US006155666A

United States Patent [19]

Sugimoto et al.

[11] Patent Number: 6,155,666

[45] **Date of Patent: *Dec. 5, 2000**

[54] EJECTOR, INK JET CARTRIDGE, INK JET PRINTING APPARATUS AND INK JET HEAD KIT HAVING THE SAME, INK JET PRINTING METHOD USING THE EJECTOR, AS WELL AS PRINTED PRODUCTS OBTAINED BY EMPLOYING THE METHOD OR APPARATUS

[75] Inventors: Hitoshi Sugimoto, Yokohama; Makoto Torigoe, Tokyo; Jiro Moriyama, Kawasaki; Shigeyasu Nagoshi, Yokohama; Hiroshi Tajika, Yokohama; Toshiharu Inui, Yokohama; Tetsuhiro Nitta, Yokohama; Kiichiro Takahashi; Fumihiro Gotoh, both of Kawasaki; Masaya Uetsuki, Yokohama; Hiroshi Yoshino, Yokohama; Masao Kato, Yokohama; Minako Kato, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/513,520

[22] Filed: Aug. 10, 1995

[30] Foreign Application Priority Data

| | | | |
|---|---|---|---|
| Aug. 10, 1994 | [JP] | Japan | 6-188186 |
| Feb. 13, 1995 | [JP] | Japan | 7-023586 |
| Feb. 13, 1995 | [JP] | Japan | 7-047826 |
| Aug. 8, 1995 | [JP] | Japan | 7-202635 |

[51] Int. Cl.[7] ..... B41J 2/165

[52] U.S. Cl. ..... 347/24; 347/30; 347/35; 347/36

[58] Field of Search ..... 347/24, 30, 33, 347/21, 95, 22–36

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |

(List continued on next page.)

FOREIGN PATENT DOCUMENTS

| | | |
|---|---|---|
| 53-24486 | 3/1978 | Japan . |
| 54-43733 | 4/1979 | Japan . |
| 54-56847 | 5/1979 | Japan . |
| 56-84992 | 7/1981 | Japan . |
| 59-123670 | 7/1984 | Japan . |

(List continued on next page.)

*Primary Examiner*—Peter S. Wong
*Assistant Examiner*—Bao Q. Vu
*Attorney, Agent, or Firm*—Fitzpatrick, Cella, Harper & Scinto

[57] ABSTRACT

An in ink jet printing method and apparatus are disclosed which prevents mixing of ink with a liquid insolubilizing and/or agglomerating the ink and which can print images having excellent water resistance and high quality. Prevention of mixing of the ink with the liquid is achieved by separately arranging an ink receiver for receiving ink ejected by preliminary ejection and the liquid insolubilizing and/or agglomerating the ink ejected by preliminary ejection, or by setting the distance between the ink jet cartridge for the liquid and the cartridge for ink adjacent thereto is made larger than the distance between two adjacent ink jet cartridges. Alternatively, the direction of ejecting ports of an ink jet ejectors may be deviated. Prevention of mixing may also be achieved by using in addition to printing head ejecting ink onto a printing material, a printability improving liquid ejecting head ejecting a printability improving liquid which insolubilizes and/or agglomerates the coloring material in the ink, and recovering units for recovering the heads. Also, mixing of the ink with the liquid is prevented upon capping, wiping, suction recovering.

16 Claims, 72 Drawing Sheets

U.S. PATENT DOCUMENTS

| | | | |
|---|---|---|---|
| 4,459,600 | 7/1984 | Sato et al. | 346/140 R |
| 4,463,359 | 7/1984 | Ayata et al. | 346/1.1 |
| 4,506,277 | 3/1985 | Terasawa | 347/36 |
| 4,538,160 | 8/1985 | Uchiyama | 346/140 R |
| 4,558,333 | 12/1985 | Sugitani et al. | 346/140 R |
| 4,608,577 | 8/1986 | Hori | 346/140 R |
| 4,723,129 | 2/1988 | Endo et al. | 346/1.1 |
| 4,740,796 | 4/1988 | Endo et al. | 346/1.1 |
| 4,894,667 | 1/1990 | Moriyama | 346/140 R |
| 4,965,596 | 10/1990 | Nagoshi et al. | 347/36 |
| 5,023,630 | 6/1991 | Moriyama | 346/140 R |
| 5,155,497 | 10/1992 | Martin et al. | 347/33 |
| 5,164,747 | 11/1992 | Osada et al. | 346/140 R |
| 5,166,699 | 11/1992 | Yano et al. | 346/1.1 |
| 5,221,931 | 6/1993 | Moriyama | 346/1.1 |
| 5,343,227 | 8/1994 | Hirosawa et al. | 349/42 |
| 5,367,325 | 11/1994 | Yano et al. | 347/17 |
| 5,396,271 | 3/1995 | Premnath | 347/33 |
| 5,555,008 | 9/1996 | Stoffel et al. | 347/100 |
| 5,606,354 | 2/1997 | Bekki et al. | 347/33 |
| 5,608,432 | 3/1997 | Yamaguchi | 347/33 |
| 5,617,124 | 4/1997 | Taylor et al. | 347/35 |
| 5,625,385 | 4/1997 | Suzuki | 347/24 |
| 5,635,969 | 6/1997 | Allen | 347/96 |
| 5,680,162 | 10/1997 | Taylor et al. | 347/35 |

FOREIGN PATENT DOCUMENTS

| | | |
|---|---|---|
| 59-138461 | 8/1984 | Japan . |
| 60-71260 | 4/1985 | Japan . |
| 62-38155 | 8/1987 | Japan . |
| 64-63185 | 3/1989 | Japan . |
| 5-202328 | 8/1993 | Japan . |

FIG24.D

EJECTOR, INK JET CARTRIDGE, INK JET PRINTING APPARATUS AND INK JET HEAD KIT HAVING THE SAME, INK JET PRINTING METHOD USING THE EJECTOR, AS WELL AS PRINTED PRODUCTS OBTAINED BY EMPLOYING THE METHOD OR APPARATUS

BACKGROUND OF THE INVENTION

1. Field of the Invention

The present invention relates to an ejector, an ink jet cartridge, ink jet printing apparatus and ink jet head kit having such an ejector, an ink jet printing method using such an ejector, as well as printed products obtained by employing such a method or apparatus. More particularly, the present invention relates to method and apparatus for printing by ejecting an ink and a liquid for improving the printability of the ink on a material to be printed. Further, the present invention relates to an ink ejector for ejecting an ink or a printability improving liquid for use in an ink jet printing apparatus or method and to an ink jet cartridge for use in an ink printing apparatus.

The present invention is applicable to apparatuses which applies an ink onto a printing material, i.e., a medium on which printing is performed, such as cloths, threads, leathers, nonwoven fabrics, OHP paper, metal, glass as well as commonly used general paper. Specific examples of such apparatuses include business machines and apparatuses such as printers, copiers, and facsimiles, and large scale production systems and industrial production machines and apparatuses, such as textile printing apparatuses.

2. Description of Related Art

Printing apparatuses having functions of printers, copiers, facsimiles, and the like or printing apparatuses used as composite machines inclusive of computers, word processors, and the like and output machines and apparatuses for work stations are constructed so that images including characters, symbols, etc. can be printed or recorded on a printing material or printing medium (material to be printed) such as paper, plastic thin plates (sheets for OHP, etc.) based on image information. The printing apparatuses may be classified into ink jet type, wire dot type, heat-sensitive type, thermal transfer type, laser beam type, and so on depending on the type of printing by the printing means used.

In a printing apparatus of the serial-type in which main scanning is performed in the direction crossing the direction in which a printing material is transferred (sub-scanning direction), printing is performed as follows. First, after a printing material is set to a predetermined printing position, images inclusive of characters, symbols, etc. are printed by the printing means mounted on the carriage which moves along the printing material (main scanning) until printing for one line is completed. Then, a predetermined amount of paper is fed (sub-scanning), and then images for next line are printed. This procedure is repeated until images are printed over a desired area of the printing material. On the other hand, in a printing apparatus of the line type in which printing is performed by sub-scanning, i.e., feeding a printing material in the direction of transferring a printing material, the printing material is set to a predetermined printing position and printing for a whole line en bloc is performed continuously, while feeding a predetermined amount of paper or printing material (pitch feeding), so that images can be printed over the whole predetermined area of the printing material.

Among the printing apparatuses, a printing apparatus of the ink jet type (ink jet printing apparatus) ejects ink on a printing material from a printing means (printing head). The ink jet printing apparatus of the type has various advantages in that it is easy to make the printing means compact in size, it can print high precision images in high speed, it can print on normal paper without resort to any special treatment, it runs at a low cost, it works with less noises since it is of the non-impact type, and it allows printing color images using multiple color inks. Of these, much higher speed printing can be attained with the line-type printing apparatus which uses a line-type printing means having an array of a number of ejecting ports arranged along a direction of the width of paper.

In particular, it is advantageous to use a printing means (printing head) of the ink jet type which ejects an ink making use of thermal energy since it is possible to readily manufacture one having an arrangement of liquid passages or ejecting ports or orifices at a high density, thus facilitating further reduction in size, by forming on a substrate films of an electrothermal transducer, electrode, liquid passage wall, a top plate, and so on. Also, utilization of the advantages of IC technology and micro-processing technology, makes it easy to fabricate a printing means in a longer form or in a planar form (two-dimensional structure) and to modify the printing means into the so-called full-multicolor type one which enables full-line type printing in multiple colors and to mount the printing means on a printing head or a printing apparatus at a high density. On the other hand, there have been various requirements for the material of the printing material. Recently, there has been an increasing demand for use of thin paper, processed paper such as punched paper for filing, seamed paper, paper having a desired non-standardized size or form, or the like in addition to usual printing materials such as paper and resin thin plates.

As described above, the ink jet printing apparatus is used widely as a printing apparatus such as a printer, a copying machine because of its low noise, low running cost, ease of down sizing, ease of arrangement for multi-color printing construction. However, in the case where images are printed on a so-called normal paper as a printing material by one of these printing apparatuses of ink jet printing type, sometimes images have insufficient water resistance, or when printing color images is contemplated, high concentration images that cause no feathering do not stand together with images that cause no blurring among the colors. Thus, it is difficult to obtain durable, high quality color images.

In order to increase water resistance of images, there is used a printing method which employs an ink containing a coloring material having a resistance to water. Recently, such a method has been put into practice. However, the water resistance is yet insufficient, and the ink in principle is difficult to be dissolved in water once it is dried so that the ejecting ports of the printing head tend to be clogged. Naturally, in order to prevent such a clogging, the printing apparatus requires complicated arrangements.

Japanese Patent Application Laying-open No. 84992/1981 discloses a method for preparing a large amount of a printing paper by coating a material for fixing a dye in an ink to be used on a printing paper in advance prior to printing with the ink. However, this method have various disadvantages in that it is necessary to perform printing using the special printing paper thus prepared in advance, and the precoating of a printing material with a material for fixing the dye inevitably results in a need of employing a larger apparatus for preparing a special purpose printing paper on a large scale and in an increase in cost, and further, it is difficult to coat the above-described material for fixing the dye on a printing paper in a predetermined film thickness uniformly upon preparing the special purpose printing paper.

Japanese Patent Application Laying-open No. 63185/1989 discloses the technology in which a colorless ink for insolubilize a dye is deposited on a printing paper by means of an ink jet printing head. Japanese Patent application Laying-open No. 202328/1993 discloses technology for obtaining water resistant images without color bleeding by applying on a printing paper a solution of a polyvalent metal salt solution and then an ink containing a chemical dye having a carboxyl group. However, as in these technologies, in the case where the solution which insolubilizes a dye is ejected by an ink jet printing head, a problem arises in that the printing apparatus comes to be out of order when the printing ink and the solution for the insolubilization of the ink come into contact each other in the body of the apparatus. There is no teaching or suggestion in the prior art on the arrangement of printing apparatus that have overcome such a problem.

Further, many technologies have been disclosed that increase the durability of images on the printing material. Japanese Patent Application Laying-open No. 24486/1978 discloses the technology in which the printed material is post-treated to convert the dye into a lake and have it fixed in order to increase the moisture durability of the printed material. In particular, Japanese Patent Application No. 43733/1979 discloses the printing method in which two or more components are used whose film-forming properties increase at a normal temperature or upon heating when they are contacted each other. According to this method, there can be obtained printed materials having formed a strongly bonded coating by the contact of the components on the printing material. Japanese Patent Application Laying-open No. 150396/1980 (Japanese Patent Application Publication No. 38155/1987 discloses the printing method in which after ink jet printing is performed using an aqueous dye ink, there is given a water resistance-imparting agent which forms a lake with the dye.

U.S. Pat. No. 4,538,160 discloses an ink jet printing method in which the position of an image to be printed is discerned in advance and a printing ink and a processing ink (liquid for improving the printability of the ink) are applied one over another. Various variations are disclosed. For example, prior to the application of a printing ink, an image may be formed with the processing ink. The processing ink may be applied over the image previously formed with the printing ink. Or, first the processing ink may be applied to form an image, then the printing ink applied over the image with the processing ink, followed by applying again the processing ink over the image. However, the above-described Japanese publications fail to disclose in substance recovering means for maintaining reliability of ejection, head structure, tank structure, printing mode for increasing the quality of printed images, which are specific to ink jet printing apparatuses.

On the other hand, ink jet printing methods by nature have the following problems. First, since printing is performed by ejecting ink droplets from a printing head onto a printing material such as paper or OHP film, fine ink droplets (mist) generated in addition to the ejected main ink droplets and ink droplets rebound on the printing material adhere on the surface of each ejecting port plane which is provided with ejecting ports and the ink accumulates in large amounts around the ejecting ports or foreign matter such as paper powder, etc. adheres thereto, resulting in that normal ejection of ink is prevented so that the ink is ejected in an unexpected or undesired direction (distortion), or ink droplets are not ejected (non-ejection).

Next, after the non-printing condition is continued for a prolonged period of time and the printing head has not ejected for a long time, the ink in the ejecting ports evaporates and dries so that the thickened or solidified ink clogs in the ejecting ports to cause an ejection failure such as a distorted ejection or a non-ejection. For this reason, ink jet printing systems are each provided with a recovering means.

As a means for wiping out unnecessary ink and foreign matter such as paper powder on the surface of an ejecting port plane due to the above-described mist or rebound ink droplets from the printing material, a recovering means is generally adopted which has an arrangement in which the surface of the ejecting port plane is wiped with a blade made of an elastic material such as rubber. When the surface of the ejecting port plane of the printing head is wiped with a blade, the ink naturally adheres to the blade. In a printing apparatus having two or more printing heads arranged side by side and allowing color image printing using different color inks, an ink which adhered to the blade in wiping the first printing head mixes with another ink of a different color which adhered to the blade during the wiping of the second printing head for a different color ink than the color of the first printing head.

The following contents relate to technical themes discovered by the present inventors during the development in Canon Kabushiki Kaisha, and unknown publicly.

In a printing apparatus having mounted thereon a printability improving liquid ejecting head which ejects a solution that solubilizes or agglomerates the dye or coloring material in the ink (printability improving liquid), wiping the printing head and the printability improving liquid ejecting head with the same blade results in mixing of the ink with the printability improving liquid on the blade or on the ejecting port plane of the printing head. As a result, the wiping leads to clogging of the ejecting ports with the solubilized or agglomerated coloring material (dye), thus causing non-ejection frequently, so that most of the ejecting ports fail to eject the ink normally. It has also been found that when the non-ejection of the printability improving liquid occurs frequently, the water resistance of the images deteriorates partially or sometimes unevenness of the images occurs.

That is, it has been found that at the time of wiping, the ink or printability improving liquid rubbed off contact each other on the blade or on the ejecting port planes, and the insolubilized or agglomerated dye adheres to or clogs the ejecting ports to generate a distorted ejection or non-ejection of ink. Further, it has been found that in the case of a color ink jet printing apparatus, wiping a plurality of printing heads with only one blade increases the amount of inks which adheres to the blade and causes contamination of inks, thus giving more adverse effects.

In an ink jet printing apparatus, the following construction is generally adopted in order to overcome the problems of a distorted ejection or non-ejection caused by the evaporation and drying of ink in the ejecting ports. That is, the printing head is closed with a cap at the time of non-printing to prevent the evaporation and drying of the ink in the ejecting ports, which results in the thickening or insolubilization of the ink. If the ink thickens or solidifies to cause ejection failure, or if there exists foreign matter which has not been removed with the blade, the thickened ink in the ejecting ports and the foreign matter on the surface of the ejecting port plane together with the ink are sucked and discharged using a suction pump connected to the cap so that a normal ejection state can be recovered. The ink or printability improving liquid discharged is absorbed by an absorber for waste ink disposed in the body of the printing apparatus through a tubing arranged in the downstream of the suction pump.

For example, if the pump for the suction and recovery is used commonly for various inks (printing ink or inks and printability improving liquid for the ink or inks) as in the conventional techniques, the ink or inks could insolubilize in the pump to cause disorder of the pump. Further, the ink agglomerate or insolubilizes in a waste ink tank for storing a waste ink or inks, a porous absorber contained in the waste ink tank decreases in its absorbability, so that leakage of ink tends to occur.

In the arrangement in which a liquid which insolubilizes the dye in an ink is ejected by the ejector of an ink jet printing apparatus, there is a fear that the ink and the printability improving liquid come into contact and mix with each other, and in that case the insolubilization of the dye in the ink could bring the printing apparatus into disorder or cause its failure. For example, problems relate to real ejection and preliminary ejection, respectively. Both the problems affect the quality and efficiency of printing to a large extent.

In the printing action of the on-demand type ink jet printing apparatus, not all of a plurality of ejecting ports provided in a single printing head is always used. There are some unused ejecting ports that have not been used for at least a certain period of time. In the case of a color printing apparatus having a plurality of printing heads, there may be the case where the whole printing head to which no data is transferred (which does not print) is unused. If the carriage is scanned or stopped with the surface of the ejecting port plane being uncapped, the ink on the ejecting port plane or in the ejecting ports, of which no ejection of ink continues for a predetermined time, evaporates and dries, thus causing a decrease in the ejection ability and a decrease in the quality of printed images.

To prevent such undesirable phenomena as described above from occurring, an ink jet apparatus generally performs an ejection of ink at a predetermined position at a predetermined time interval regardless of whether or not printing data are transmitted so that the ink in the ejecting ports can be discharged and replaced by fresh ink and the ejection can always be maintained in a proper state. Such an action of ejection of an ink is called a "preliminary ejection". The ejected ink discharged by the preliminary ejection is directed toward a cap arranged in a recovering unit or discharged toward a location called a "preliminary ejection position" arranged separately in order for the ejected ink not to scatter onto the printing material or in the printing apparatus and generate a contamination. However, if the pump at the preliminary ejection position is used commonly for the ink and the printability improving liquid, the ink is insolubilized and deposits in the pump to sometimes cause a discharge failure.

The ejected ink ejected by the preliminary ejection is ejected in a cap in an ejection recovering unit or an ink receiver arranged separately from the cap, and finally is stored in a waste ink tank or a waste ink absorber so that it does not scatter on a printing material or in the body of the printing apparatus and contaminate them. However, in the arrangement in which the preliminary ejection is carried out in a cap, it is necessary to suck the ink which accumulates in the cap by the preliminary ejection, and an action such as a displacement of the printing head for the suction is performed, which results in a decrease in throughput.

Provision of separate ink receivers for receiving the ink ejected by the preliminary ejection could solve such a problem as described above. However, if the ink and the printability improving liquid which agglomerates or insolubilizes the coloring material such as the dye contained in the ink are ejected in one and the same ink receiver, agglomeration of the coloring material occurs within the receiver, and in addition evaporation and thickening of the ink clogs the waste ink passage communicating from the ink receiver to the waste ink tank so that the ink received at the time of the preliminary ejection cannot be discharged and to be worse the ink or the printability improving liquid overflows from the receiver to cause a contamination of the inside or body of the printing apparatus.

FIGS. 1A, 1B and 1C schematically illustrate the clogging of a waste ink passage.

In the arrangement in which an ink and a printability improving liquid are ejected into a single ink receiver 400, the ink and the liquid mix with each other on a wall of the ink receiver 400 to cause an agglomeration of the ink to deposit an agglomerate 405, which grows bigger and narrows the liquid passage as shown in FIG. 1B until it clogs the entire liquid passage as shown in FIG. 1C, resulting in that the ink cannot reach a waste ink absorber 411 contained in a waste ink absorber 410. If the preliminary ejection is performed toward the ink receiver in such a clogged state as described above, portions of the ink and liquid that are not contained in the ink receiver overflow in the inside of the printing apparatus and contaminates it.

Further, in an ink jet printing apparatus provided with a plurality of ejectors, mist generated from one ejector would adhere onto the surface of an ejecting port plane of another ejector. In particular, mist generated by an ejector preceding in the direction of scanning of the carriage tends to adhere to another ejector that follows the preceding one.

As described above, the arrangement is generally adopted in which the ejecting port plane is wiped with a blade made of an elastic material such as rubber in order to remove or wipe off an unnecessary ink on the ejecting port plane around the ejecting port due to the mist and rebound ink droplets from the printing material as well as foreign matter such as paper powder.

However, once mists of the ink and printability improving liquid adhere onto the ejecting port planes of the ejectors for the ink and the liquid, there occurs insolubilization or agglomeration of the coloring material in the ink so that not only it is difficult to remove with a blade but also there arises a problem of ejection failure.

FIG. 2 is a schematic perspective view showing an outline of the construction a conventional ink jet printing apparatus. FIG. 3 is a schematic diagram illustrating the wiping action of the blade in the printing apparatus shown in FIG. 2. In FIGS. 2 and 3, a printing head 1003, which ejects an ink from a plurality of ejecting ports provided in a surface 1001 of an ejecting port plane and prints an image on a printing material 1002 (printing medium such a printing paper), is mounted on a carriage 1004 with alignment. The carriage 1004, supported by a guide shaft 1005, moves to and fro along the guide shaft 1005 which guides the direction of the movement of the carriage 1004, facing the printing material 1002. The printing material 1002 is transported (fed) according as transfer rolls 1007 and 1008 rotate. The printing material 1002 after printing is discharged out of the printing apparatus by discharge rolls 1009 and 1010.

The foreign matter such as paper powder or ink droplets which adhered to the surface 1001 of the ejecting port plane of the printing head 1003 are removed or wiped off by a wiper (wiping member) 1006 positioned outside an image forming region (printing region). At a position outside the printing region are provided caps 1011 for covering the surface 101 of the ejecting port plane to prevent drying of the ink in the ejecting ports or clogging of the ejecting ports, or for absorbing and discharging the ink from the ejecting ports by means of a pump, etc.

Hereinafter, the action of the wiper 1006 for wiping or cleaning the surface 1001 of the ejecting port plane of the printing head 1003 will be described. In FIG. 3, the conditions a, b and c of the wiper 1006 indicate the states of before a wiping action, during a wiping action, and after a wiping action, respectively. When the carriage 1004 moves in the direction indicated by the arrow A, i.e., from the right to the left in FIG. 3, the printing head 1003 mounted on the carriage 1004 also moves in the same direction as above. According as the printing head 1003 moves, the tip portion of the wiper 1006 is urged in flank and bent so that the tip portion moves while being pressed against the ejecting port plane 1001 at a proper pressure.

In other words, since the printing head 1003 moves (or passes) with the wiper 1006 being bent and pressed thereagainst, the foreign matter or ink adhering to the surface 1001 of the ejecting port plane is wiped off by the tip portion of the wiper 1006. After the printing head 1003 has passed completely, the wiper 1006 reverts to the original shape (upright figure as shown in FIG. 3, the condition c) due to its resilience. Cleaning the surface 1001 of the ejecting port plane by a series of the above-described wiping actions allows ejection of an ink to occur in a proper state stably so that high quality images can be printed.

However, the ink jet printing apparatus using in combination the cleaning means for cleaning the surface of the ejecting port plane with a wiper and the technology of using a printability improving liquid for improving the printability of the ink and having a head for ejecting the printability improving liquid has the following three technical problems. Firstly, after repeated wiping, the ink and the printability improving liquid adhere to the wiper and their reaction product fixes thereon so that the wiping ability of the wiper decreases gradually. As a result, the unnecessary matter adhering to the surface of the ejecting port plane cannot be removed sufficiently, thus causing a distorted ejection or an ejection failure to finally deteriorate the quality of printed images.

Secondly, in case the liquid ejecting head and the ink ejecting head are to be cleaned successively, the printing head has to be cleaned just after the liquid ejecting head is cleaned, since one wiper cleans both the liquid ejecting head and the ink ejecting head, with the printability improving liquid remaining on the surface of the wiper, resulting in that the liquid reacts with the ink to for a reaction product which fixes on the ejecting port plane. This causes an ejection failure, and at worst, a recovery of the heads becomes impossible even by the use of the above-described recovering means.

Thirdly, when two wipers are driven in accordance with the liquid ejecting head and the ink ejecting head, it takes a longer time to complete wiping and the printing speed of the printing apparatus decreases. However, none of the prior art references does teach or suggest a recovering means or the like which solves the technical problem on the ejection of an ink that is specific to ink jet printing apparatuses and which allows the maintenance of reliability of ejection of an ink and the maintenance of performance of the printing apparatus.

As described above, the prior art referred to above fails to teach or suggest disorders occurring in the printing apparatus due to the fixing of an ink with a printability improving liquid for improving the printability of the ink and arrangement for solving the problem.

SUMMARY OF THE INVENTION

In order to solve the above-described problems, a first object of the present invention is to provide an ink jet printing apparatus in which an ink and a liquid for improving the printability of the ink are ejected from ejectors, in which the occurrence of problems due to the mixing, or otherwise interacting, of the ink with the liquid is prevented previously, and which allows printing images of high quality and having water resistance.

A second object of the present invention is to provide an ink jet printing apparatus which can perform printing images of a high quality with a high reliability that show an excellent water resistance on normal paper but do not show feathering nor color bleeding upon color printing and which at the same time can perform an ejection o an ink with a high reliability without the agglomeration or fixation of the ink in the printing apparatus or clogging of the ejecting ports of the printing head.

A third object of the present invention is to provide a highly reliable ink jet printing apparatus which can prevent the deterioration of the quality of images which would otherwise occur due to nonalignment of positions of the printing dots because of the deterioration of the wiping ability of the wiper.

A fourth object of the present invention is to provide an ink jet printing apparatus including the above-described head which ejects a printability improving liquid for improving the printability of an ink and allowing maintenance of high quality of printed materials thereby and enabling high quality printing and high speed printing with a low cost construction.

A fifth object of the present invention is to provide an ink jet printing method in which an ink and a liquid for improving the printability of the ink are ejected from ejectors, in which the occurrence of problems due to the mixing, or otherwise interacting, of the ink with the liquid is prevented previously, and which allows printing images of a high quality and having a sufficient water resistance.

A sixth object of the present invention is to provide an ink jet printing method which can perform printing images of a high quality with a high reliability that show an excellent water resistance on normal paper but do not show feathering nor color bleeding upon color printing and which at the same time can perform ejection of ink with high reliability without agglomeration or fixation of the ink in the printing apparatus or clogging of the ejecting ports of the printing head.

A seventh object of the present invention is to provide an ink jet printing method of a high reliability which can prevent deterioration of the quality of images which would occur due to nonalignment of positions of the printing dots because of deterioration of the wiping ability of the wiper.

An eighth object of the present invention is to provide an ink jet printing method using a liquid ejecting head which ejects a printability improving liquid for improving the printability of an ink and allowing maintenance of high quality of printed materials thereby and enabling high quality printing and high speed printing with a low cost construction.

A ninth object of the present invention is to provide an ejector for use in an ink jet printing apparatus which, when mounted in the ink jet printing apparatus, can prevent the occurrence of mixing of a liquid ejected from one ejector with another liquid ejected from another ejector.

A tenth object of the present invention is to provide an ink jet cartridge having such an ejector.

An eleventh object of the present invention is to provide a method for refilling an ink in an ink tank in such an ink jet cartridge.

A twelfth object of the present invention is to provide a printed material prepared using such an ink jet printing apparatus or method.

According to a first aspect of the present invention, there is provided an ink jet printing apparatus for printing which uses a first ejector for ejecting an ink and a second ejector for ejecting a printability improving liquid for improving printability of the ink and performs printing on a printing material by ejecting the ink and the printability improving liquid from the first and second ejectors, respectively, on the printing material, the apparatus comprising: a mixing preventing means for taking an effect of substantially preventing mixing of the ink with the printability improving liquid except for their mixing on the printing material on which printing is to be performed.

Here, the mixing preventing means may comprise a recovering means for recovering the first ejector which ejects the ink, and a second recovering means for recovering only the second ejector that ejects the printability improving liquid.

The recovering means may comprise first and second wiping members for at least the first and second ejectors, respectively.

The wiping means may wipe in a direction in which the ejecting ports of the ejectors are arranged.

The first and second wiping members may wipe in different directions from one another.

The second ejector may have an ejecting port plane which is displaced from an ejecting port plane of the first ejector by a distance larger than an amount of invasion of the first wiping member toward the ejecting port plane of the first ejector.

The first wiping member for the first ejector and the second wiping member for the second ejector may be not adjacent each other.

The first wiping member for the first ejector may be arranged on a side of a printing region and the wiping member for said second ejector may be arranged on a side opposite thereto.

The recovering means may comprise separate first and second cap means for capping the first and second ejectors, respectively, and separate first and second absorbing means for absorbing the ink and the printability improving liquid, respectively.

The first cap means for capping the first ejector and the second cap means for capping the second ejector may be not adjacent to each other.

The first cap means for capping the first ejector may be arranged on a side of a printing region and the second capping means for capping the second ejector is arranged on an opposite side thereto.

The recovering means may comprise an absorbing means which performs ink absorption for the first ejector and ink absorption for the second ejector simultaneously or independently of each other.

The absorbing means may be a tube pump comprising a resilient tube and performs an absorption when the tube is stroked.

The recovering means may comprise at least one wiping member for wiping ejecting port planes of the first and second ejectors, respectively, by a relative movement, a wiping surface of the wiping member contacting the ejecting port plane of the first ejector exclusively, and another wiping surface of the wiping member contacting the ejecting port plane of the second ejector.

The recovering means may comprise separate first and second capping means for the first and second ejectors, respectively, and absorbing means for performing ink absorption communicating to the first and second capping means, respectively.

The ink jet printing apparatus may further comprise a waste liquid tank having an absorber, wherein a waste ink and a waste printability improving liquid absorbed and discharged from the first and second ejector by each absorbing means are absorbed by the absorber in the waste tank through separate passages.

The recovering means may comprise a wiping member, the wiping member being arranged so that it does not contact the ejecting port plane of the second ejector.

The first ejector may be arranged on each side of the second ejector along the direction of scanning, and each of the first and second ejectors is provided with a recovering means for exclusive use.

The recovering means may comprise at least one wiping means for wiping ejecting port planes of the first and second ejectors by relative movement, and wherein the wiping means contacts the ejecting port planes of the first and second ejectors, respectively, at different regions of the same wiping surface of the wiping means.

The wiping means may be movable in the direction in which ejecting ports of the ejector are arrayed.

The movement of the wiping means in the direction in which ejecting ports are arrayed may be performed by relative movement of the ejector.

The movement of the wiping means in the direction in which ejecting ports are arrayed may be performed by relative movement of the ejector and engagement with a striking portion provided in the ejector.

The recovering means may comprise an ink receiver which receives an ink ejected by preliminary ejection from the first ejector; and a liquid receiver which receives a printability improving liquid for improving the printability of the ink, the printability improving liquid being ejected by preliminary ejection from the second ejector, the liquid receiver being arranged separately from the ink receiver.

The ink receiver for receiving an ink from the first ejector and the ink receiver for receiving a printability improving liquid for improving the printability of the ink may be not adjacent to each other.

The ink receiver for the first ejector may be arranged on a side of printing region and the liquid receiver for the second ejector is arranged on a side opposite thereto with respect to the recovering means.

The liquid receiver may be arranged in a conveying route for conveying a printing material.

The liquid receiver may be arranged outside the printing region.

The ink jet printing apparatus may further comprise a means for performing preliminary ejection when the printing material is on the conveying route, the preliminary ejection being at a position on the printing material which position corresponds to a position at which the liquid receiver is arranged.

The mixing preventing means may comprise a means for performing on a printing material preliminary ejection by the second ejector which ejects the printability improving liquid.

The ink jet printing apparatus may further comprise a means for performing the preliminary ejection by the second ejector on the printing material outside a printing region.

The mixing preventing means may comprise a means for changing a position of preliminary ejection by the second ejector depending on whether or not a printing material is present.

The mixing preventing means may comprise the first and second ejectors arranged so that they eject in different directions from one another.

The ejecting port planes of the first and second ejectors may be inclined with respect to a printing surface, and wherein the first and second ejectors are oppositely inclined from each other.

The ejecting ports of the first and second ejectors may have respective center lines at a predetermined angle with respect to a plane vertical to a plane which is to be parallel when the first and second ejectors are mounted in the ink jet printing apparatus.

The first and second ejectors may have liquid passages which energize the ink and the printability improving liquid for ejection, wherein the mixing preventing means has an energizing means for energizing the ink and the printability improving liquid in the liquid passages, respectively, in different directions than those in which the ink and the printability improving liquid flow and also different from each other, whereby the ink and the printability improving liquid are ejected from the ejecting ports of the first and second ejectors, respectively in different directions from each other.

The first and second ejectors may have liquid passages which energize the ink and the printability improving liquid for ejection, and wherein the mixing preventing means has an ejection direction changing means for changing directions in which the ink and the printability improving liquid in the liquid passages, respectively, are ejected into different directions than those in which the ink and the printability improving liquid flow and also different from each other, whereby the ink and the printability improving liquid are ejected from the ejecting ports of the first and second ejectors, respectively in different directions from each other.

The mixing preventing means may be provided between the first and second ejectors with a means for suppressing adherence of mist generated from one of the first and second ejector to the other of the first and second ejectors.

The ink jet printing apparatus may be constructed such that a distance between the ejecting port plane of the second ejector and the printing material is larger than a distance between the ejecting port plane of the first ejector and the printing material.

The mixing preventing means may comprise: a first wiping means for cleaning the ejecting port plane of the first ejector; a second wiping means for cleaning the ejecting port plane of the second ejector; a first positioning means for determining a relative position between the first ejector and the first wiping means; and a second positioning means for determining a relative position between the second ejector and the second wiping means; wherein as a carriage having mounted thereon the first and second ejector and movable scans, the first and second wiping means moves up and down independently of each other, the first wiping means cleaning the first ejector only and the second wiping means cleaning the second ejector only.

The second ejector may comprise a plurality of ejectors.

The first ejector may comprise a plurality of ejectors.

The ink jet printing apparatus may further comprise a stroke controlling means for retracting the first and second wiping means to positions where the first and second positioning means do not function.

The ink jet printing apparatus may further comprise: a carriage having mounted thereon the first and second ejectors and capable of reciprocating motion along a guide member; a first wiper for cleaning an ejecting port plane of the first ejector; a second wiper for cleaning an ejecting port plane of the second ejector; a first wiper holder for holding the first wiper; a second wiper holder for holding the second wiper; an urging means for urging the first and second wiper holders toward the first and second ejectors, respectively; a controlling means for controlling strokes of the first and second wiper holders against the urging means; a first projection provided in the first wiper holder; a first striking portion provided in the carriage corresponding to the first ejector and the first projection; and a second striking portion provided in the carriage corresponding to the second ejector and the second projection; wherein when no cleaning of the ejecting port planes of the first and second ejectors is necessary, the first and second wiper holders are retracted to positions where the first and second wiper do not interfere with the first and second ejectors by the controlling means, while when cleaning of the ejecting port planes of the first and second ejectors is necessary, the first and second wiper holders are under less control by the controlling means to return to positions where the first and second wipers interfere with the first and second ejectors, so that upon movement of the carriage along the guide member, the first and second striking portions contact the first and second projections, respectively, whereby the first wiper cleans the first ejector only and the second wiper cleans the second ejector only.

The second ejector may comprise a plurality of ejectors.

The first ejector may comprise a plurality of ejectors.

The ink jet printing apparatus may further comprise: a carriage having mounted thereon the first and second ejectors and capable of reciprocating motion along a guide member; a first wiper for cleaning an ejecting port plane of the first ejector; a second wiper for cleaning an ejecting port plane of the second ejector; a first wiper holder for holding the first wiper; a second wiper holder for holding the second wiper; an urging means for urging the first and second wiper holders toward the first and second ejectors, respectively; a controlling means for controlling strokes of the first and second wiper holders against the urging means; a first projection provided in the first wiper holder; a first striking portion provided in a portion of the ejector corresponding to the first projection; and a second striking portion provided in a portion of the second ejector corresponding to the second projection; wherein when no cleaning of the ejecting port planes of the first and second ejectors is necessary, the first and second wiper holders are retracted to positions where the first and second wiper do not interfere with the first and second ejectors by the controlling means, while when cleaning of the ejecting port planes of the first and second ejectors is necessary, the first and second wiper holders are under less control by the controlling means to return to positions where the first and second wipers interfere with the first and second ejectors, so that upon movement of the carriage along the guide member, the first and second striking portions contact the first and second projections, respectively, whereby the first wiper cleans the first ejector only and the second wiper cleans the second ejector only.

The first ejector may comprise a plurality of ejectors which ejects different colors, respectively, and wherein a distance between any adjacent two of the first ejectors is larger than a distance between the second ejector and one of the first ejectors which is adjacent to the second ejector.

The distance between the second ejector and the one of the first ejectors which is adjacent to the second ejector may be not shorter than 1.5 cm.

The first ejector may be arranged at a distance from the second ejector such that mist generated from one of the first and second ejectors does not substantially adhere to the other of the first and second ejectors.

The first and second ejectors may eject the ink and the printability improving liquid, respectively, utilizing thermal energy, and further each of the ejectors comprising a thermal energy generating means for generating thermal energy to be given to the ink.

The printability improving liquid may comprise a substance which has a function of insolubilizing or agglomerating a coloring material in an ink.

The printability improving liquid may comprise a low molecular weight component and a high molecular weight component comprising a cationic substance, and wherein the ink contains an anionic dye.

The printability improving liquid may comprise a low molecular weight component and a high molecular weight component comprising a cationic substance, and wherein the ink contains an anionic dye or an anionic compound and a pigment.

According to a second aspect of the present invention, there is provided an ink jet printing apparatus for printing which uses a first ejector for ejecting an ink and a second ejector for ejecting a printability improving liquid comprising a substance which has a function of insolubilizing or agglomerating a coloring material in the ink and performs printing on a printing material by ejecting the ink and the printability improving liquid from the first and second ejectors, respectively, the apparatus comprising: a first recovering means for recovering the first ejector; and a second recovering means for recovering the second ejector only.

According to a third aspect of the present invention, there is provided an ejector which is mounted on an ink jet printing apparatus upon use, comprising a mixing preventing means for substantially preventing mixing of a first ejected liquid ejected from the ejector with a second ejected liquid ejected from an other ejector.

Here, the ejector may have an ejecting port plane inclined with respect to a plane which when mounted on an ink jet printing apparatus is parallel to a printing surface of a printing material.

The ejector may be mounted on an ink jet printing apparatus, an ejecting port in the ejecting port plane has a center line crossing at a predetermined angle with respect to a plane vertical to a plane which when mounted is parallel to a printing surface of a printing material.

The ejector may further comprise: a liquid passage which energizes an ink or a printability improving liquid for ejection; and an energizing means for energizing the ink or the printability improving liquid in the liquid passage in a direction different than that in which the ink or the printability improving liquid flows.

The ejector may further comprise: a liquid passage which energizes an ink or a printability improving liquid for ejection; and an ejection direction changing means for changing a direction in which the ink or the printability improving liquid in the liquid passage into a direction different than that in which the ink or the printability improving liquid flows.

The ejector may eject the ink or the printability improving liquid utilizing thermal energy, and further comprising a thermal energy generating means for generating thermal energy to be given to the ink.

According to a fourth aspect of the present invention, there is provided an ink jet cartridge comprising: an ejector which is mounted on an ink jet printing apparatus upon use, comprising a mixing preventing means for substantially preventing mixing of a first ejected liquid ejected from the ejector with a second ejected liquid ejected from an other ejector; and an ink tank communicating to the ejector.

The ink tank may be filled with an ink.

The ink tank may be refilled with an ink.

According to a fifth aspect of the present invention, there is provided a method of refilling an ink jet cartridge, comprising the step of: introducing an ink into an ink tank of an ink jet cartridge with an ink introducing means for introducing an ink, the ink jet cartridge comprising an ejector which is mounted on an ink jet printing apparatus upon use, comprising a mixing preventing means for substantially preventing mixing of a first ejected liquid ejected from the ejector with a second ejected liquid ejected from an other ejector; and an ink tank communicating to the ejector.

According to a sixth aspect of the present invention, there is provided an ink jet printing apparatus which performs printing using an ejector which is mounted on an ink jet printing apparatus upon use, the ejector comprising a mixing preventing means for substantially preventing mixing of a first ejected liquid ejected from the ejector with a second ejected liquid ejected from an other ejector; wherein the ejector being attachable to and detachable from a body of the ink jet printing apparatus.

Here, the ejector may eject the ink or the printability improving liquid utilizing thermal energy, and further comprising a thermal energy generating means for generating thermal energy to be given to the ink.

The printability improving liquid may comprise a substance which has a function of insolubilizing or agglomerating a coloring material in an ink.

The printability improving liquid may comprise a low molecular weight component and a high molecular weight component comprising a cationic substance, and wherein the ink contains an anionic dye.

The printability improving liquid may comprise a low molecular weight component and a high molecular weight component comprising a cationic substance, and wherein the ink contains an anionic dye or an anionic compound and a pigment.

According to a seventh aspect of the present invention, there is provided an ink jet printing method using an ejector and ejecting an ink from the ejector to perform printing on a printing material, the process comprising the steps of: ejecting an ink from a first ejector; ejecting a printability improving liquid for improving the printability of the ink from a second ejector; and substantially preventing mixing of the ink ejected from the first ejector with the printability improving liquid ejected from the second ejector excepting their mixing on the printing material.

Here, preventing mixing of the ink with the printability improving liquid may comprise introducing an ink ejected from the first ejector by preliminary ejection thereof to a liquid receiving position separately arranged from a liquid receiving position where a liquid ejected from the second ejector by preliminary ejection thereof is received.

The liquid receiving position may be arranged in a conveying route for conveying the printing material.

The liquid receiving position may be arranged outside a printing region.

When the printing material is in the conveying route, preliminary ejection may be performed at a position on the printing material corresponding to the liquid receiving position.

The preventing mixing of the ink with the printability improving liquid may be performed by introducing an ink ejected from the first ejector by preliminary ejection thereof to a liquid receiving position separately arranged from a liquid receiving position where a liquid ejected from the second ejector by preliminary ejection thereof is received.

The preventing mixing of the ink with the printability improving liquid may comprise performing preliminary ejection by the second ejector ejecting the printability improving liquid on the printing material outside a printing region.

The preventing mixing may comprise changing a position of preliminary ejection by the second ejector depending on whether or not a printing material is present.

The first ejector may comprise a plurality of ejectors which ejects different colors, respectively, and wherein the preventing mixing comprises ejecting the ink and the printability improving liquid form the first and second ejectors arranged such that a distance between any adjacent two of the first ejectors is larger than a distance between the second ejector and one of the first ejectors which is adjacent to the second ejector.

The distance between the second ejector and the one of the first ejectors which is adjacent to the second ejector may be not shorter than 1.5 cm.

The preventing mixing may comprise ejecting the printability improving liquid from the second ejector in a direction different from a direction in which the ink from the first ejector is ejected.

The preventing mixing may comprise ejecting the ink and the printability improving liquid through ejecting ports, respectively, each inclined with respect to a printing surface, and wherein the first and second ejectors are oppositely inclined from each other.

The ink and the printability improving liquid may be ejected through ejecting ports arranged in a direction crossing at a predetermined angle to a plane which is to be parallel to a printing surface when the first and second ejectors are mounted in the ink jet printing apparatus.

The first and second ejectors may have liquid passages which energize the ink and the printability improving liquid for ejection, and wherein the preventing mixing comprises energizing the ink and the printability improving liquid in the liquid passages, respectively, in different directions than those in which the ink and the printability improving liquid flow and also different from each other, whereby the ink and the printability improving liquid are ejected from the ejecting ports of the first and second ejectors, respectively in different directions from each other.

The first and second ejectors may have liquid passages which energize the ink and the printability improving liquid for ejection, and wherein the preventing mixing comprises changing directions in which the ink and the printability improving liquid in the liquid passages, respectively, are ejected into different directions than those in which the ink and the printability improving liquid flow and also different from each other, whereby the ink and the printability improving liquid are ejected from the ejecting ports of the first and second ejectors, respectively in different directions from each other.

The preventing mixing may comprise substantially suppressing adherence of mist generated from one of the first and second ejector to the other of the first and second ejectors.

The first ejector may be arranged at a distance from the second ejector such that mist generated from one of the first and second ejectors does not substantially adhere to the other of the first and second ejectors.

According to an eighth aspect of the present invention, there is provided a printed material obtained by printing using the above ink jet printing apparatus.

According to a ninth aspect of the present invention, there is provided a printed material obtained by printing using the above ejector.

According to a tenth aspect of the present invention, there is provided a printed material obtained by printing by the above ink jet printing method.

Here, by the term "substantially prevent" is meant that a mixture of an ink and a printability improving liquid on the body of the ink jet printing apparatus and the surface of the ejector or head decreases to an extent such that printing can be recovered, or that the occurrence of a state in which printing is made impossible by such a mixing of an ink and a printability improving liquid can be prevented, preferably that such a mixing can be completely prevented.

The term "ejector" may include a portion of a head or different heads.

According to the above-described arrangements, ink and a printability improving liquid which contains a substance having a function of insolubilizing and/or agglomerating a coloring material such as a dye in the ink are separated in space and/or time before a printing, i.e., in a stage of preparing a printing, e.g., at the time of a preliminary ejection by ejectors, during a printing, i.e., during an ejection for printing by an ejector or in a transient stage from one scanning to another, e.g., at the time of a wiping, or after a printing, e.g., during a discharging and a storing of a waste liquid, so that the ink and the printability improving liquid do not contact each other, resulting in that they do not mix with each other, thus preventing the occurrence of inconveniences due to such a mixing, such as an ejection failure of ejectors, a contamination of the printing apparatus in the inside or body thereof, and so on. In other words, the mixing of the ink and the printability improving liquid with each other can be prevented in at least one of actions or operations that are necessary for performing a proper printing.

According to the above-described arrangements, provision of a first recovering means for recovering a first ejector for ejecting ink and a second recovery means for recovering a second ejector for ejecting a printability improving liquid prevents mixing of the ink and the printability improving liquid with each other upon recovering, thus preventing the occurrence of inconveniences due to such a mixing, such as an ejection failure, a contamination of the printing apparatus in the inside thereof.

According to the above-described arrangements, the first ejector ejecting ink and the second ejector ejecting a printability improving liquid are separately contacted by different wiping members, respectively, or by one wiping member, such that the first and second ejectors contact different areas regardless of whether the areas exist in different wiping members or in one wiping member, with the result that the ink and the printability improving liquid do not mix with each other upon the wiping, thus preventing the occurrence of inconveniences due to such a mixing, such as an ejection failure, a contamination of the printing apparatus in the inside thereof. More particularly, according to the above-described arrangements, directions in which a wiping is performed by the first and second ejectors are made different between the two ejectors, amounts of invasion by the first and second ejectors are made different from each other, wiping members for wiping the first and second ejectors are not arranged adjacent each other, one wiping member wipes the first and second ejectors in its different contact surfaces, respectively, one wiping member is used for wiping such that it does not contact the second ejector ejecting the printability improving liquid, one wiping member is used for wiping such that it contacts the first and second ejectors at different regions in its contact surface, the direction of wiping by a wiping member is made different, or the like, with the result that the ink and the printability improving liquid do not mix with each other upon the wiping, thus preventing the occurrence of inconveniences due to such a mixing, such as an ejection failure, a contamination of the printing apparatus in the inside thereof.

According to the above-described arrangements, provision of a first capping means for capping a first ejector for ejecting ink and a second capping means for capping a second ejector for ejecting a printability improving liquid prevents mixing of the ink and the printability improving liquid with each other upon capping, or in a stage of a non-printing or a waiting, thus preventing the occurrence of inconveniences due to such a mixing, such as an ejection failure, a contamination of the printing apparatus in the inside thereof.

According to the above-described arrangements, preliminary ejection of an ink jet ejector which ejects an ink and an ink jet ejector which ejects a printability improving liquid for improving the printability of the ink can be performed at separate positions. As a result, there occurs no mixing of the ink with the printability improving liquid on portions which receive the ink and the liquid ejected by the preliminary ejections so that deposition of the insoluble matter on liquid discharge passage for discharging waste ink or the like to clog the passage can be prevented.

A preliminary ejection of the printability improving liquid can be performed toward a printing material so that the amount of a waste liquid to be discharged in the printing apparatus can be decreased to some extent.

A preliminary ejection of the printability improving liquid can be performed toward a printing material so that the amount of a waste liquid to be discharged in the printing apparatus can be decreased to some extent.

Further, according to the present invention, the distance between a liquid ejector which ejects a printability improving liquid for improving the printability of an ink and an adjacent ejector which ejects an ink is made larger than the distance between any adjacent two ejectors which eject inks containing different coloring materials, respectively, or the ejecting port planes provided with ejecting ports for ejecting inks containing different coloring materials are inclined in a direction opposite to the direction in which the surface of the ejecting port planes provided with an ejecting port for ejecting a printability improving liquid for improving the printability of the inks is inclined. By these arrangements, mists generated from the ejectors for ejecting inks containing coloring materials, respectively, and a mist generated from an ejector which ejects a printability improving liquid for improving the printability of the inks do not adhere to any of the other ejectors.

The above and other objects, effects, features and advantages of the present invention will become more apparent from the following description of embodiments thereof taken in conjunction with the accompanying drawings.

BRIEF DESCRIPTION OF THE DRAWINGS

FIGS. 24A to 24F are each a schematic diagram illustrating the wiping action of the ink jet printing apparatus shown in FIG. 23;

DESCRIPTION OF PREFERRED EMBODIMENTS

Hereinafter, the present invention will be described in more detail by examples with reference to the attached drawings.

EXAMPLE 1

Figures 1A, 1B, 1C:
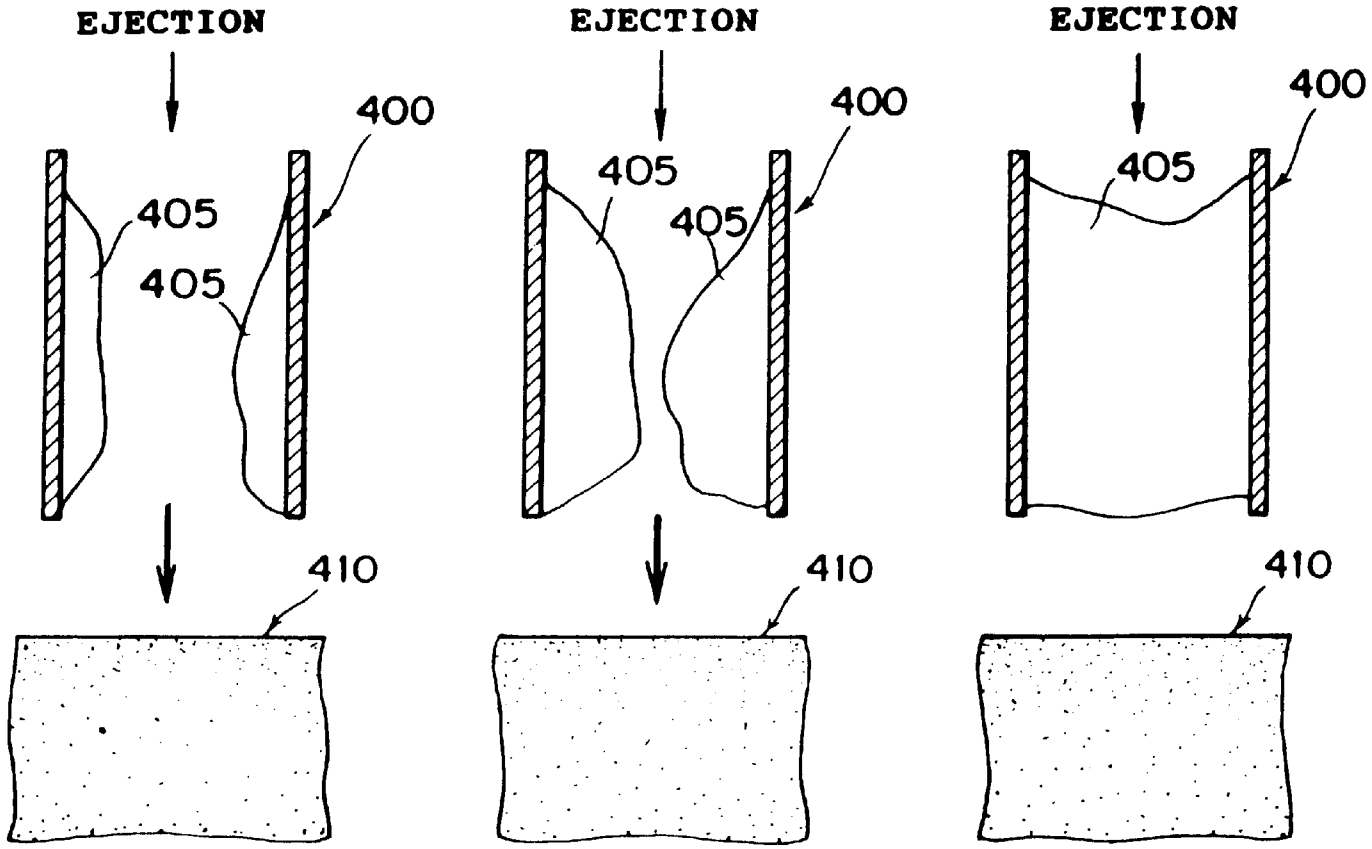
FIG.1A PRIOR ART
FIG.1B PRIOR ART
FIG.1C PRIOR ART
FIGS. 1A to 1C are each a schematic cross-sectional view showing an ink receiver, illustrating a problem of overflowing of an ink therein.
Figure 2:
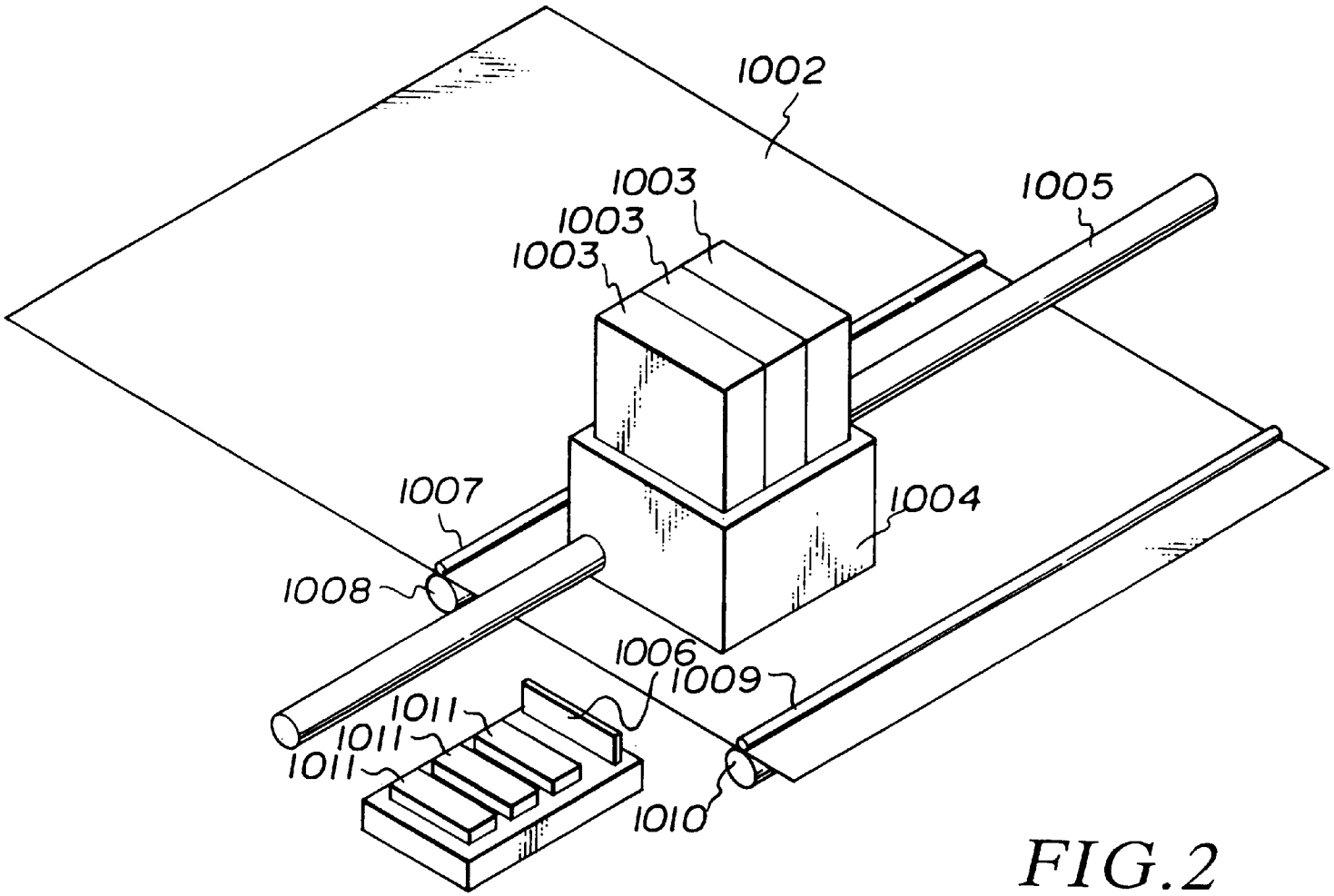
FIG. 2 (PRIOR ART)
FIG. 2 is a schematic perspective view showing a main part of a conventional ink jet printing apparatus.
Figure 3:
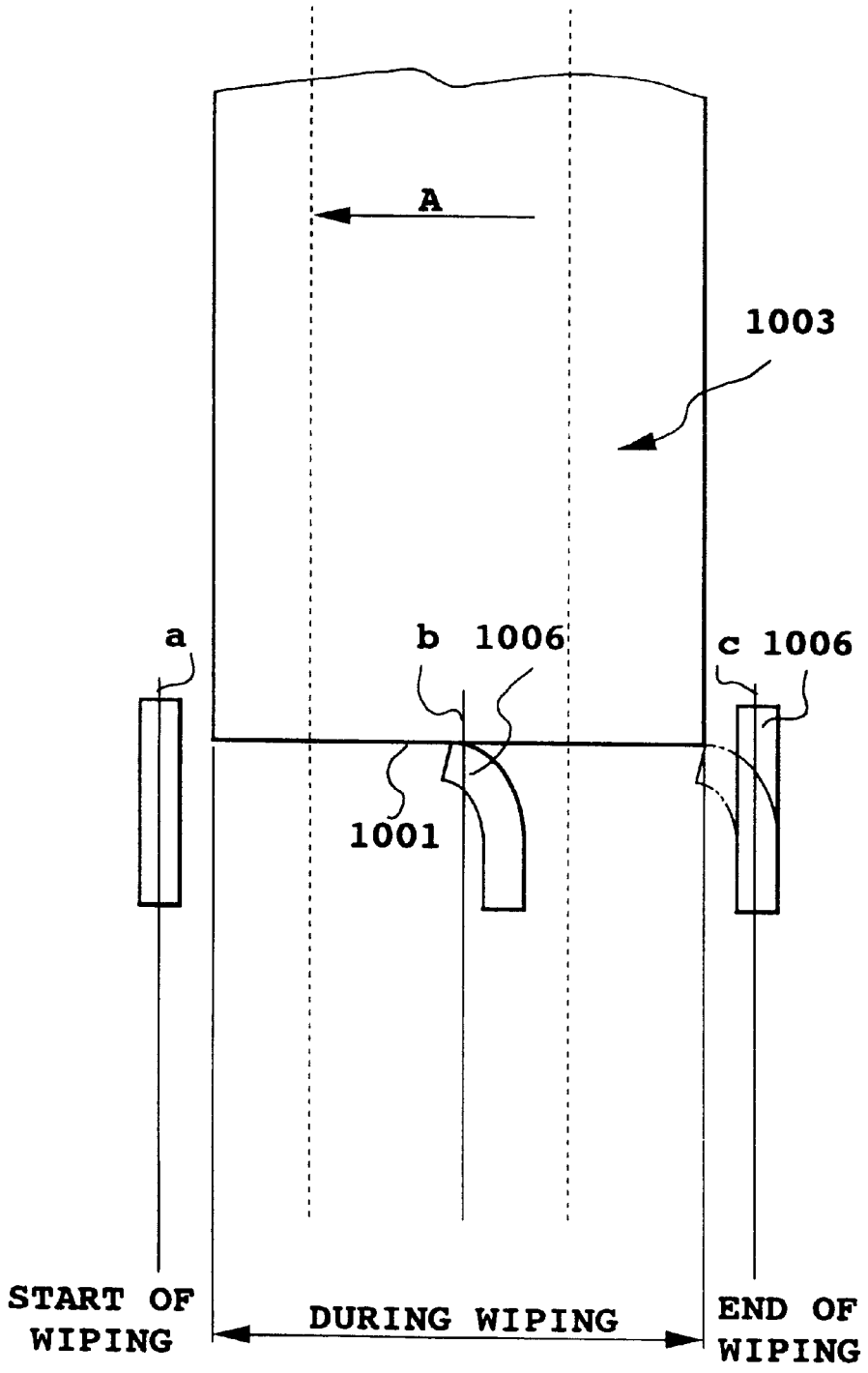
FIG. 3 (PRIOR ART)
FIG. 3 is a schematic side view showing a main part of the conventional ink jet printing apparatus shown in FIG. 1, illustrating the wiping action of the apparatus.
Figure 4:
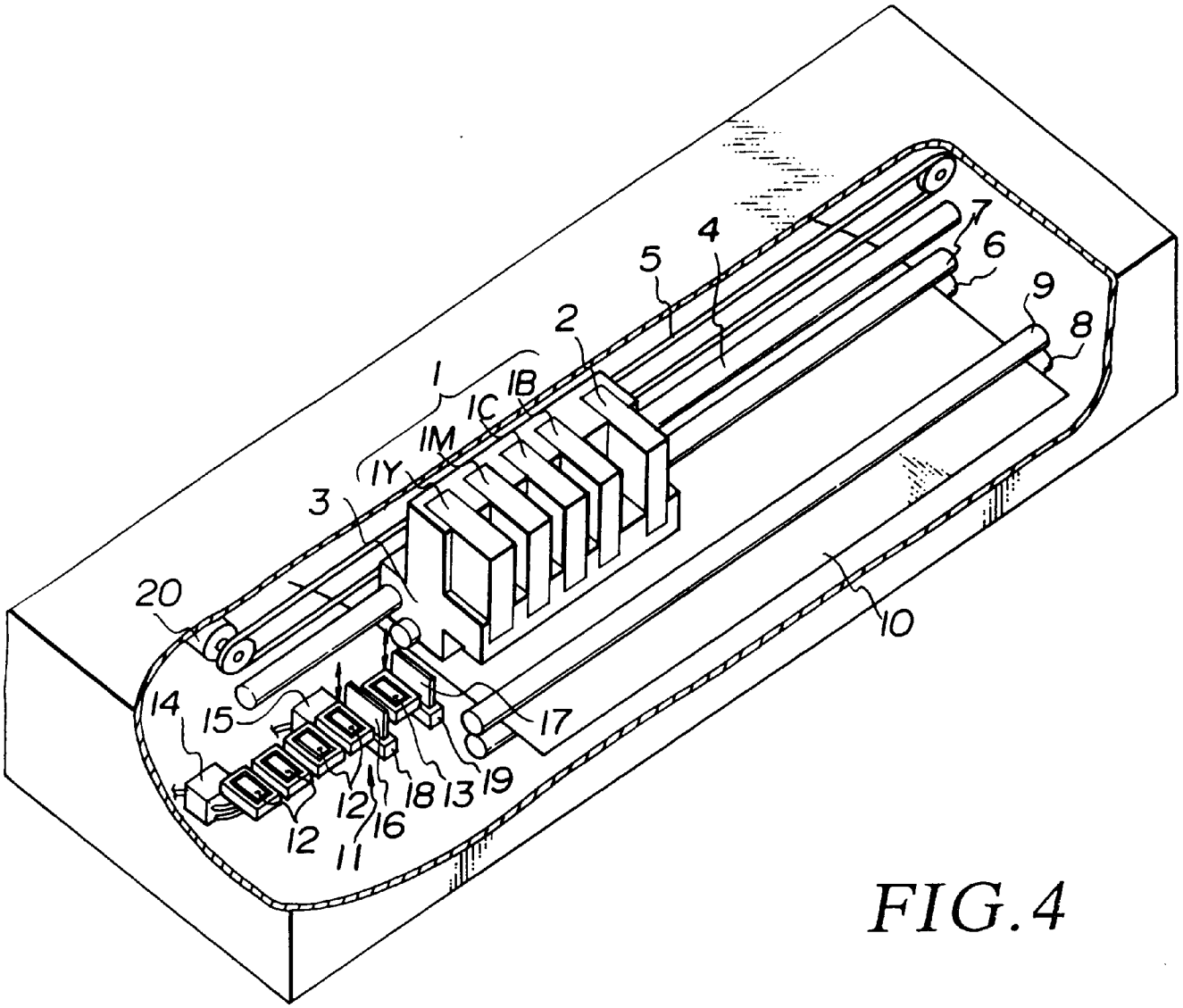
FIG. 4 is a partially broken perspective view showing an ink jet printing apparatus according to a first example of the present invention.

FIG. 4 is a partially broken perspective view showing an ink jet printing apparatus according to a first example of the present invention. In FIG. 1, reference numeral 1 designates a cartridge constructing a printing head which ejects ink for printing. A cartridge 2 constructing a head ejects a printability improving liquid for improving the printability of the ink. The "printability improving liquid" is sometimes referred to also as a "treating liquid". In the example shown in FIG. 4, four cartridges 1 (1Y, 1M, 1C, and 1B) for printing using different color inks (yellow, magenta, cyan, and black), respectively, and one cartridge 2 for ejecting the printability improving liquid. Here, the printability improving liquid is a liquid which contains a substance or compound having a function of insolubilizing and/or agglomerating the coloring materials such as dyes and pigments in the inks. The improvement in printability referred to here includes an improvement in at least one property selected from density, color saturation, sharpness of an edge portion, dot shape, image stability such as fixability, water resistance, light resistance, etc. of ink, and so on.

Each cartridge 1 for printing has an ink tank portion in its upper part and an ejector for ejecting ink in its lower part. On the other hand, the cartridge 2 has a printability improving liquid tank portion (or sometimes referred to "treating liquid tank") in its upper part and an ejector for ejecting a printability improving liquid (or sometimes referred to also as "treating liquid ejector") in its lower part. The cartridges 1 and 2 are each connected with a connector (not shown) which receives a signal for driving the ejector therein. 3 is a carriage.

The carriage 3 carries four printing head cartridges (printing heads) 1 for printing with different color inks, respectively, and one head cartridge (printability improving liquid ejecting head) 2 for ejecting a printability improving liquid in their positions with alignment. The carriage 3 includes a connector holder (not shown) for transmitting signals for driving the printing heads 1 and the printability improving liquid ejecting head 2 and is electrically connected to each of the cartridges 1 and 2 through the connector holder.

The printing heads 1 contain different color inks, e.g., yellow (Y), magenta (M), cyan (C), and black (B), respectively. The printability improving liquid ejecting head 2 contains a printability improving liquid, or treating liquid (S), which contains a substance or compound having a function of insolubilizing and/or agglomerating (insolubilizing, agglomerating, or insolubilizing and agglomerating) coloring materials such as dyes or pigments in the inks. In this embodiment, there are mounted on the carriage 3 from the right in FIG. 4 a plurality of cartridges (printing heads) 1Y, 1M, 1C, and 1B for printing with yellow, magenta, cyan, and black inks, respectively, and the cartridge (sometimes referred to as "treating head") 2 for ejecting the above-described printability improving liquid at the rightmost end.

In FIG. 4, the carriage 3 is slidably supported on a guide rail or shaft 4 extending in a main scanning direction of the carriage 3. A driving belt 5 transmits a driving force to the carriage 3 from a driving motor 20. Two pairs of conveying rolls for conveying a printing medium or material 10 while it is being clamped thereby, i.e., a pair of rolls 6 and 7 and a pair of rolls 8 and 9, are arranged before and behind a printing position of the printing heads. The printing material 10 such as paper is guided and supported in a press contact state by a platen (not shown) for restricting the printing surface of the printing material 10 to be in a flattened state in a printing position. In this state, the ejecting port planes of the cartridges (heads) 1 and 2 mounted on the carriage 3 project downward of the carriage 3 and are located between the conveying rolls 7 and 9 for conveying the printing material 10 so that the ejecting port planes are parallel to the printing material 10 pressed against a guiding surface of the platen (not shown).

In the vicinity of a home position arranged on the left, i.e., outside the printing region of the ink jet printing apparatus according to the present example, there is arranged a recovering unit 11. The recovering unit 11 includes four caps 12 corresponding to four printing heads (cartridges) 1Y, 1M, 1C, and 1B, respectively, and one cap 13 corresponding to the printability improving liquid ejecting head (cartridge) 2, the caps 12 and 13 being movable up and down vertically. When the carriage 3 is located at the home position, the caps 12 and 13 are pressed against and connected to the ejecting port planes of the corresponding heads 1 and 2, respectively to cap the ejecting ports. The capping prevents an increase in viscosity and setting of the ink or printability improving liquid in each ejecting port due to evaporation of a solvent or solvents in the ink or printability improving liquid so that occurrence of an ejection failure can be prevented.

The recovering unit 11 includes an suction pump 14 connected to each of the caps 12 and an suction pump 15 connected to the cap 13. The suction pumps 14 and 15 are used in order to perform an absorbing and recovering process when an ejection failure occurs in any one of the printing heads 1 and the printability improving liquid ejecting head 2 so that the ejecting port planes are capped with the caps 12 and 13, respectively. Further, the recovering unit 11 includes two wiping members or blades 16 and 17 made of an elastic material such as rubber. The blades 16 and 17 are supported by blade holders 18 and 19, respectively.

In this example, a blade moving mechanism (not shown), which is driven by the movement of the carriage 3, moves the blade holders 18 and 19 up and along with this movement, the blades 16 and 17 moves up and down between a wiping position, i.e., an elevated position, where the blades project in order to wipe off an ink or foreign matter adhering to the ejecting port planes of the heads (cartridges) 1 and 2 and a waiting position, i.e., a lowered position, where the blades 16 and 17 are retracted and not contacting the ejecting port planes. The blades 16 for wiping the printing heads 1, respectively, and the blade 17 for wiping the printability improving liquid ejecting head 2 are constructed so that they can be moved up and down independently of each other.

In this example, when the carriage 3 moves from the right hand side in FIG. 4 (printing region (PR) side) to the home position (H) side, or from the home position (H) side to the printing region (PR) side, the blades 16 contact the ejecting port planes of the printing heads 1, respectively, and the blade 17 contacts the ejecting port plane of the printability improving liquid ejecting head 2, to effect the wiping action for wiping the ejecting port planes by a relative movement thereof.

In the ink jet printing apparatus according to this example, the printability improving liquid ejecting head 2 ejects on the printing material 10 a printability improving liquid for insolubilizing and/or agglomerating the coloring material such as dye or pigment in an ink and causes the printability improving liquid to contact with the inks ejected from the printing heads 1 to give the dye or pigment in the inks with water resistance. Since the dyes or pigments in the inks react with the printability improving liquid to immediately insolubilize and/or agglomerate them, not only the water resistance of the inks increases but also undesired bleeding between the different color inks can be prevented. In this example, there are used an aqueous solution of a cationic polymer as the printability improving liquid and inks containing an acidic dye usually used as the printing inks.

Figure 5:
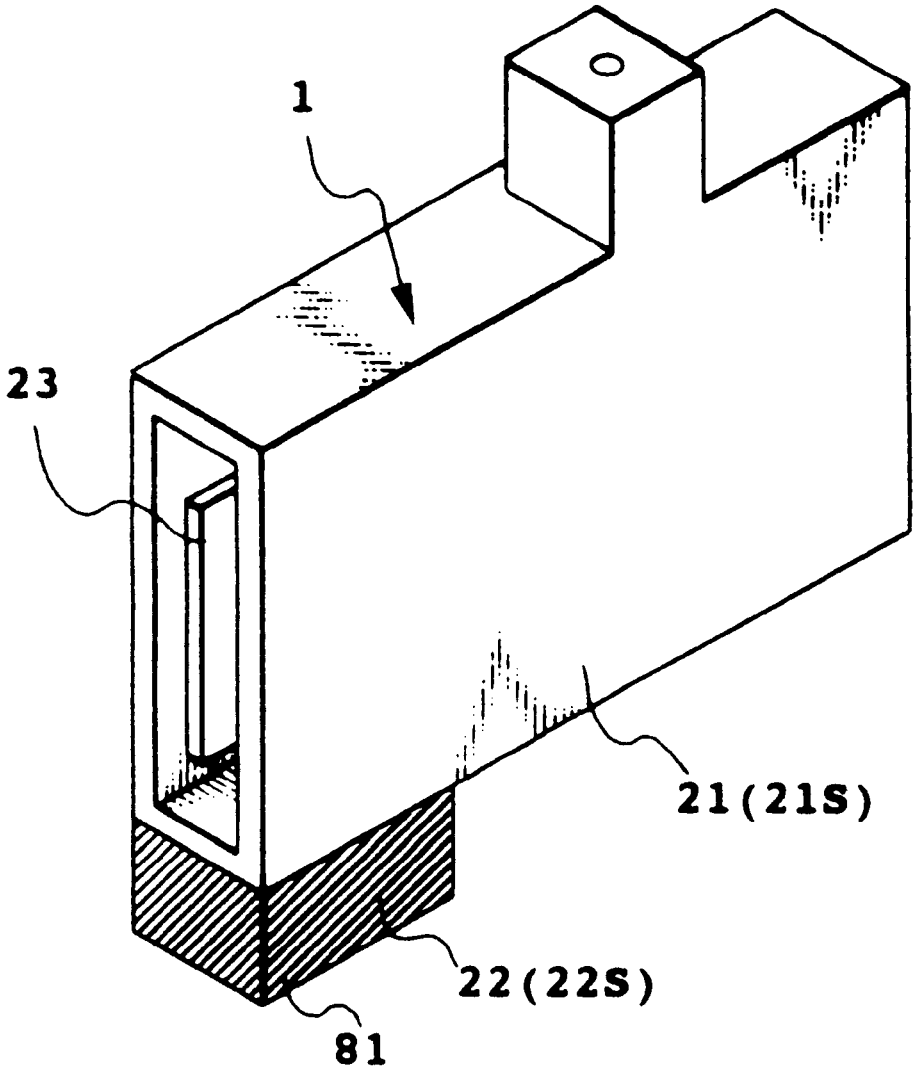
FIG. 5 is a schematic perspective view showing an ink jet cartridge in the ink jet printing apparatus shown in FIG. 4.

FIG. 5 is a schematic perspective view showing an ink jet cartridge in the ink jet printing apparatus shown in FIG. 4, the cartridge including an ejector and an ink tank portion integrally assembled. The printability improving liquid ejecting head 2 is of the same construction as the printing heads 1 except that the liquid stored and used is the printability improving liquid. In FIG. 5, the printing head 1 has an ink tank portion 21 in the upper part thereof, an ink ejector (printing head portion) 22 in the lower part thereof, and a connector 23 for receiving signals for driving the ejector 22 and outputting ink residual amount detecting signals for determining and giving an information on a residual amount of the ink in the ink tank portion. The connector 23 is arranged at a position abreast of the ink tank 21.

The printing head 1 has an ejecting port plane 81 on a bottom side in FIG. 5 (on the side of a printing material 10). The ejecting port plane is provided with a plurality of ejecting ports. The printing head has a liquid passage communicating to the respective ejecting ports. In the liquid passage is arranged an energy generating element which generates energy required for ejecting ink.

The printing head (cartridge) 1 is an ink jet printing means for ejecting ink and effecting printing and is constructed by an exchangeable ink jet cartridge including the ink ejector 22 and the ink tank portion 21 integrally arranged. The printing head 1 is a ink jet printing means which includes an electro-thermal transducer for generating thermal energy. The printing head 1 ejects ink from ejecting ports and performs printing utilizing changes in pressure due to growth and contraction of bubbles formed by film boiling caused by thermal energy applied to by the electro-thermal transducer.

Figure 6:
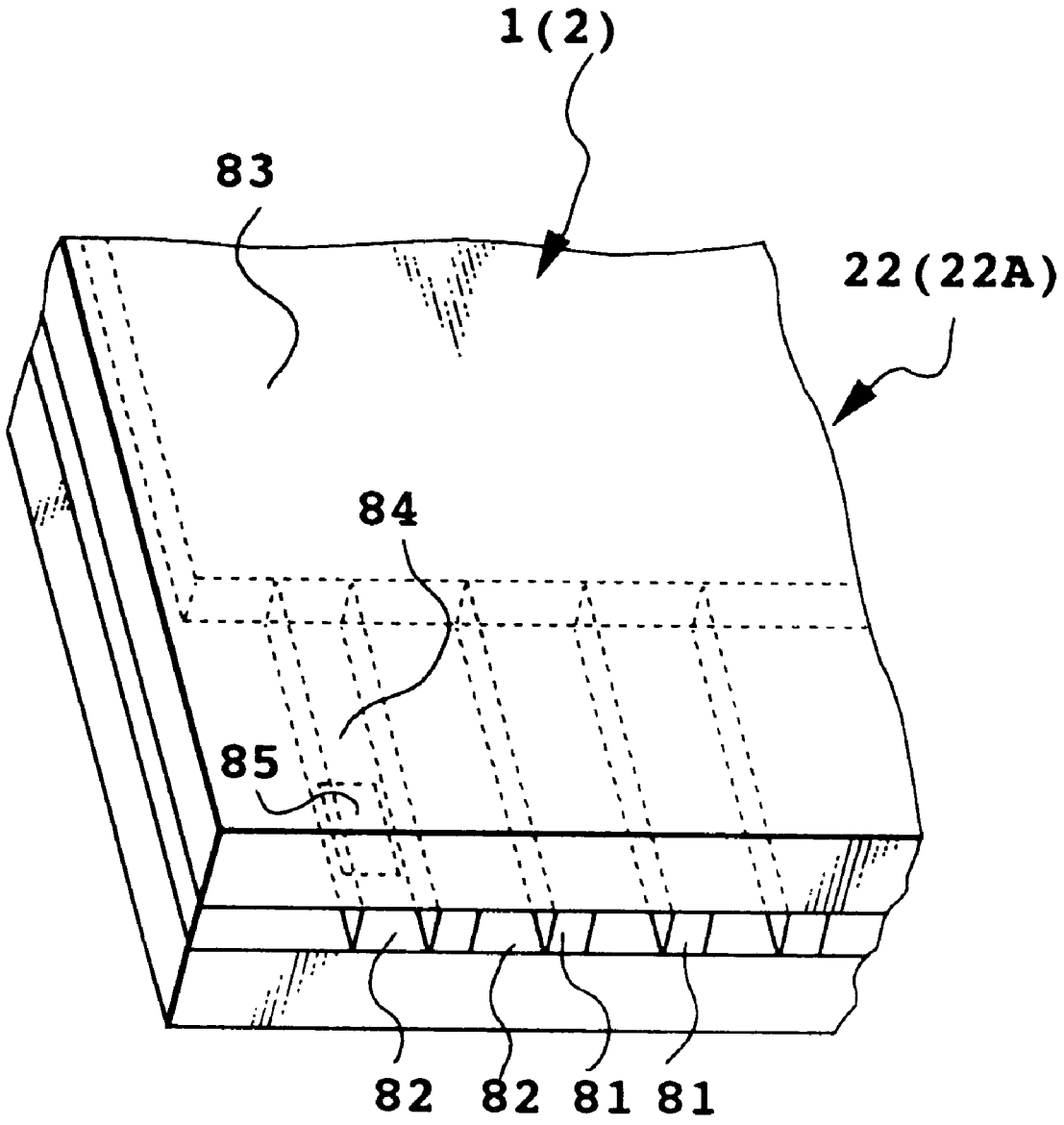
FIG. 6 is a partial perspective view showing schematically the structure of an ink ejector in the cartridge in the ink jet printing apparatus shown in FIG. 4.

FIG. 6 is a partial perspective view showing schematically the structure of an ink ejector 22 (printability improving liquid ejector 22A) in the printing head 1 (printability improving liquid ejecting head 2) in the ink jet printing apparatus shown in FIG. 4. In FIG. 6, in the ejecting port plane 81 facing a printing material 10 (FIG. 4) at a predetermined distance or gap (e.g., on the order of about 0.5 mm to 2.0 mm), there are provided with a plurality of ejecting ports 82 at a predetermined pitch and an electro-thermal transducer 85, such as a heating resistor, for generating energy for ejecting an ink or printability improving liquid is arranged on a wall of each liquid passage 84 communicating a common liquid chamber 84 with the respective ejecting ports 82. The plurality of ejecting ports 82 are arrayed in a direction crossing the direction of movement (i.e., the main scanning direction) of the printing head 1. When the corresponding electro-thermal transducers 85 are driven (energized by application of current) in accordance with image signals or ejection signals, the ink in each liquid passage 84 is subjected to film boiling so that the ink is ejected from the printing head through the ejecting ports 82 by virtue of the pressure generated thereby.

Figure 7A:
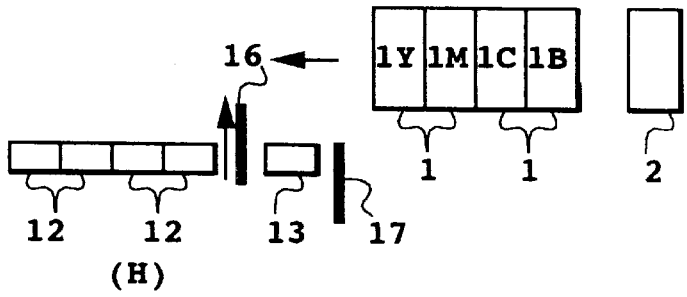
FIGS. 7A to 7D are each a schematic diagram illustrating the wiping action of a wiper in the ink jet printing apparatus shown in FIG. 4.
Figure 7B:
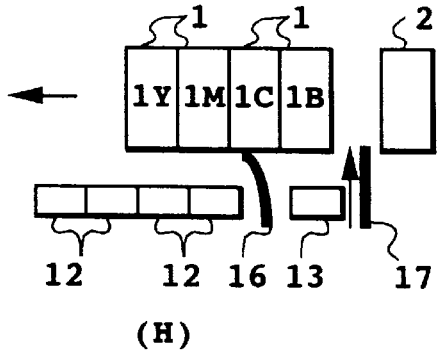

FIGS. 7A to 7D, 8A to 8D, and 9A to 9D are each a schematic diagram illustrating the wiping action of a wiper in the ink jet printing apparatus shown in FIG. 4. FIGS. 7A to 7D illustrate the wiping action of the wiper when the carriage 3 moves from the printing region side to the home position side. As shown in FIG. 7A, the printing heads 1 and the printability improving liquid ejecting head 2 on the carriage 3 move toward the home position from the right (printing region (PR)). Then, as shown in FIG. 7B, first the blade 16 for ink present between the caps 12 for the inks and the cap for the printability improving liquid elevates and wipes the printing heads 1Y, 1M, 1C and 1B sequentially according as the carriage 3 moves.

Figure 7C:
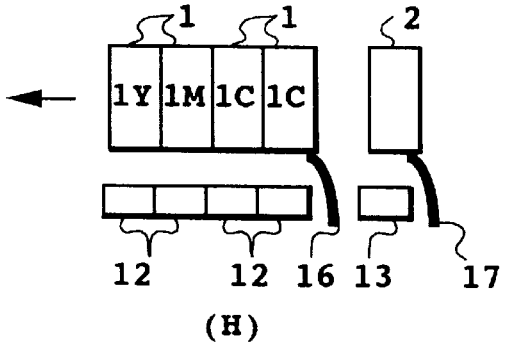
Figure 7D:
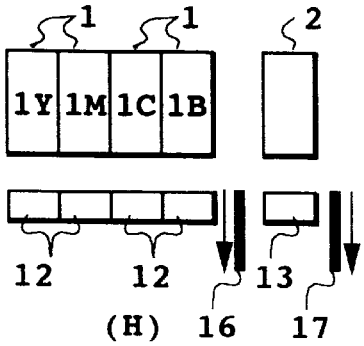

Further, as shown in FIG. 7C, after the printing heads 1 have passed above the blade 17 for the printability improving liquid, the blade 17 for the printability improving liquid elevates to wipe the ejecting port plane of the printability improving liquid ejecting head 2 simultaneously with the wiping by the blade 16 on the ejecting port planes of the printing heads 1. After completion of the wiping of the fourth printing head 1 by the blade 16 for ink and of the wiping of the printability improving liquid ejecting head by the blade 17 for the printability improving liquid, the blades 16 and 17 come down and wait in a waiting position as shown in FIG. 7D. In the arrangement shown in FIGS. 7A to 7D, a wiping is effected by the blades 16 and 17 when the carriage 3 moves from the right (printing region(PR)) toward the home position (H) side where the recovering unit 11 is present. However, the direction of wiping is not limited thereto. For example, the apparatus may be constructed so that wiping can be effected when the carriage 3 moves from the home position (H) side to the right (printing region (PR)) as shown in FIGS. 8A to 8D.

Figure 8A:
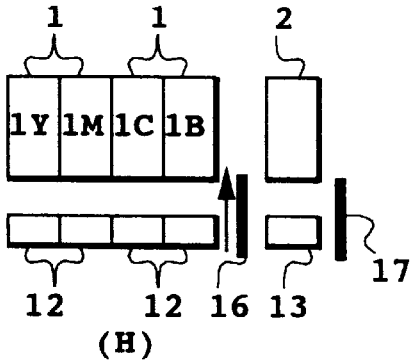
FIGS. 8A to 8D are each a schematic diagram illustrating the wiping action of a wiper in the ink jet printing apparatus shown in FIG. 4.
Figure 8B:
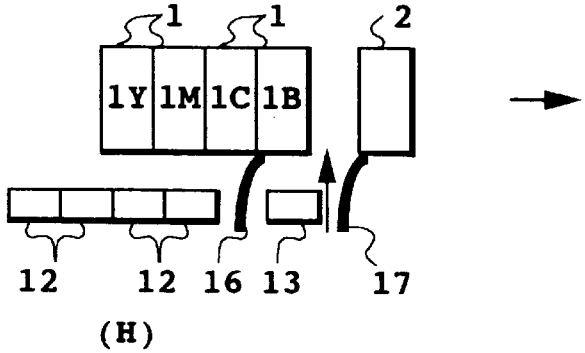
Figure 8C:
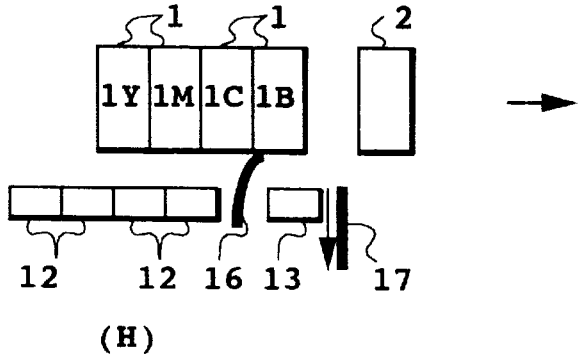
Figure 8D:
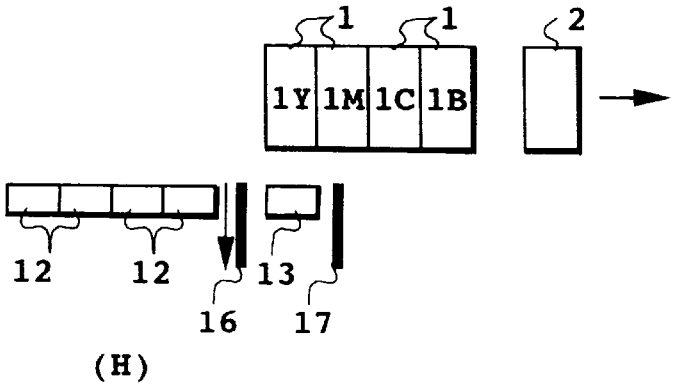

In the arrangement as shown in FIGS. 8A to 8D, as shown in FIG. 8A, first both the blades 16 and 17 for the ink and printability improving liquid, respectively, are elevated simultaneously and then the carriage 3 moves from the left (home position (H)) toward the right (printing region (PR)). As a result, the blades 16 and 17 come into contact with the first or rightmost printing head 1 and the printability improving liquid ejecting head 2, respectively, to wipe them simultaneously as shown in FIG. 8B. After the wiping of the printability improving liquid ejecting head 2 was completed, the blade 17 for the printability improving liquid is lowered to a waiting position and the blade 16 for ink continues the wiping action to wipe the remaining printing heads 1, as shown in FIG. 8C. Finally, as shown in FIG. 8D, the blade 16 for ink is lowered it has wiped all the printing heads to cease a series of wiping action.

By adopting the wiping direction as illustrated in FIGS. 8A to 8D, the disadvantage can be prevented that the ink and liquid droplets wiped off from the heads and adhering to the blades 16 and 17, respectively, scatter to a conveying portion for conveying the printing material 10 due to the elasticity of the blade to unexpectedly contaminate the printing material 10.

Figure 9A:
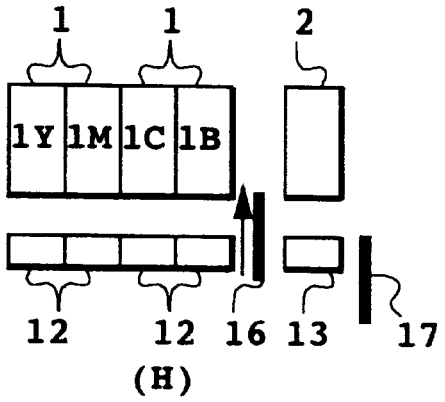
FIGS. 9A to 9D are each a schematic diagram illustrating the wiping action of a wiper in the ink jet printing apparatus shown in FIG. 4.
Figure 9B:
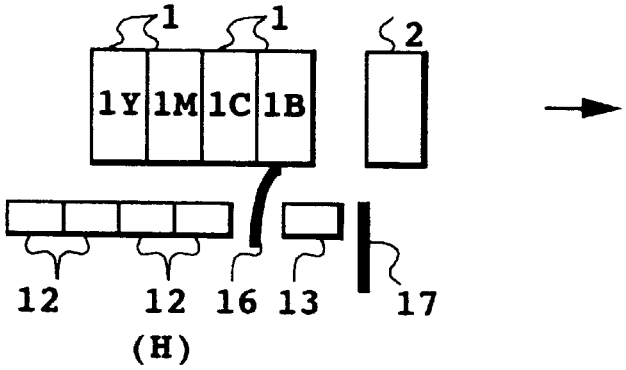
Figure 9C:
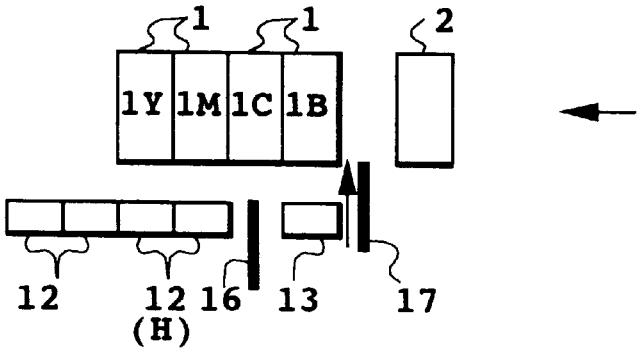
Figure 9D:
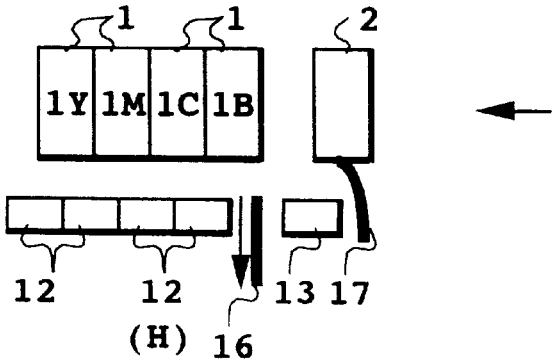

Further, as shown in FIGS. 9A to 9D, the wiping direction of the printing heads 1 may differ from the wiping direction of the printability improving liquid ejecting head 2. It may be arranged as shown in FIGS. 9A to 9D that the blade 16 can wipe the printing heads 1 when the carriage 3 moves from the right (printing region side) to the home position (H) as shown in FIGS. 9A and 9B while the blade 17 for the printability improving liquid can wipe the printability improving liquid ejecting head 2 only when the carriage 3 move from the printing region side toward the home position (H) as shown in FIGS. 9C and 9D. By adopting this wiping direction, the disadvantage or fear can be avoided or minimized that the ink droplets which scatter due to the elasticity of the blade 16 could adhere to the printability improving liquid ejecting head 2, or conversely, the printability improving liquid droplets which scatter due to the elasticity of the blade 17 could adhere to the printing heads 1.

In the arrangement shown in FIG. 4, the caps 12 for the printing heads 1 and the cap 13 for the printability improving liquid ejecting head 2 are provided separately and used independently of each other, in other words, for exclusive use. In addition, the suction pumps 14 and 15 connected to the caps 12 and 13, respectively, are also independent from each other and adapted for exclusive use. By this arrangement, the inks and the printability improving liquid which insolubilize and/or agglomerate the coloring materials in the inks do not contact each other in the caps 12 and 13 and also in the pumps 14 and 15 when waste inks and waste printability improving liquid are disposed of, so that high reliability of the apparatus of the present invention can be maintained.

Figure 10:
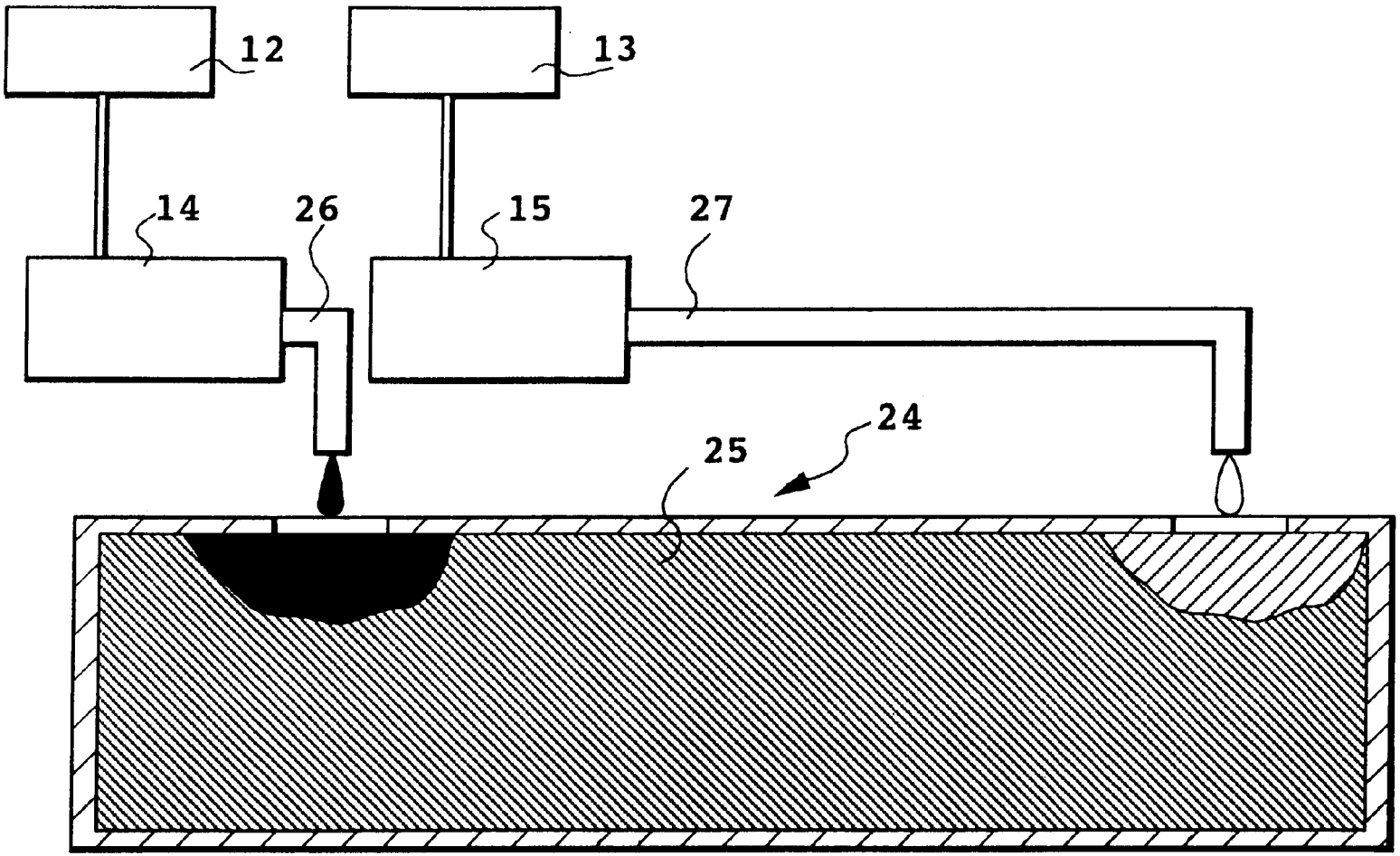
FIG. 10 is a schematic view showing a waste liquid recovering system for recovering a waste liquid from the ink jet printing apparatus shown in FIG. 4.

FIG. 10 is a schematic view showing a waste liquid recovering system for recovering a waste liquid from the ink jet printing apparatus shown in FIG. 4. More particularly, FIG. 10 shows a recovering system for recovering the ink and printability improving liquid discharged from the pumps 14 and 15, respectively. In FIG. 10, A waste ink sucked from the printing head 1 by the suction pump 14 communicating with the caps 12 and a waste printability improving liquid sucked from the printability improving liquid ejecting head 2 by the suction pump 15 communicating with the cap 13 are recovered through separate passages independent of each other, in order for the waste liquids not to leak out of the printing apparatus, and stored in a waste tank 24.

The waste liquid tank 24 is filled with a porous absorbing substrate 25, which absorbs and retain the waste liquids. The waste liquid tank 24 is arranged in the body of the printing apparatus. In the arrangement shown in FIG. 10, a waste ink conduit 26 which transports a waste ink from the suction pump 14 for the printing head 1 and a waste liquid conduit 27 which transports a waste printability improving liquid from the suction pump 15 for the printability improving liquid ejecting head 2 are connected to the waste liquid tank 24 at opposite ends, i.e., at a sufficient distance from each other. With this arrangement, the printability improving liquid and ink in the waste liquid tank 24 will not contact each other until the absorbing substrate 25 absorbs the liquids sufficiently so that the porous absorbing substrate 25 can absorb and retain a sufficiently large amount of liquids.

Figure 11:
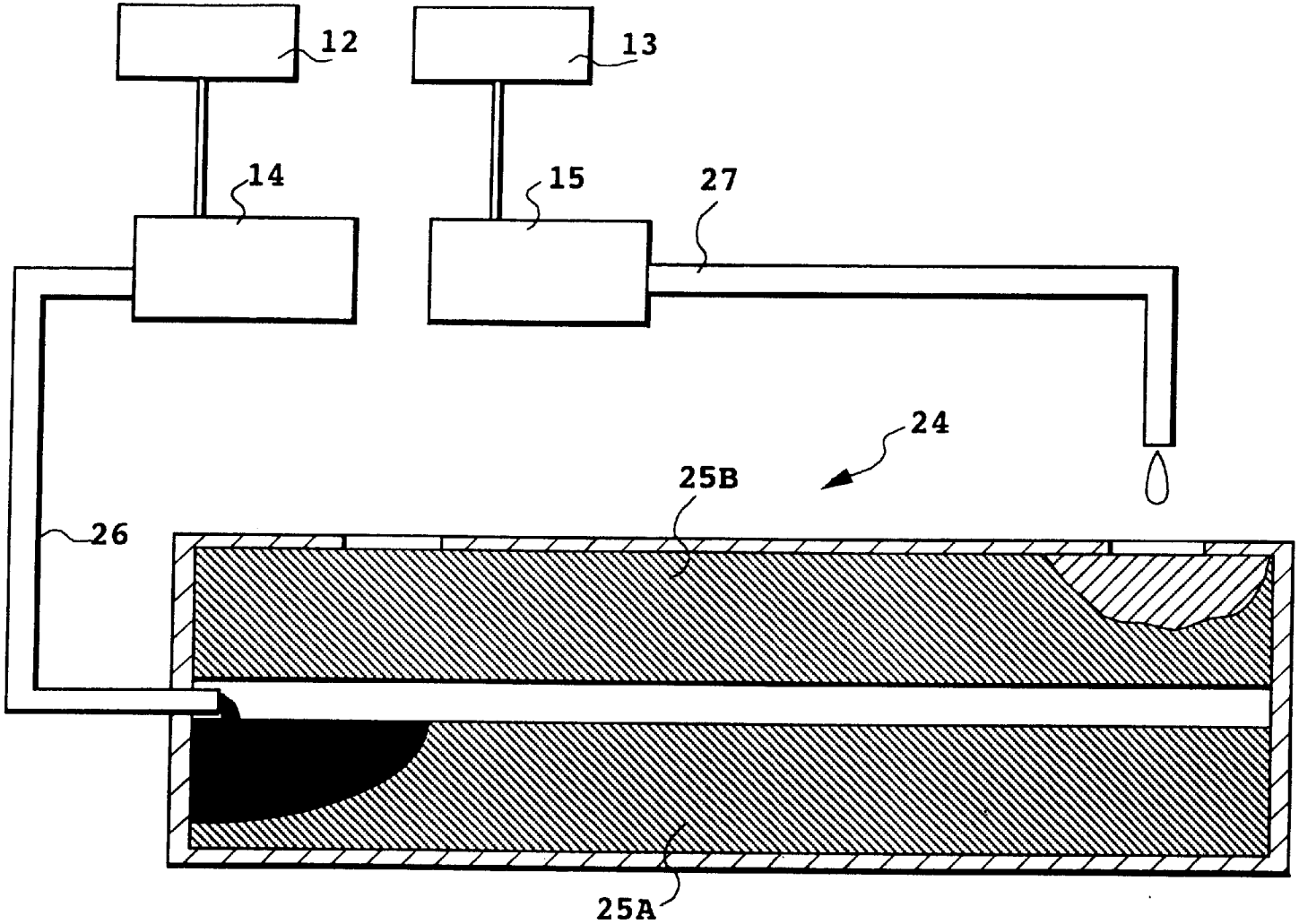
FIG. 11 is a schematic view showing a waste liquid recovering system according to a variation to the waste liquid recovering system shown in FIG. 10.

FIG. 11 is a schematic view showing a waste liquid recovering system according to a variation to the waste liquid recovering system shown in FIG. 10. More particularly, FIG. 11 shows a waste liquid recovering system constructed such that in the waste liquid recovering system shown in FIG. 10, the absorbing substrate 25 in the waste liquid tank 24 is arranged in two layers one above the other, the upper absorbing substrate 25A for absorbing the waste inks and the lower absorbing substrate 25B for absorbing the waste printability improving liquid. With the arrangement shown in FIG. 11, no dye in the inks will leak out of the waste liquid tank 24 to contaminate the inside or outside of the printing apparatus even when the inks overflow over the lower ink absorbing substrate 25A, since the dyes in the inks are trapped by or agglomerate in the upper absorbing substrate 25B and the printability improving liquid absorbed therein.

EXAMPLE 2

Figure 12:
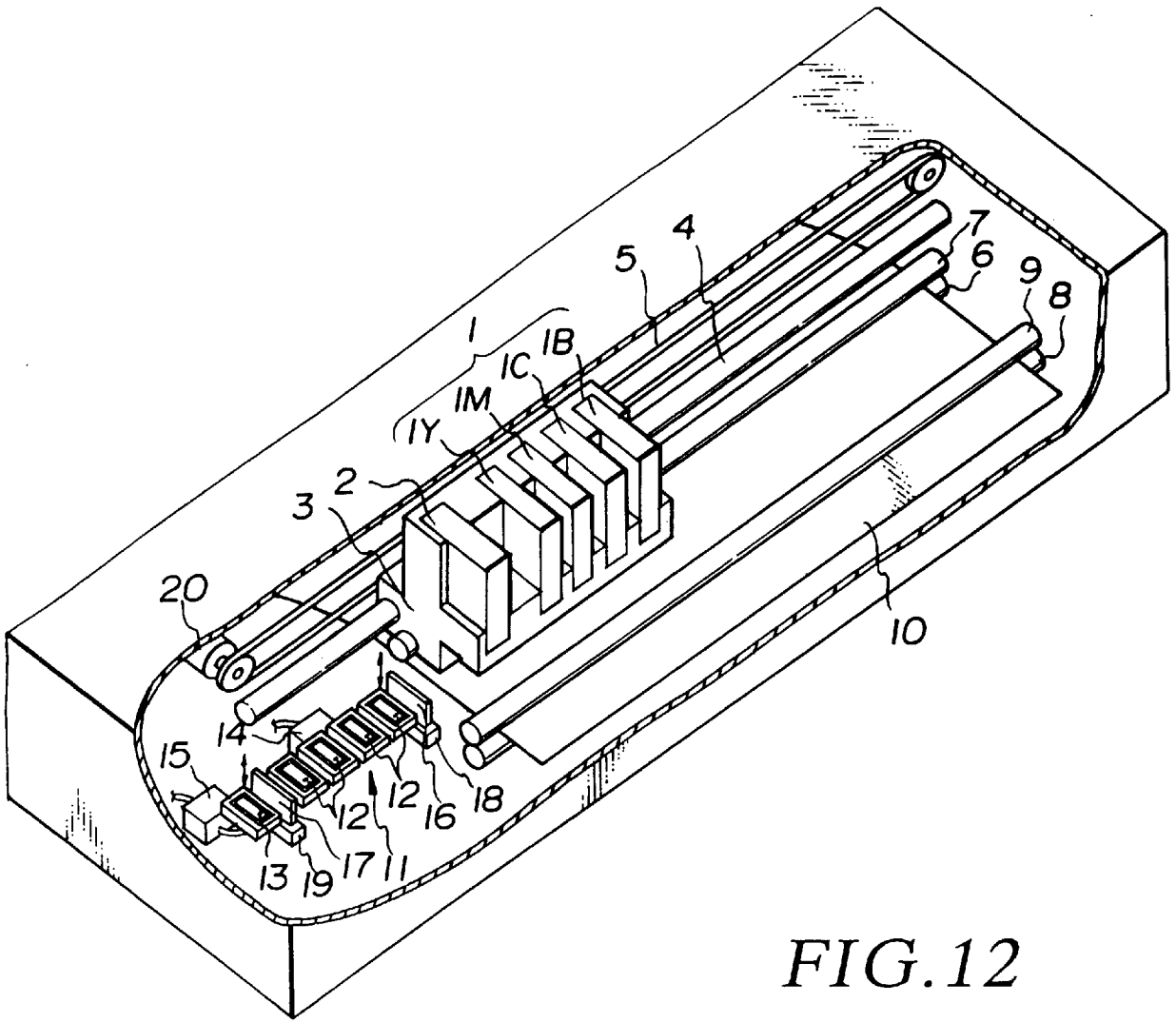
FIG. 12 is a partially broken perspective view showing an ink jet printing apparatus according to a second example of the present invention.

FIG. 12 is a partially broken perspective view showing an ink jet printing apparatus according to a second example of the present invention. Same or like parts as in the first example as shown in FIG. 4 are indicated by same reference numerals and detailed description will be omitted herein. In this example, the carriage 3 carries on the left end a cartridge (printability improving liquid ejecting head) 2 containing a printability improving liquid which insolubilizes and/or agglomerates the coloring material in the ink and then sequentially arranged from the left to the right printing heads 1 for yellow (1Y), magenta (1M), cyan (1C), and black (1B). In accordance with this, the recovering unit 11 includes a cap 13 for printability improving liquid ejecting head 2 and a blade 17 for a printability improving liquid ejecting head 2 arranged on the left end, and caps 12 and a blade 16 for printing heads 1 arranged in the same sequence as the printability improving liquid ejecting heads 1.

Figure 13A:
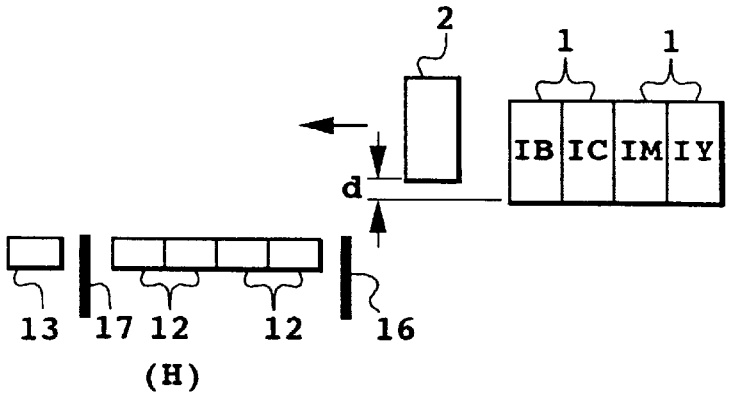
FIGS. 13A to 13D are each a schematic diagram illustrating the wiping action of the ink jet printing apparatus shown in FIG. 12.

FIGS. 13A to 13D are each a schematic diagram illustrating the wiping action of the ink jet printing apparatus shown in FIG. 12. In FIG. 13A, on the cartridge 3, the ejecting port plane of the printability improving liquid ejecting head 2 is arranged at a position by a distance d further from a printing surface of the printing material 10 than the ejecting port planes of the printing heads 1 (in the example shown in FIGS. 13A to 13D, at a position retracted upwards from the printing material). In heads which eject liquid droplets such as ink jet printing heads 1, the larger the distance from the printing material 10, the lower the precision of hit by the liquid droplets decreases. However, since the printability improving liquid is substantially transparent, the change in precision of hit by the printability improving liquid ejecting head 2 gives substantially no influence to picture quality.

Figure 13B:
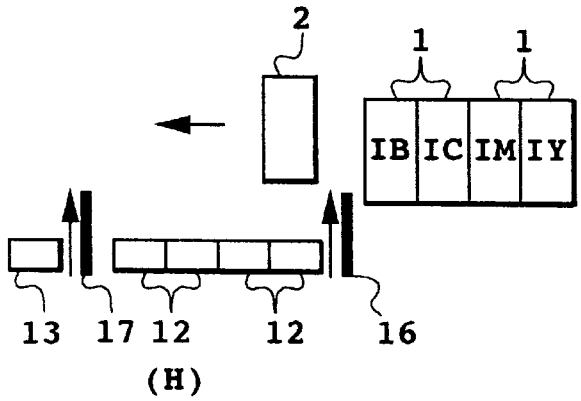

With the arrangement shown in FIGS. 13A to 13D, when the carriage 3 moves from the right (printing region (PR) side) to the left (home position (H) side where the recovering unit 11 is present), first the blade 17 for the printability improving liquid and the blade 16 for the inks are projected upwards (elevated) simultaneously as shown in FIG. 13B. In this occasion, the amount of projection (elevation) of the blade 17 for the printability improving liquid is set up to so that the projected position is optimal taking into consideration the fact that the ejecting port plane of the printability improving liquid ejecting head 2 is retracted by a distance d as compared with the ejecting port planes of the printing heads 1. In other words, the above-described amount of retraction (distance) d is set up to a value larger than the amount of invasion of the blade 16 for the printing heads 1 toward the ejecting port planes of the printing heads 1, so that the printability improving liquid ejecting head when it passes above the blade 16 for the printing heads 1 does not contact the blade 16.

Figure 13C:
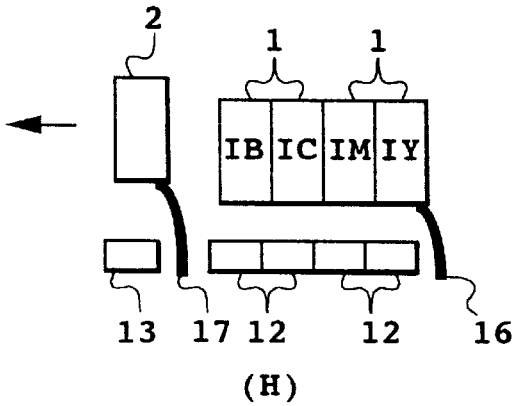
Figure 13D:
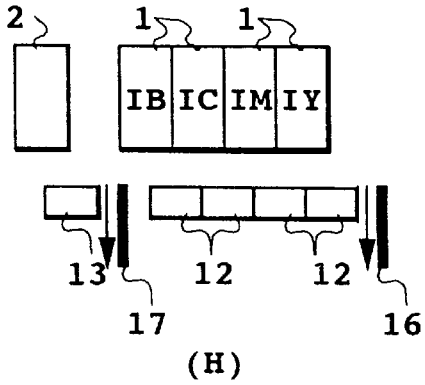

When the carriage 3 further moves toward the left, the blade 17 for the printability improving liquid ejecting head 2 wipes the ejecting port plane of the printability improving liquid ejecting head 2 while the blade 16 for the printing heads 1 wipes the respective ejecting port planes of the printing heads 1 as shown in FIG. 13C. When the wiping of the ejecting port planes of all the heads 1 and 2 is over, the blades 16 and 17 are lowered to a waiting position and thus a series of wiping actions are completed. In this example, too, the wiping direction of the blades 16 and 17 is not limited to what has been described above. In this example, it is possible to use a common elevating mechanism for moving up and down the blades 16 and 17 so that the action of moving up an down upon the wiping action can be simplified.

EXAMPLE 3

Figure 14:
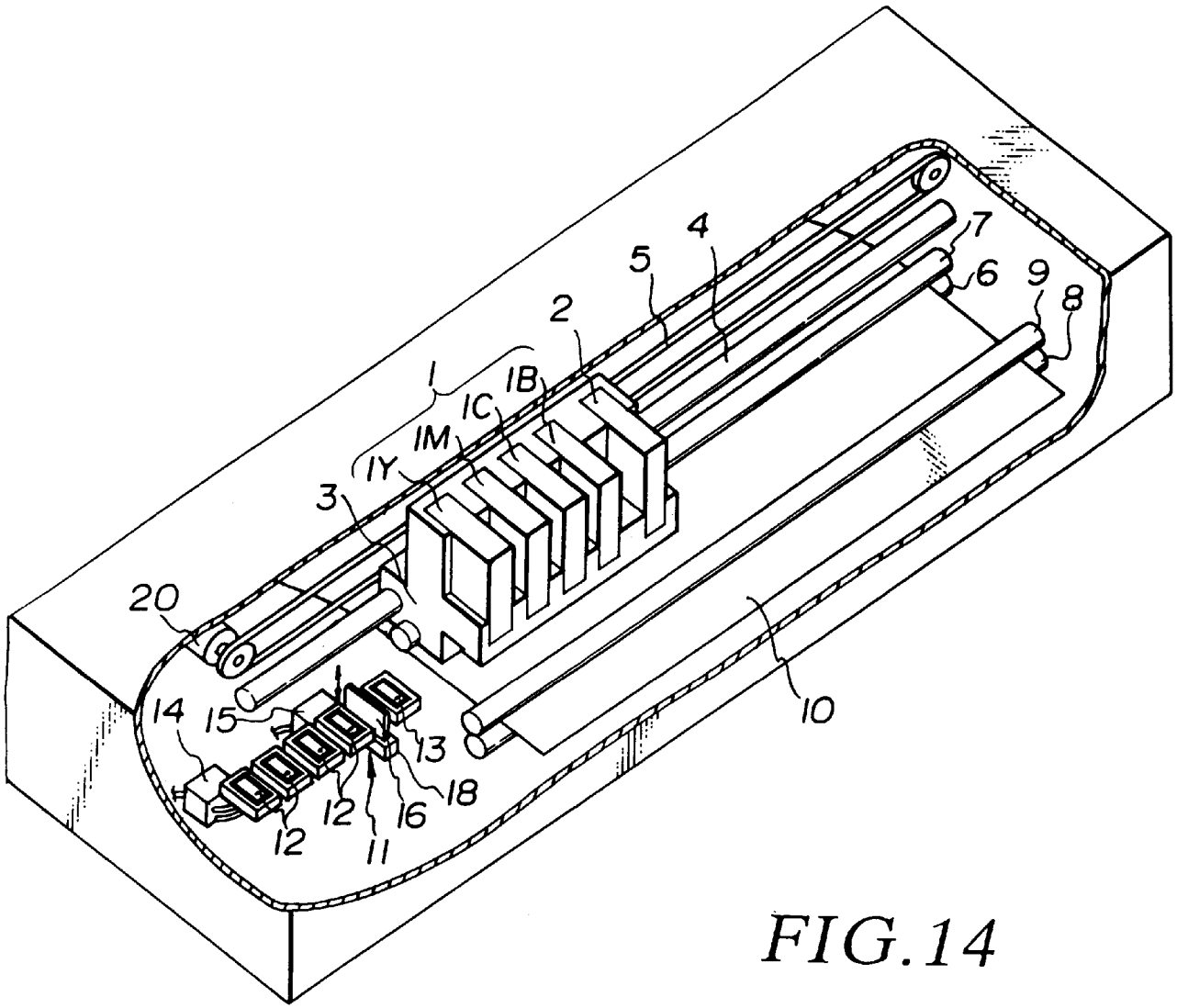
FIG. 14 is a partially broken perspective view showing an ink jet printing apparatus according to a third example of the present invention.

FIG. 14 is a partially broken perspective view showing an ink jet printing apparatus according to a third example of the present invention. Same or like parts as in the first example as shown in FIG. 4 are indicated by same reference numerals and detailed description will be omitted herein. In this example, the printing apparatus is constructed such that one blade 16 performs wiping of both of the printing heads 1 and the printability improving liquid ejecting head 2. In other words, in the printing apparatus of this example, a common blade is used for both the printing heads 1 and the printability improving liquid ejecting head 2.

Figure 15A:
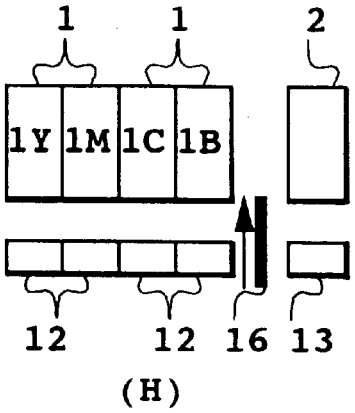
FIGS. 15A to 15C are each a schematic diagram illustrating the wiping action of the ink jet printing apparatus shown in FIG. 14.
Figure 15B:
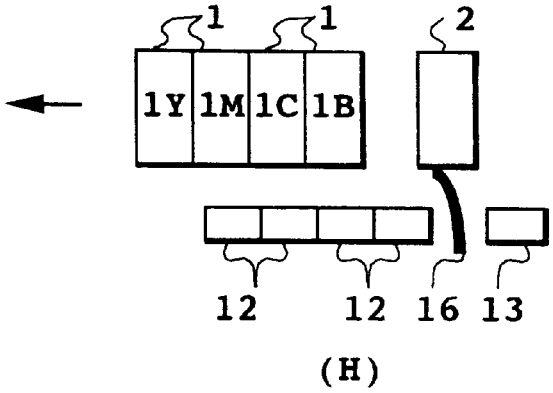
Figure 15C:
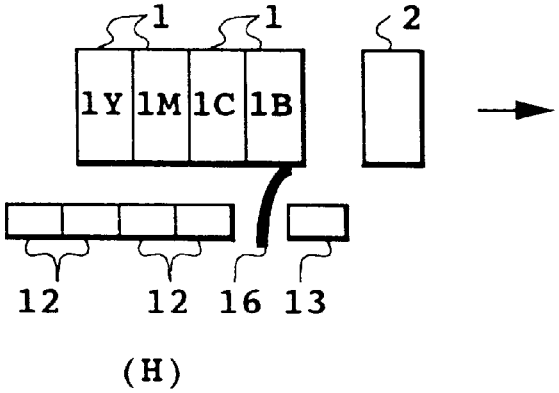

FIGS. 15A to 15C are each a schematic diagram illustrating the wiping action of the ink jet printing apparatus shown in FIG. 14. In FIG. 15, when the carriage 3 is located on the home position (H), the blade 16 is elevated as shown in FIG. 15A. In this state, the carriage 3 moves toward the left end, only the printability improving liquid ejecting head 2 is wiped by the blade 16 as shown in FIG. 15B. Conversely, the movement of the carriage 3 from the state shown in FIG. 15A toward the right end, only the printing heads 1 are wiped as shown in FIG. 15C. In this example, in spite of the fact that only one blade is used, the printability improving liquid does not contact the inks on the blade 16 since the blade 16 contacts the printing heads 1 and the printability improving liquid ejecting head 2 with its different surface portions.

Figure 16A:
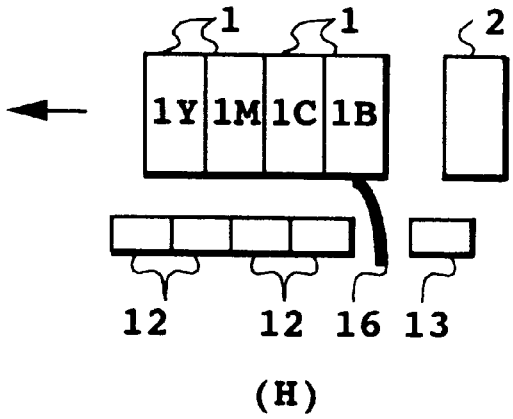
FIGS. 16A and 16B are each a schematic diagram illustrating the wiping action of the ink jet printing apparatus shown in FIG. 14.
Figure 16B:
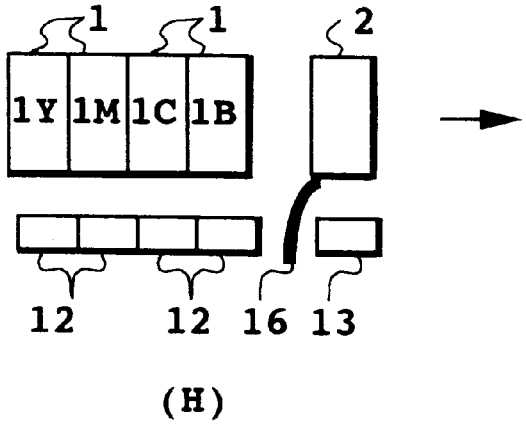
Figure 17:
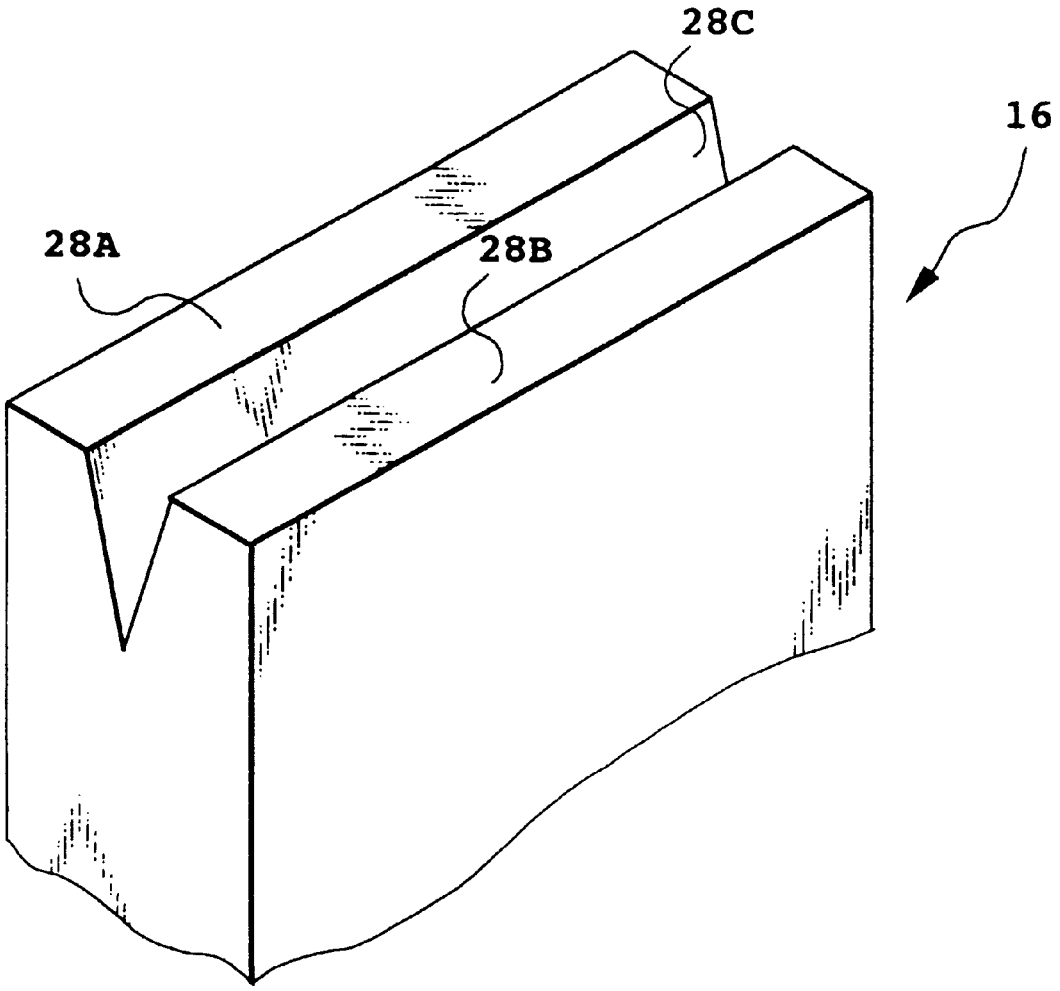
FIG. 17 is a partial perspective view showing schematically an example of a tip configuration of a blade in the ink jet printing apparatus shown in FIG. 14.

FIGS. 16A and 16B are each a schematic diagram illustrating the wiping action of the ink jet printing apparatus shown in FIG. 14. The printing apparatus may be constructed also as follows. That is, as shown in FIG. 16A, only the printing heads 1 are wiped along with leftward movement of the carriage 3, and then, only the printability improving liquid ejecting head 2 is wiped along with rightward movement of the carriage 3. FIG. 17 is a partial perspective view showing schematically an example of a tip configuration of the blade 16 in the ink jet printing apparatus shown in FIGS. 14 to 16A and 16B. That is, it is preferred that the blade 16 be provided with a V-groove 28C on its top surface which splits the tip portion of the blade into two portions 28A and 28B so that it becomes more difficult for the inks and the treating inks wiped by the blade 16 to contact on the blade 16.

In the examples illustrated with reference to FIGS. 4 to 17, the ink jet printing apparatus which ejects inks and a printability improving liquid on a printing material 10 is constructed such that the inks and the printability improving liquid do not contact each other in the recovering unit 11 and, hence, water resistance of the printed image is improved, bleeding at the boundary of different color regions is prevented, and the occurrence in the printing apparatus of insolubilization and/or agglomeration of the dye in the ink is prevented or minimized. As a result, there can be obtained an ink jet printing apparatus having an improved reliability for recovering.

Although the blade 16 for the printing heads 1 and the blade 17 for the printability improving liquid ejecting head 2 are both arranged on the home position (H) side in the preceding examples, the printing apparatus may also be constructed such that only the blade 16 for the printing heads 1 is positioned on the home position (H) side and the blade 17 for the printability improving liquid ejecting head 2 is positioned on the side opposite to the home position via the printing region (PR) so that only the printing heads 1 are wiped on the home position (H) side and on the opposite side only the printability improving liquid ejecting head 2 is wiped.

EXAMPLE 4

Figure 18:
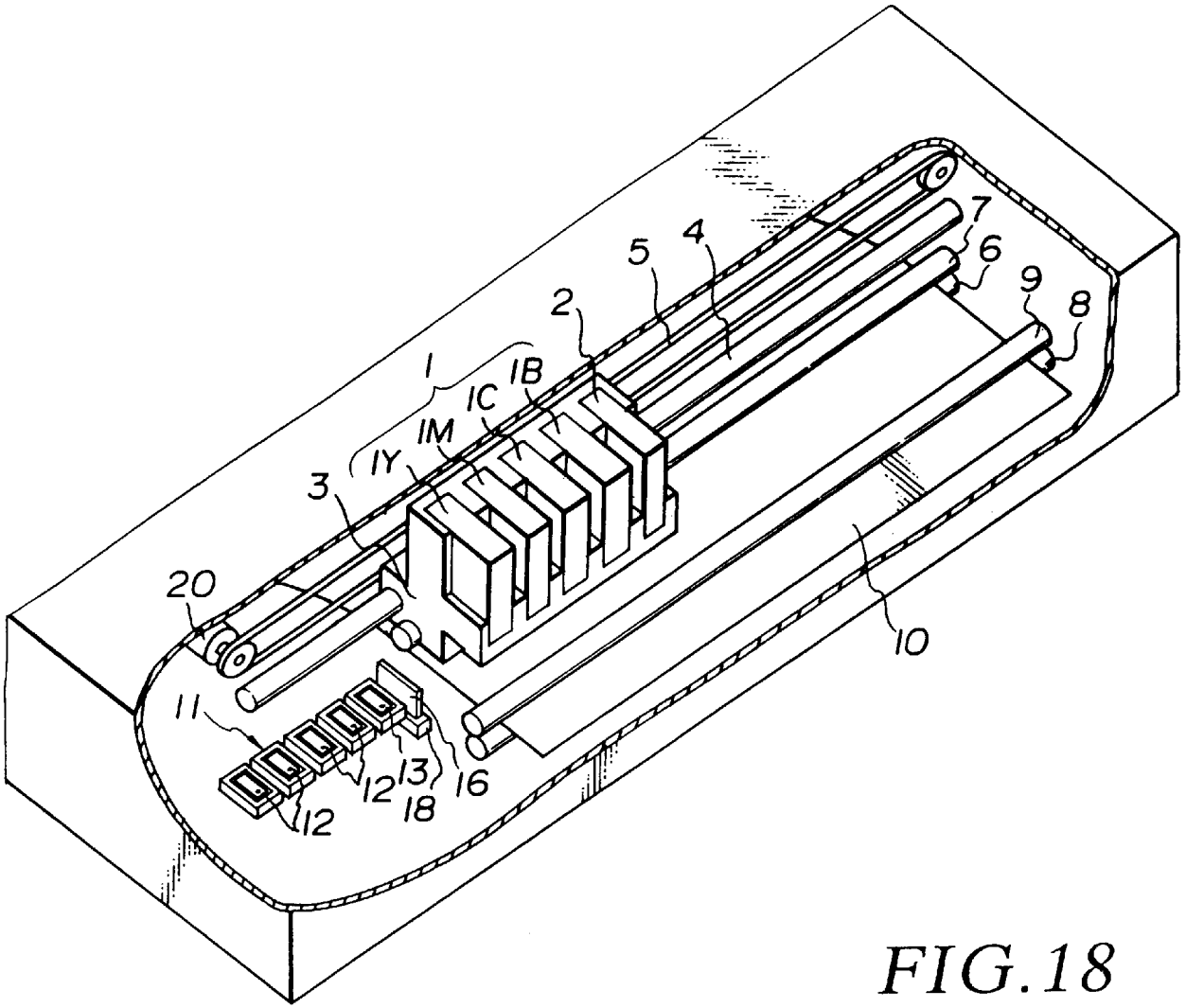
FIG. 18 is a partially broken perspective view showing an ink jet printing apparatus according to a fourth example of the present invention.

FIG. 18 is a partially broken perspective view showing an ink jet printing apparatus according to a fourth example of the present invention. In FIG. 18, a cartridge.

In FIG. 18, reference numeral 1 designates a cartridge constructing a printing head which ejects ink for printing. 2 is a cartridge constructing a head which ejects a printability improving liquid. In this example, too, four cartridges 1 for printing using different color inks and one cartridge 2 for ejecting the printability improving liquid. On the carriage 3, there are mounted from the left to the right a printing head 1Y for yellow, a printing head 1M for magenta, a printing head 1C for cyan, and a printing head 1B for black, and a printability improving liquid ejecting head 2 in positions with alignment.

On the left side or on the side of the home position of the printing apparatus is arranged a recovery unit 11, in which there are arranged sequentially from the left end, four caps for the printing heads 1 and a cap 13 for the printability improving liquid ejecting head 2 at the rightmost end. In this example, the caps 12 for the printing heads 1 and the cap 13 for the printability improving liquid ejecting head 2 are arranged so that they can move in the directions of projection and retraction (up and down) independently of each other.

Various color inks and the printability improving liquid used in the above-described ink jet printing apparatus are formulated as follows. For example, yellow (Y) ink is an ink consisting of 5.0 wt. % (% by weight) of glycerol, 5.0 wt. % of thiodiglycol, 5.0 wt. % of urea, 4.0 wt. % of isopropyl alcohol, 2.0 wt. % of a dye (C.I. Direct Yellow 142), and 79.0 wt. % of water. Magenta (M) ink is an ink consisting of 5.0 wt. % of glycerol, 5.0 wt. % of thiodiglycol, 5.0 wt. % of urea, 5.0 of isopropyl alcohol, 2.5 wt. % of a dye (C.I.

Acid Red 289), and 78.5 wt. % of water. Cyan (C) ink is an ink which consists of 5.0 wt. % of glycerol, 5.0 wt. % of thiodiglycol, 5.0 wt. % of urea, 5.0 wt. % of isopropyl alcohol, 2.5 wt. % of a dye (C.I. Direct Blue 199), and 78.5 wt. % of water. Black (B) ink is an ink which consists of 5.0 wt. % of glycerol, 5.0 wt. % of thiodiglycol, 5.0 wt. % of urea, 5.0 wt. % of isopropyl alcohol, 3.0 wt. % of a dye (C.I. Food Black 2), and 78.0 wt. % of water.

The printability improving liquid is a solution which consists of 5.0 wt. % of polyallylamine hydrochloride, 1.0 wt. % of benzalkonium hydrochloride, 10.0 wt. % of diethylene glycol, 0.5 wt. % of Acetylenol EH (manufactured by KAWAKEN FINE CHEMICAL CO., LTD.), and 83.5 wt. % of water. Here, an example is taken in which a dye is used as a coloring material of inks Y, M, C, and B. However, the present invention is not limited thereto. There can also be used pigments or mixture of dyes and pigments as the coloring material. Similar effects to those obtained with the use of dyes as the coloring material can be obtained by using an optimal printability improving liquid which can insolubilize and/or agglomerate the above-described coloring material which contains a pigment or pigments in the ink.

FIGS. 19A to 19D are each a schematic diagram illustrating the wiping action of the ink jet printing apparatus shown in FIG. 18. FIGS. 19A to 19D are each a partial front view showing the parts in the vicinity of the home position of the printing apparatus. In FIGS. 19A to 19D, the carriage 3 carries a plurality of heads 1 and 2, among which the printability improving liquid ejecting head 2 at the rightmost position has an ejecting port plane at a retracted position (higher position in FIGS. 19A to 19D) as compared with the ejecting port planes of the printing heads 1. In this example, the ejecting port plane of the printability improving liquid ejecting head 2 is located at a distance from the printing material 10 by about 1.5 mm more remote than the ejecting port planes of the printing heads 1. The larger the distance of the ejecting port plane of each head from the printing surface of the printing material 10, the lower the precision of hit on the printing material 10 of the liquid droplets. However, since the printability improving liquid is substantially transparent, the change in precision of hit by the liquid droplets from the printability improving liquid ejecting head 2 gives substantially no influence to picture quality.

Figure 19A:
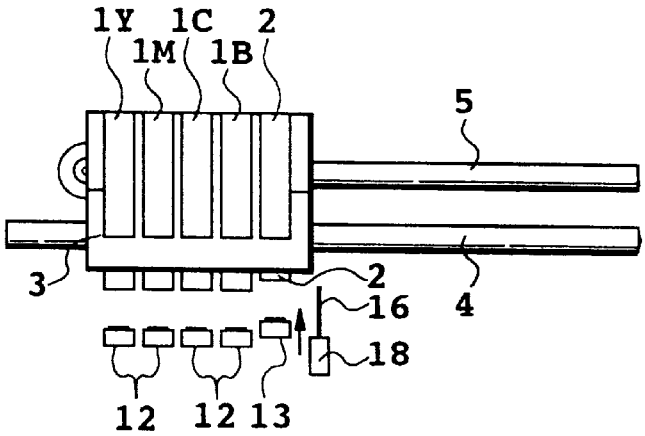
FIGS. 19A to 19D are each a schematic diagram illustrating the wiping action of the ink jet printing apparatus shown in FIG. 18.
Figure 19B:
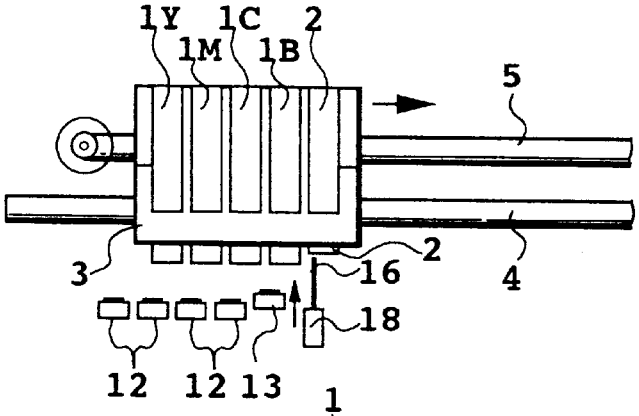
Figure 19C:
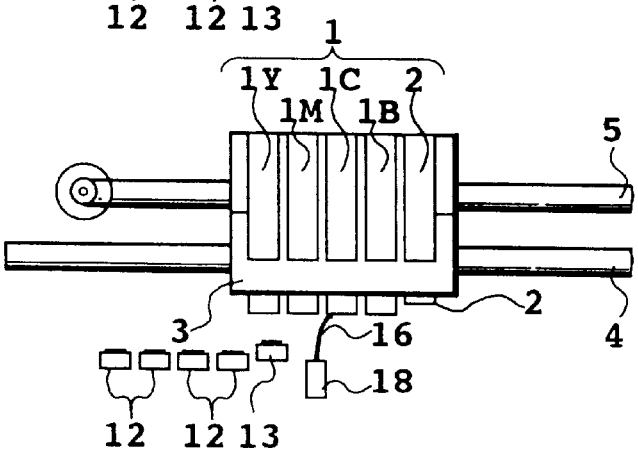
Figure 19D:
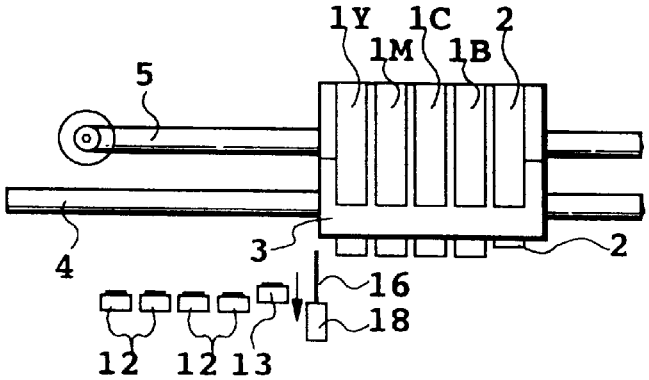

With the arrangement shown in FIGS. 19A to 19D, the blade 16 projects (elevates) to a wiping position when the carriage 3 is present at the home position as shown in FIG. 19A. Then, as shown in FIG. 19B, the carriage 3 moves along the guide rail or shaft 4 toward the printing region side. At this moment, the ejecting port plane of the printability improving liquid ejecting head 2 present at the rightmost position passes above the blade 16 without a touch since it is retracted from the ejecting port planes of the printing heads 1, when the carriage 3 moves further to the right, the blade 16 contacts the ejecting port planes of the printing heads 1 one by one and wipes the ejecting port planes by its relative movement as shown in FIG. 19C. When the ejecting port plane of the leftmost printing head 1 passes the blade 16 and is remote therefrom, the blade 16 moves to a retracted (lowered) position and stands in a waiting mode as shown in FIG. 19D. In this example, the printing apparatus is constructed such that the ejecting port plane of the printability improving liquid ejecting head 2 is not wiped. This is because there occurs substantially no adherence of liquid droplets to the ejecting port plane of the printability improving liquid ejecting head 2 due to rebounds of the liquid droplets from the printing material 10 since the ejecting port plane of the printability improving liquid ejecting head 2 is more remote from the printing material than the ejecting port planes of the printing heads 1 and, hence, there occurs no abnormality in the state of ejection without wiping. Here, the wiping by the blade 16 occurs when the carriage moves from the left in FIG. 18 (home position side) to the printing region. However, the wiping direction is not limited thereto. The printing apparatus may be constructed such that the wiping is performed when the carriage 3 moves from the printing region to the home position side.

EXAMPLE 5

Figure 20:
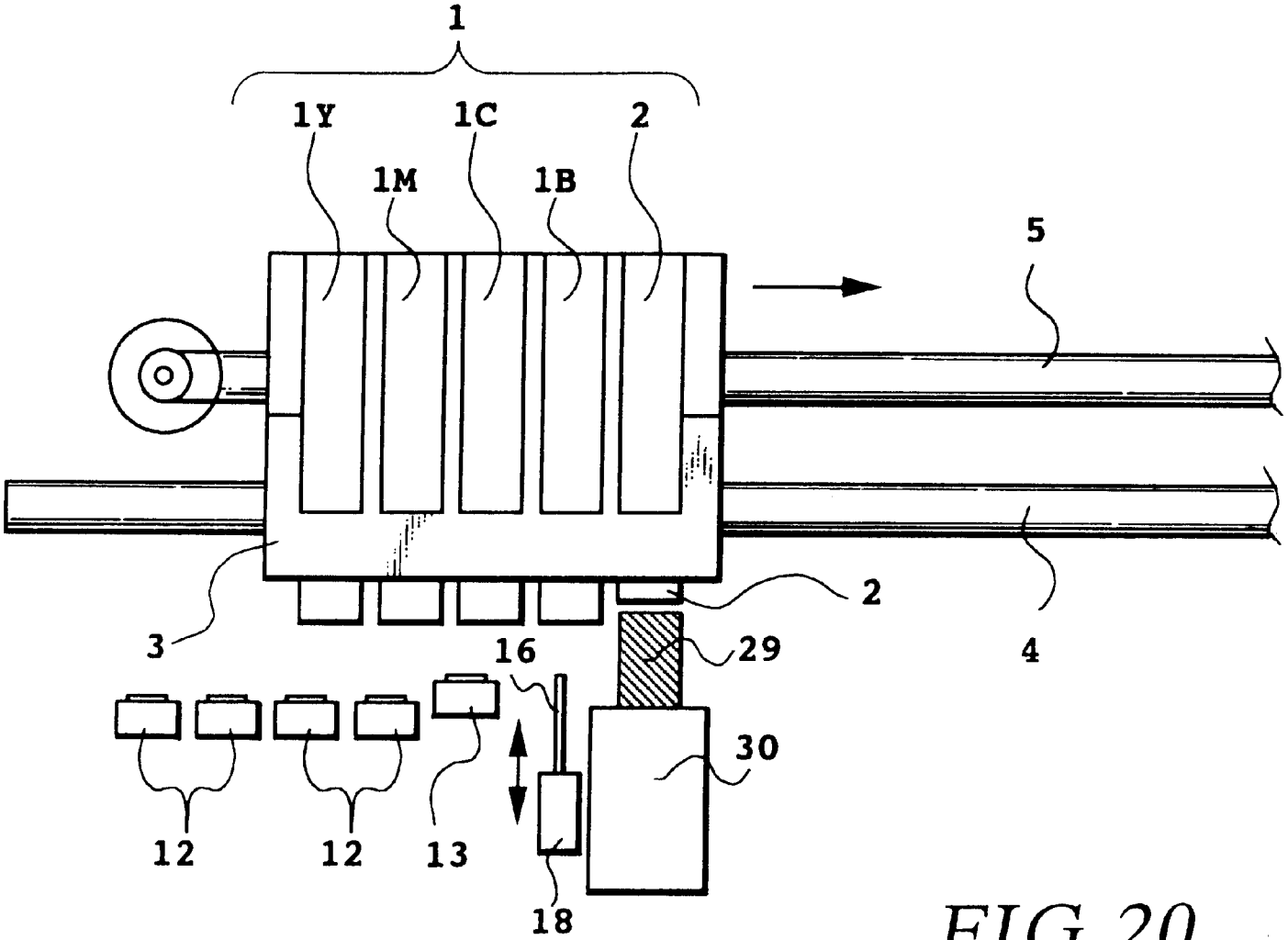
FIG. 20 is a partial plan view showing schematically a major portion of an ink jet printing apparatus according to a fifth example of the present invention.

FIG. 20 is a partial plan view showing schematically a major portion of an ink jet printing apparatus according to a fifth example of the present invention. This example corresponds to a construction in which a blade 29 for the printability improving liquid ejecting head 2 and a blade holder 30 for holding the blade 29 are added to the arrangement of the fourth example as shown in FIGS. 18 and 19A to 19D, with the other parts being of substantially the same construction. In the arrangement shown in FIG. 20, the printability improving liquid ejecting head 2 is moved to a position at which it faces the blade 29 and the ejecting port plane of printability improving liquid ejecting head 2 is wiped at this position. The blade 29 is mounted so that it contacts the ejecting port plane of the printability improving liquid ejecting head 2 while it moves in the direction vertical to the plane of paper in FIG. 20.

Figure 21:
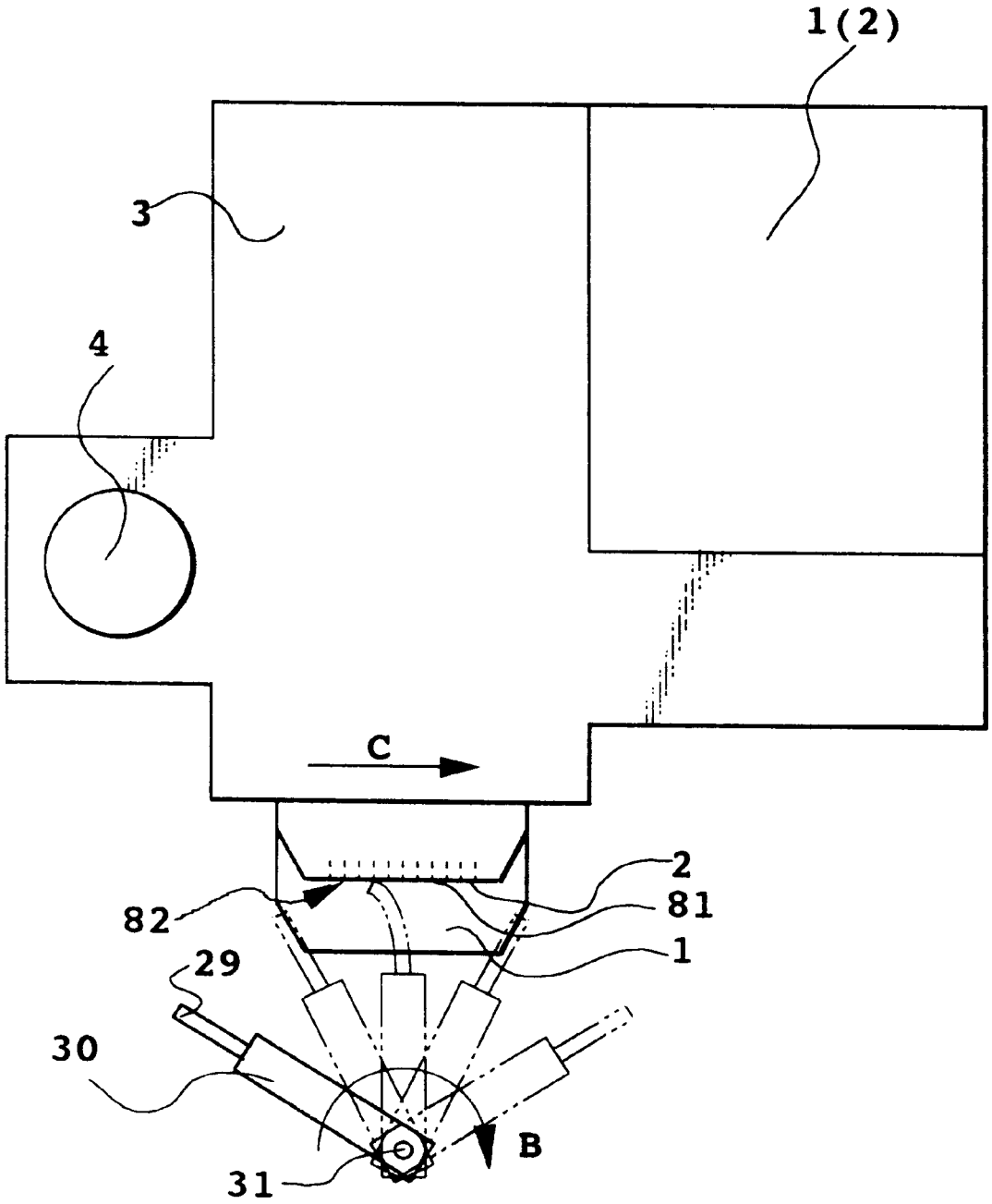
FIG. 21 is a side view showing the ink jet printing apparatus shown in FIG. 20.

FIG. 21 is a schematic side view showing the wiping action of the ink jet printing apparatus shown in FIG. 20. More particularly, FIG. 21 illustrates the wiping action of the blade 29 in the arrangement shown in FIG. 20 when it wipes the ejecting port plane of the printability improving liquid ejecting head 2. As shown in FIG. 21, the blade holder 30 holding the blade 29 is rotatable around an axis of rotation 31 and the blade 29 when rotated around the axis of rotation 31 in the direction indicated by the arrow B, contacts the ejecting port plane 81 of the printability improving liquid ejecting head 2 so that the ejecting port plane 81 of the printability improving liquid ejecting head 2 can be wiped therewith. In this case, the ejectors 82 are formed in the ejecting port plane 81 in the form of an array along the direction vertical to the direction of the scanning of the carriage 3 as indicated by the arrow C.

Figure 22:
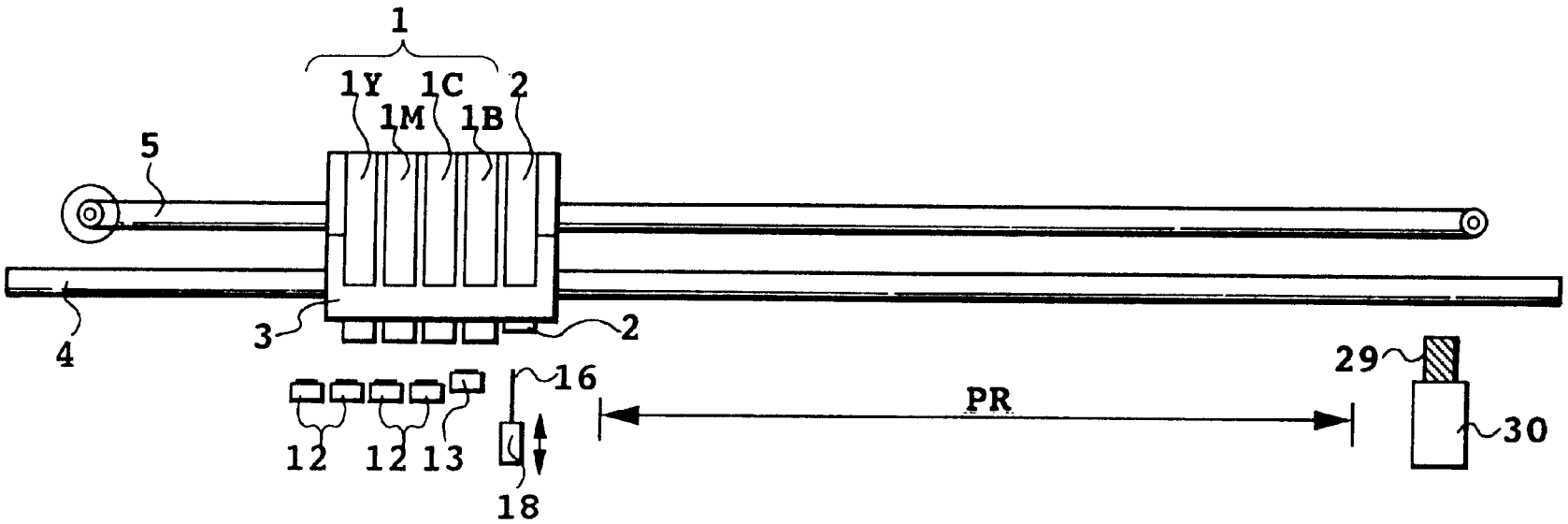
FIG. 22 is a schematic front view showing a variation of the ink jet printing apparatus shown in FIG. 17.

In the fifth example shown in FIGS. 20 and 21, the printing heads 1 and the printability improving liquid ejecting head 2 differ in the direction of wiping from each other so that there occurs no mixing of the ink with the printability improving liquid on either ejecting port plane of the printing heads 1 and the printability improving liquid ejecting head 2 even if the liquid droplets adhering to the blade scatter due to an elastic force of the blade. As a variation to the arrangement shown in FIG. 20, the rotatable blade 29 of wiping the printability improving liquid ejecting head 2 may be arranged at a position opposite to the home position (H) via the printing region (PR) as shown in FIG. 22.

EXAMPLE 6

Figure 23:
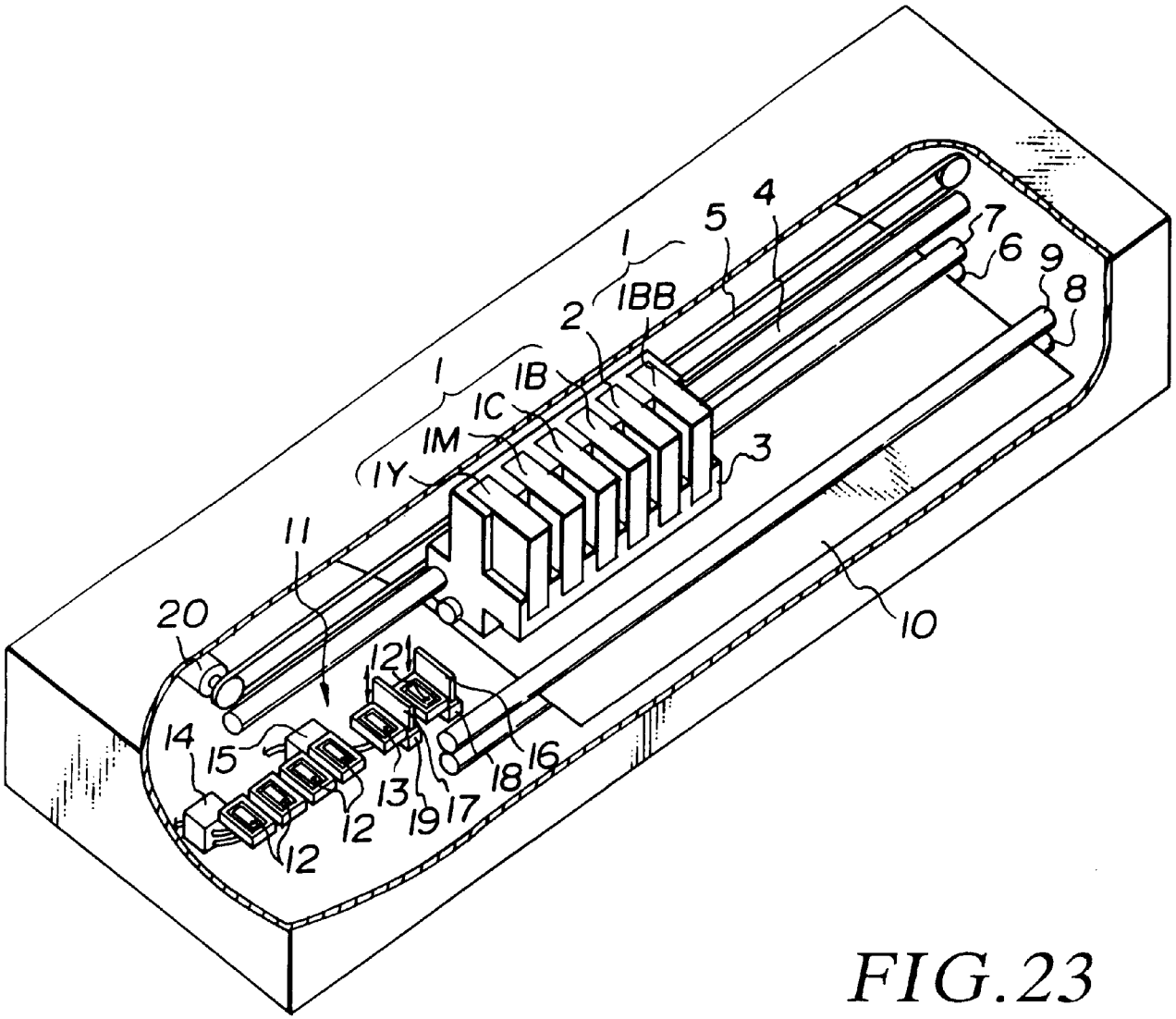
FIG. 23 is a partially broken perspective view showing an ink jet printing apparatus according to a sixth example of the present invention.

FIG. 23 is a partially broken perspective view showing an ink jet printing apparatus according to a sixth example of the present invention. In FIG. 23, the carriage 3 carries in total six cartridges in position with alignment. In this example, there are mounted on the carriage 3 a printing head 1Y for yellow, a printing head 1M for magenta, a printing head 1C for cyan, a printing head 1B for black, a printability improving liquid ejecting head 2, and a printing head 1BB for black, arrange in sequence from the left to the right in FIG. 23. The printability improving liquid ejecting head 2 ejects on a printing material 10 a printability improving liquid which insolubilizes and/or agglomerates a coloring material such as dye in ink. The rightmost printing head 1BB is a second black printing head which uses black ink employed upon a back scan printing action in reciprocating printing. That is, the printability improving liquid ejecting head 2 is arranged next to (on the right hand side of) the black printing head 1B, and then the above-described second black printing head 1BB is arranged next to (on the right hand side of) the printability improving liquid ejecting head 2.

In FIG. 23, a recovering unit 11 is arranged on the left side of the printing region (PR). The recovering unit 11 includes, as arranged sequentially from the left to the right in accordance with the arrangement of the heads 1 and 2, four caps 12 for capping four printing heads 1Y, 1M, 1C, and 1B, respectively, and next thereto (on the right hand side thereof) one cap 13 for capping the printability improving liquid ejecting head 2, and in addition, next to (on the right hand side of) the printability improving liquid ejecting head 2, another cap 12 for capping the second black printing head 1BB.

Between the cap 13 for the printability improving liquid which is the fifth from the left end and the cap 12 for black ink which is the sixth from the left (the rightmost) is arranged the blade 17 for the printability improving liquid ejecting head 2, and the blade 16 for the printing heads 1 is arranged on the right hand side (on the printing region (PR) side) of the rightmost cap 12. Other portions are of substantially the same construction as the printing apparatus shown in FIG. 4. Same parts are indicated by the same reference numerals and detailed description thereof will be omitted here.

The blades 16 and 17 for wiping the ejecting port planes of the heads (in total 6) are made of a material generally having a lower hardness than the heads so that they do not injure the ejecting port planes. In order to increase an allowance for relative position between the blades and the heads, the blades 16 and 17 are in many cases made of an elastic material. The material which can be generally used for the blades 16 and 17 includes elastic materials such as natural rubber, nitrile rubber, butadiene rubber, chloroprene rubber, butyl rubber, chlorinated butyl rubber, silicone rubber, polystyrene rubber, polyvinyl chloride, and polyurethane rubber. In addition, foamed or sintered material made of polyurethane, polyethylene or the like can be used as the case may be. The blades 16 and 17 are held by the blade holders 18 and 19, respectively.

In the printing apparatus according to the sixth example shown in FIG. 23, the blade 16 held by the blade holder 18 and the blade 17 held by the blade holder 19 are constructed such that they can be set to a projected (elevated) position (wiping position) for wiping the ink or foreign matter adhering to the ejecting port planes of the heads 1 and 2 and to a retracted (lowered) position (waiting position) not contacting the ejecting port planes, independently of each other.

In this example, when the carriage 3 moves from the right in FIG. 4 (printing region side) to the home position (H) side where the recovering unit 11 is present, or from the home position (H) side to the printing region (PR) side, the blade 16 contacts the ejecting port planes of the printing heads 1 and moves relatively thereto, and the blade 17 contacts the ejecting port plane of the printability improving liquid ejecting head 2 and moves relatively thereto, to effect the wiping action for wiping the ejecting port planes by relative movement thereof.

In the ink jet printing apparatus according to this example shown in FIG. 23, the printability improving liquid ejecting head 2 ejects on the printing material 10 a printability improving liquid for insolubilizing and/or agglomerating in water the coloring material such as dye or pigment in an ink and causes the printability improving liquid to contact with the inks ejected from the printing heads 1 on the printing material 10 to give the dye or pigment in the inks with water resistance. Since the dyes or pigments in the inks react with the printability improving liquid on the printing material 10 to immediately insolubilize and/or agglomerate them, not only the water resistance of the inks increases but also undesired bleeding between the different color inks can be prevented.

Figure 24A:
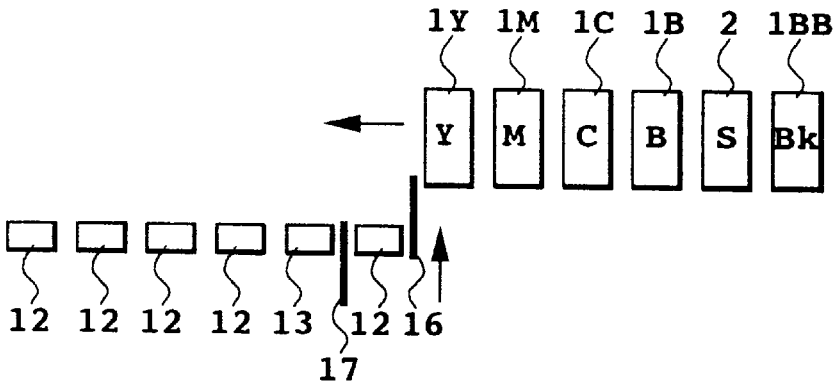
Figure 24B:
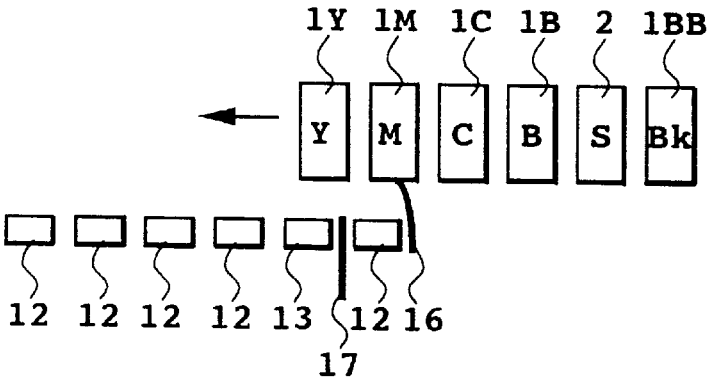
Figure 24C:
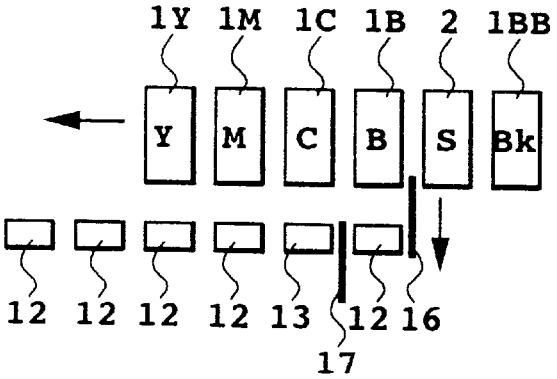

FIGS. 24A to 24F are each a schematic diagram illustrating the wiping action of the ink jet printing apparatus shown in FIG. 23. In the arrangement shown in FIGS. 24A to 24F, after the blade 16 for the printing heads 1 is projected (elevated), the heads mounted on the cartridge 3 move form the right (printing region (PR) side) toward the home position (H) as shown in FIG. 24A. The elevated blade 16 for the printing heads 1 wipes the printing heads 1 sequentially according as the carriage 3 moves to the left as shown in FIG. 24B. Then, as shown in FIG. 24C, the blade 16 is retracted (lowered) to a waiting position at the moment when the printability improving liquid ejecting head 2 reaches just before (right hand neighbor of) the blade 16 for the printing heads 1 so that contact of the blade 16 with the printability improving liquid ejecting head 2 can be prevented.

Figure 24E:
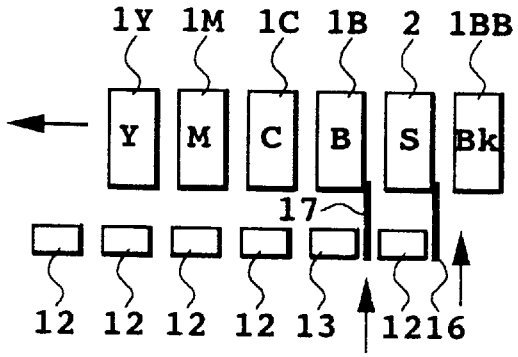
Figure 24E:
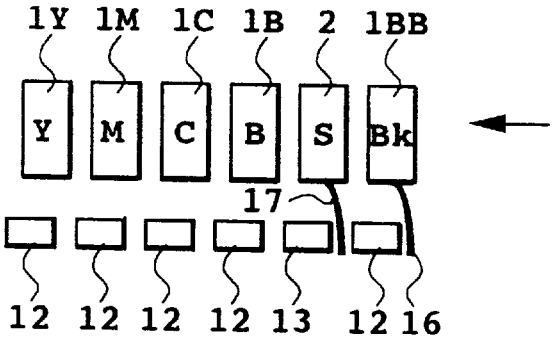
Figure 24F:
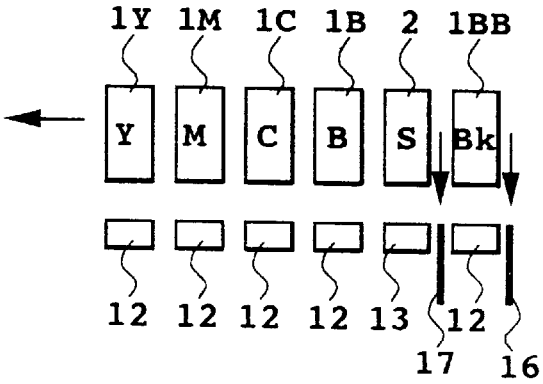

Further, when the carriage 3 moves to the left and the printability improving liquid ejecting head 2 passes above the blade 16 for the printability improving liquid ejecting heads 1, the blade 16 for the printing heads 1 and the blade 17 for the printability improving liquid ejecting head 2 are projected (elevated) as shown in FIG. 24D. Then, according as the carriage 3 moves toward the left, the wiping of the printability improving liquid ejecting head 2 by the blade 17 and the wiping of the printing head 1BB at the right end by the blade 16 are performed simultaneously as shown in FIG. 24E. After the wiping of all the heads 1 and 2 is over, both the blades 16 and 17 are retracted (lowered) to stand in a waiting position as shown in FIG. 24F.

With the arrangement shown in FIGS. 24A to 24F, the wiping actions by the blades 16 and 17 are performed when the carriage 3 moves from the right (printing region (PR) side) to the left (home position (H) side where the recovering unit 11 is present). However, the direction of wiping is not limited thereto. The printing apparatus may be constructed such that wiping occurs when the carriage moves from the home position (H) side to the right (printing region side (PR)).

EXAMPLE 7

FIGS. 25A to 25H are each a schematic view showing a major part of an ink jet printing apparatus according to a seventh example of the present invention and illustrating the wiping action of the printing apparatus. FIGS. 25A to 25H are each a partial front view showing a part of the printing apparatus in the vicinity of the home position (H). The carriage 3 carries, as arranged in sequence from the left to the right, in total six heads in position with alignment. That is, there are mounted on the carriage 3 a yellow-printing head 1Y for printing yellow, a magenta-printing head 1M for printing magenta, a cyan-printing head 1C for printing cyan, a black-printing head 1B for printing black, a printability improving liquid ejecting head 2, and a second black-printing head 1BB for printing black.

In FIG. 23, a recovering unit 11 arranged in the vicinity of the home position of the printing apparatus includes, as arranged sequentially from the left to the right in accordance with the arrangement of the heads 1 and 2, in total six caps 12 and 13. In the right hand neighbor of the rightmost cap 12 is arranged a blade 16 for wiping the printing heads 1 and a blade 17 for wiping the printability improving liquid ejecting head 2 is arranged in the right hand neighbor of the blade 16. The blades 16 and 17 are held by blade holders 18 and 19, respectively, and driven to a projected (elevated) position and a retracted (lowered) position independently of each other.

As shown in FIGS. 25A to 25H, among the six heads mounted on the carriage 3, the second from the right end, i.e., the printability improving liquid ejecting head 2, is arranged such that its ejecting port plane is arranged at a retracted position more remote from a printing surface of a printing material 10 than the ejecting port planes of other heads (printing heads). In this example, the ejecting port plane of the printability improving liquid ejecting head 2 is arranged by about 1.5 mm more remote from the printing material 10 than the ejecting port planes of the printing heads 1. The larger the distance of the ejecting port plane of each head from the printing surface of the printing material 10, the lower the precision of hit on the printing material 10 of the liquid droplets. However, since the printability improving liquid is substantially transparent, the change in precision of hit by the liquid droplets from the printability improving liquid ejecting head 2 gives substantially no influence to the picture quality of the product.

Further, in this example, an overlap (invasion) between a tip portion of the blade 16 and the ejecting port plane of each printing head 1 is set to about 1.0 mm. The cap 13 for capping the printability improving liquid ejecting head 2 is arranged in a projected position relatively projected (elevated) with respect to the ejecting port planes of the printing heads 1 by a distance d of retraction of the ejecting port plane of the printability improving liquid ejecting head 2.

Figure 25A:
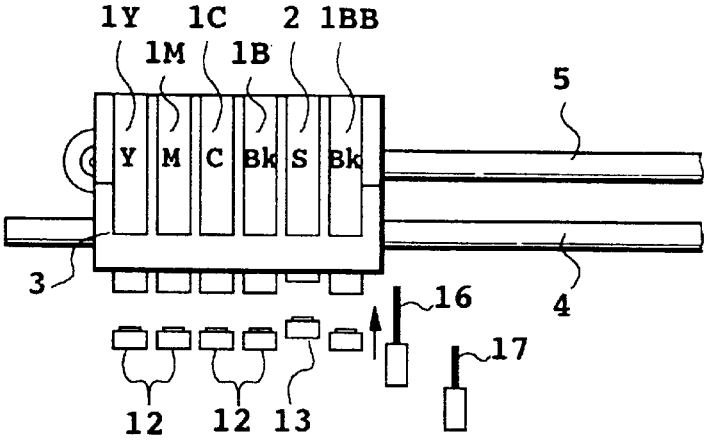
FIGS. 25A to 25H are each a schematic view showing a major part of an ink jet printing apparatus according to a seventh example of the present invention and illustrating the wiping action of wipers in the apparatus.
Figure 25B:
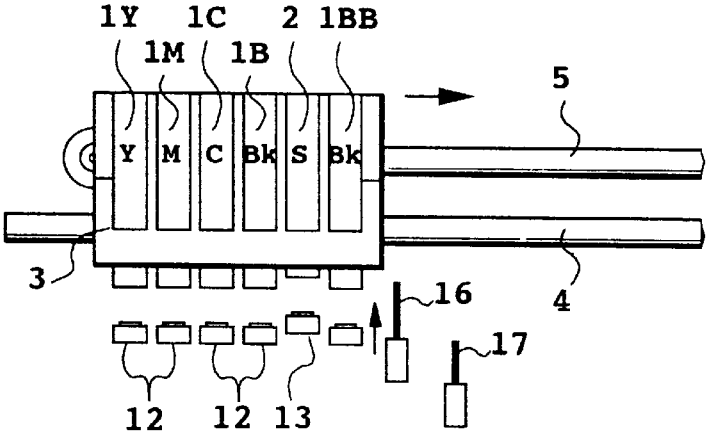
Figure 25C:
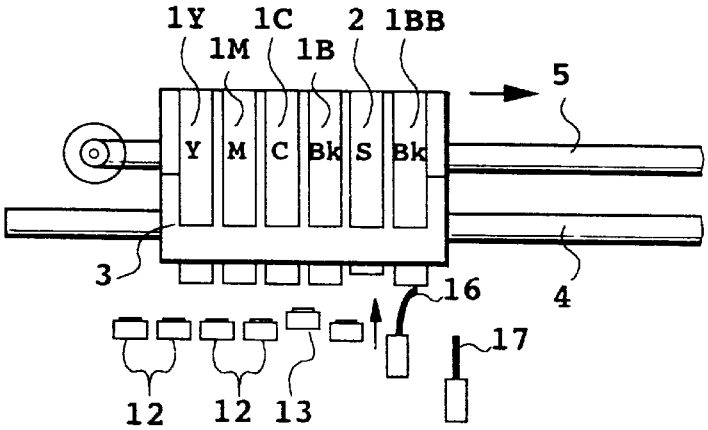
Figure 25D:
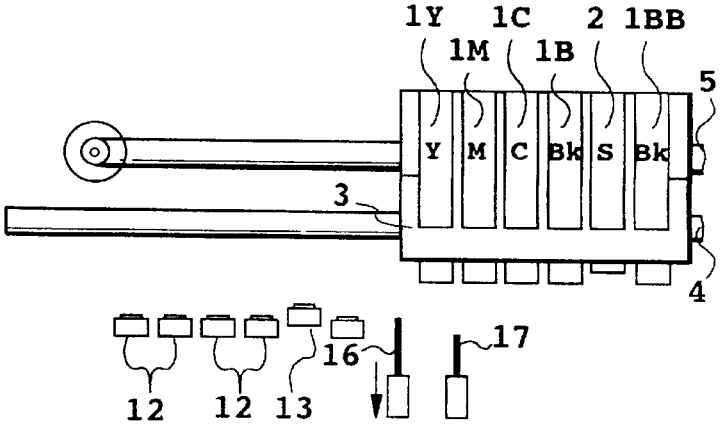
Figure 25E:
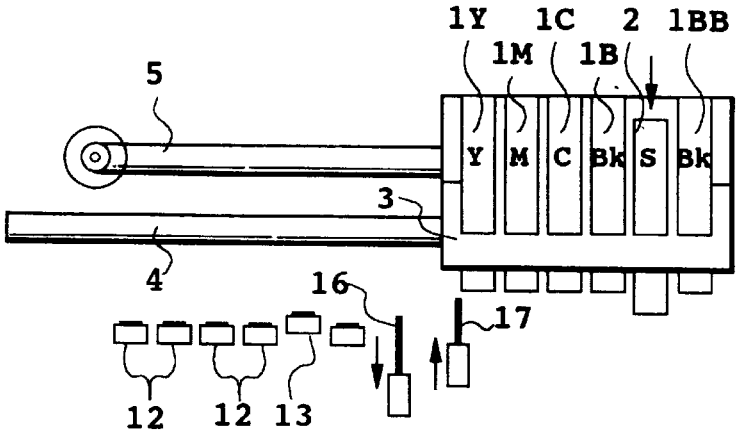
Figure 25F:
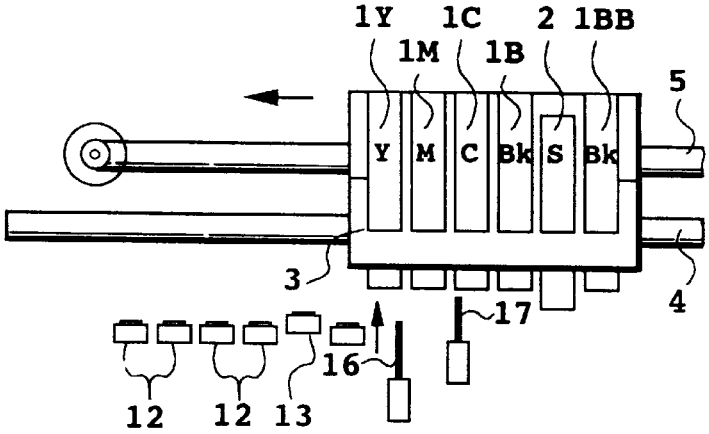
Figure 25G:
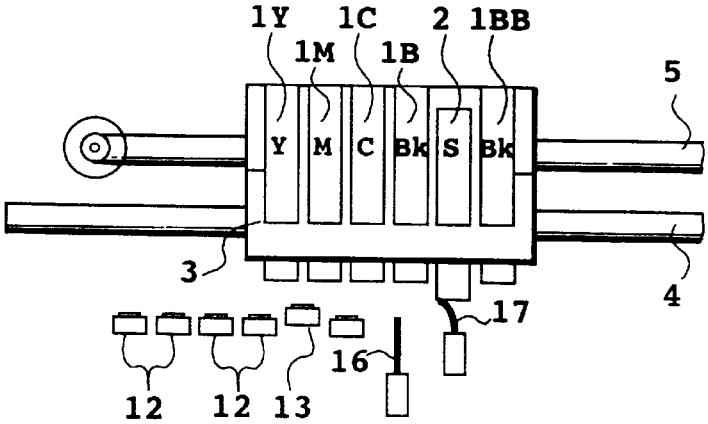
Figure 25H:
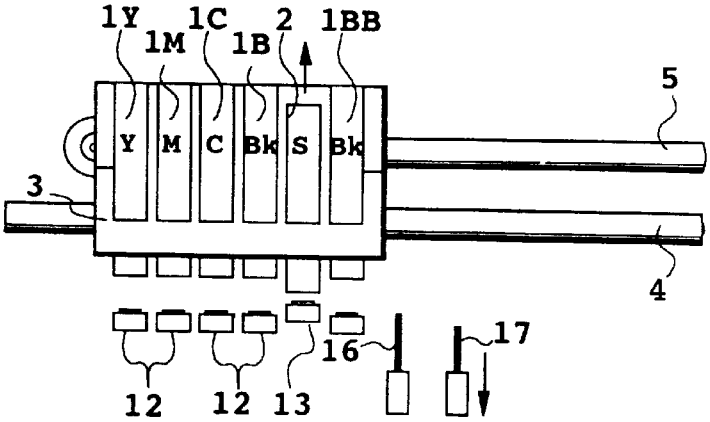

The wiping action of the printing apparatus according to the seventh example of the present invention is as follows. In the arrangement shown in FIGS. 25A to 25H, the blade 16 projects (elevates) to a wiping position when the carriage 3 is present in the home position as shown in FIG. 25A. Then, as shown in FIG. 25B, the carriage 3 moves along the guide rail or shaft 4 toward the printing region side. At this moment, the ejecting port plane of the printability improving liquid ejecting head 2 positioned at the second from the right end passes above the blade 16 without any contact therewith since it is retracted from the ejecting port planes of the printing heads 1. When the carriage 3 moves further to the right, the blade 16 comes in contact with the ejecting port planes of the printing heads 1 one by one and wipes the ejecting port planes by its relative movement as shown in FIG. 25C. Upon this wiping, the ejecting port plane of the printability improving liquid ejecting head 2 is retracted by about 0.5 mm larger than the overlap or invasion of the blade 16 more remote as compared with the ejecting port planes of the printing heads 1 and, hence, the ejecting port plane of the printability improving liquid ejecting head 2 does not contact the blade 16. When the carriage 3 moves to the right further and the ejecting port plane of the leftmost printing head 1 passes the blade 16, the blade 16 moves to a retracted (lowered) position and stands in a waiting mode as shown in FIG. 25D. When all the heads pass above the blade 17 to the right hand side thereof, the blade 17 projects (elevates) as shown in FIG. 25E, and the printability improving liquid ejecting head 2 makes forward to a wiping position (down ward projected position) as driven by a driving mechanism (not shown). Then, the carriage moves to the home position side as shown in FIG. 25F, and the blade 17 wipes the ejecting port plane of the printability improving liquid ejecting head 2 as shown in FIG. 25G. Further, the carriage 3 moves to the left, and stops at the time when the head at the right end passes above blade 16 to retract (lower) the blade 17 for the printability improving liquid ejecting head 2 to a waiting position and return the printability improving liquid ejecting head 2 to the original retracted position (default position) as shown in FIG. 25H.

In this example, although the printing apparatus is constructed such that the printing heads 1 are wiped by the blade 16 when the carriage 3 moves from the left (home position (H) side) to the printing region side while the printability improving liquid ejecting head 2 is wiped by the blade 17 when the carriage 3 moves in the opposite direction, the wiping direction is not limited thereto. The printing apparatus may be constructed such that wiping occurs when the carriage 3 moves in the opposite direction to the above. Also, it may be constructed such that the distance between the blades 16 and 17 is adjusted and the printability improving liquid ejecting head 2 and the printing heads 1 are wiped with one movement of the carriage.

EXAMPLE 8

Figure 26A:
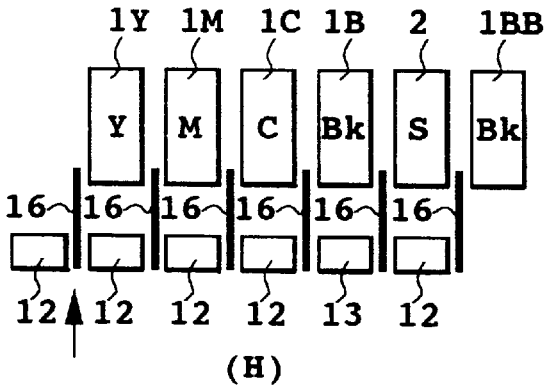
FIGS. 26A to 26D are each a schematic view showing a major part of an ink jet printing apparatus according to an eighth example of the present invention and illustrating the wiping action of wipers in the apparatus.
Figure 26B:
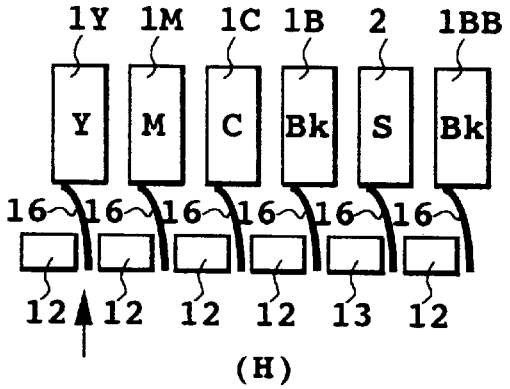

FIGS. 26A to 26D are each a schematic view showing a major part of an ink jet printing apparatus according to an eighth example of the present invention and illustrating the wiping action of wipers in the apparatus. In this example, a blade is arranged separately for each of six heads mounted on the carriage 3. In the arrangement shown in FIGS. 26A to 26D, the carriage 3 moves until it comes before the blades 16 and 17 corresponding to the heads 1 and 2 as shown in FIG. 26A. At this position, the blades 16 and 17 are projected (elevated) to respective wiping positions. As soon as the blades 16 and 17 are set to the projected positions, the carriage 3 moves to the home position (H) side (to the left) to wipe the ejecting port planes of all the printing heads 1 at a time as shown in FIG. 26B.

Figure 26C:
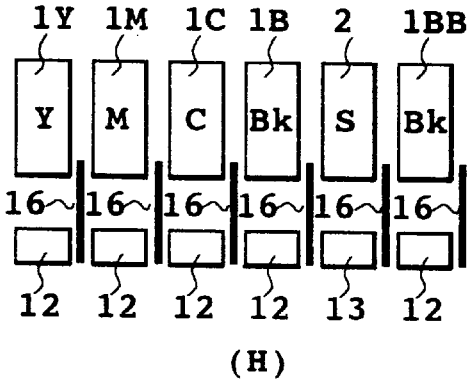
Figure 26D:
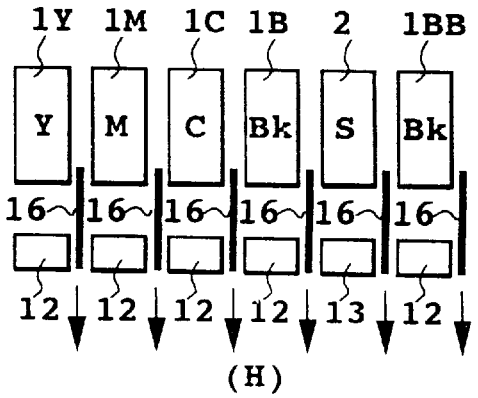

In FIGS. 26A to 26D, when the wiping of the ejecting port planes of the heads 1 and 2 is over, the movement of the carriage 3 is stopped as shown in FIG. 26C and the blades 16 and 17 are retracted (lowered) to respective waiting positions as shown in FIG. 26D. According to this example, since no complicated action is involved upon a wiping each head and since the time for which the blade contacts the head is relatively short, the time required for a wiping can be reduced to some extent. At the same time, there occurs no contact or mixing between different color inks or between an ink and a printability improving liquid through the blades 16 and 17, color mixing by such a mixing can be prevented.

In each of the examples shown in FIGS. 23 to 26D, an ink jet printing apparatus which can obviate a printing failure, such as a distorted ejection or an ejection failure as would be encountered when a wiping mechanism is used in common, by providing blades or wiping mechanism for the printing heads 1 and blades or wiping mechanism for the printability improving liquid ejecting head 2 separately.

In this example, the printing apparatus is constructed such that the heads are wiped with separate blades in the scanning direction of the carriage. However, the present invention is not limited particularly to this construction but each independent blade may wipe the ejecting port planes of the heads by relative movement along the direction in which the ejecting ports are arrayed.

EXAMPLE 9

Figure 27:
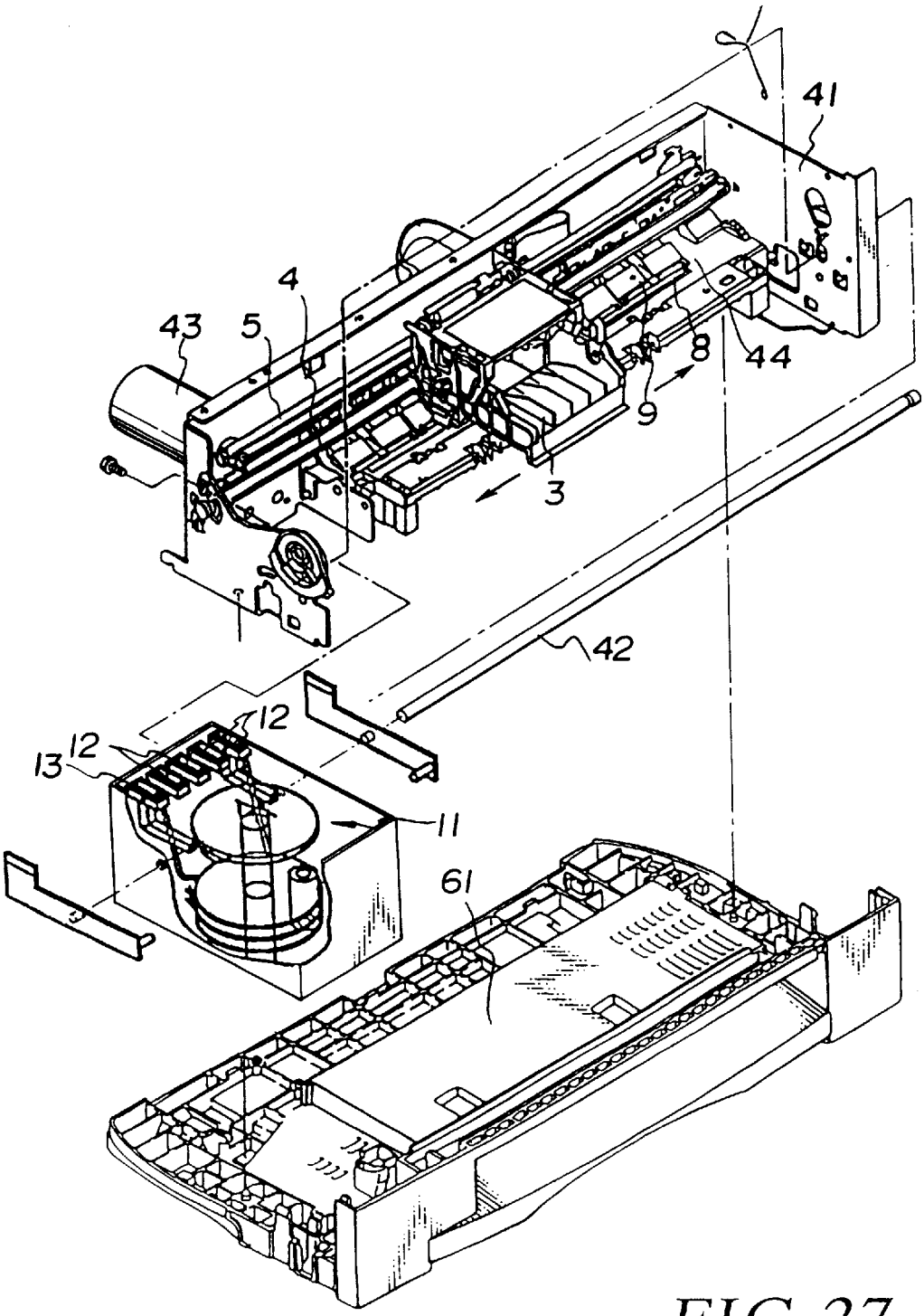
FIG. 27 is a schematic view showing a main part of an ink jet printing apparatus according to a ninth example of the present invention and illustrating the wiping action of wipers in the apparatus.
Figure 28:
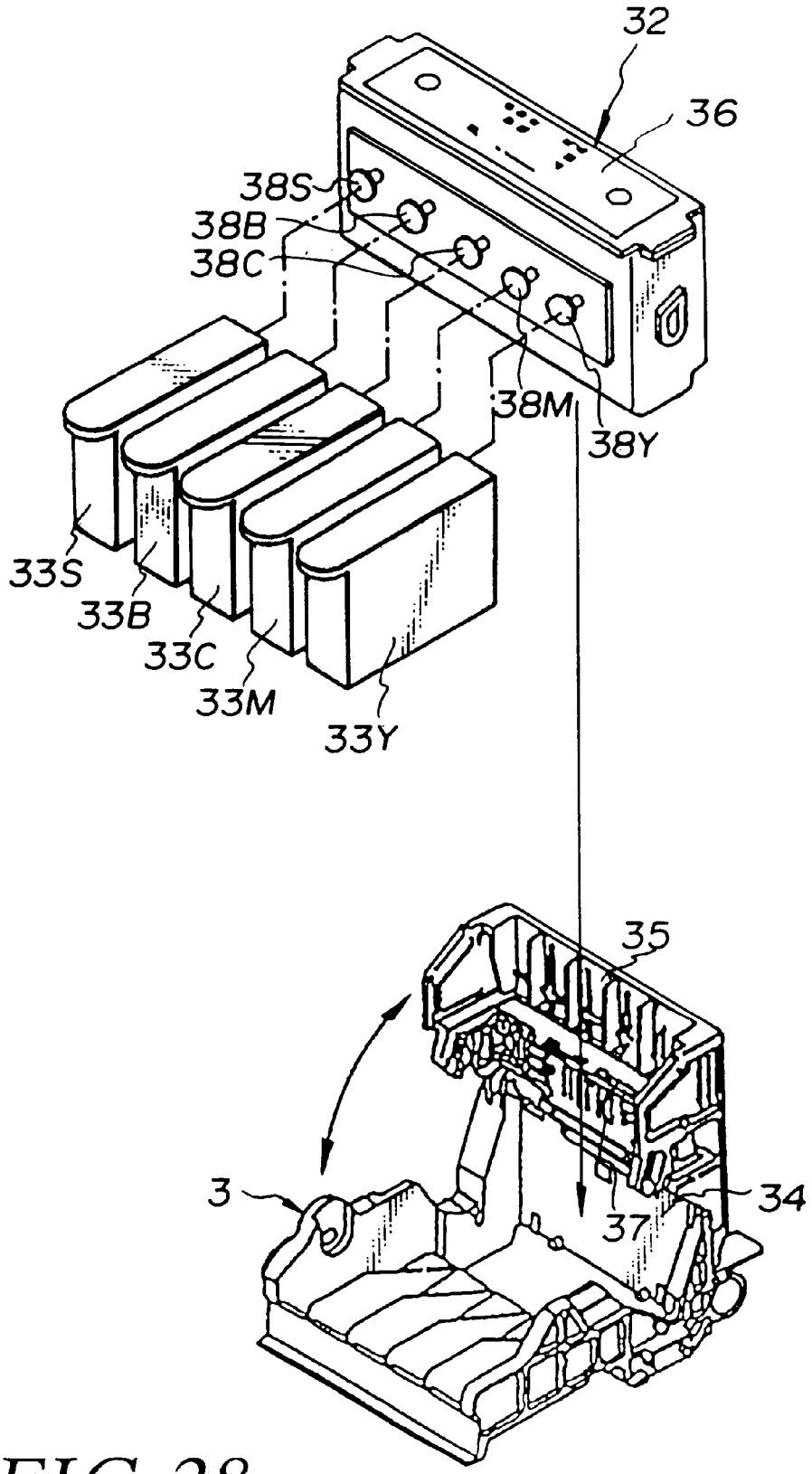
FIG. 28 is an exploded perspective view schematically showing an ink jet head unit, a liquid tank, and a carriage in the ink jet printing apparatus shown in FIG. 27.
Figure 29:
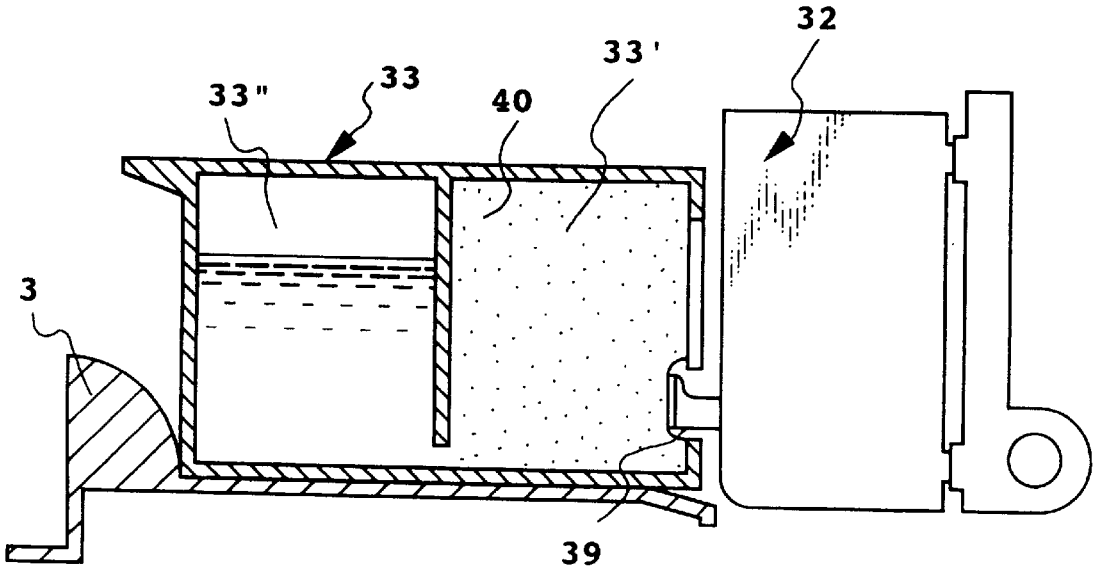
FIG. 29 is a schematic vertical cross-sectional view showing the state in which an ink jet head unit and a liquid tank are mounted on the carriage in the ink jet printing apparatus shown in FIG. 27.
Figure 30:
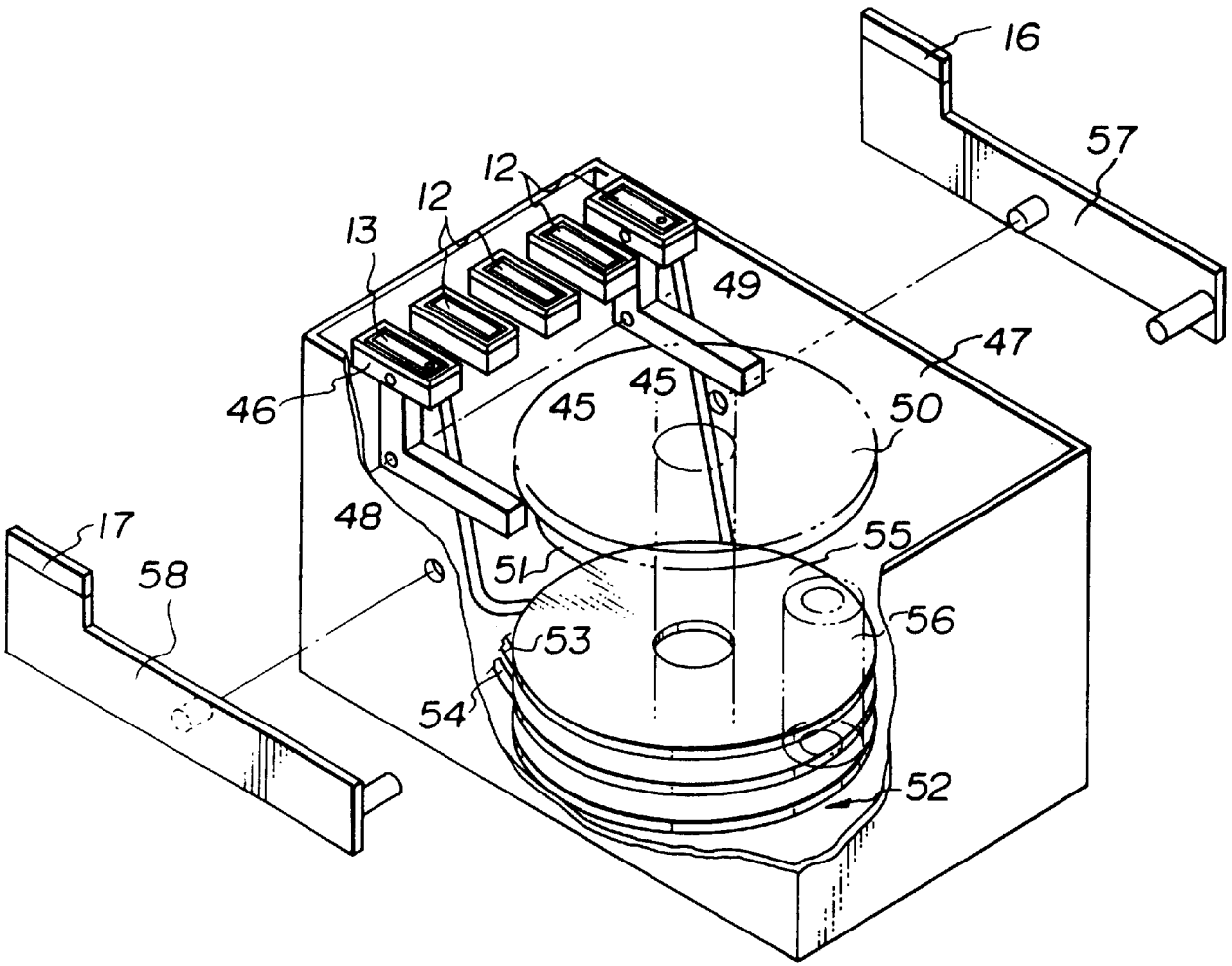
FIG. 30 is a schematic perspective view showing a detailed structure of the recovering unit in the ink jet printing apparatus shown in FIG. 27.

FIG. 27 is a schematic view showing a main part of an ink jet printing apparatus according to a ninth example of the present invention and illustrating the wiping action of wipers in the apparatus. FIG. 28 is an exploded perspective view schematically showing an ink jet head unit, a liquid tank, and a carriage in the ink jet printing apparatus shown in FIG. 27. FIG. 29 is a schematic vertical cross-sectional view showing the state in which an ink jet head unit and a liquid tank are mounted on the carriage in the ink jet printing apparatus shown in FIG. 27. FIG. 30 is a schematic perspective view showing a detailed structure of the recovering unit in the ink jet printing apparatus shown in FIG. 27.

In FIGS. 27 to 29, a head unit 32 and a plurality of liquid tanks 33 are exchangeably mounted on the carriage 3. In this example, the plurality of tanks 33 include in total five independent tanks, i.e., a printability improving liquid tank 33S for containing a printability improving liquid S, a black ink tank 33B for containing black ink, a cyan ink tank 33C for containing cyan ink, a magenta ink tank 33M for containing magenta ink, and a yellow ink tank 33Y for containing yellow ink. The head unit 32 has incorporated therein four ejectors ejecting the above-described four color inks, respectively, and one ejector ejecting the above-described printability improving liquid. The head unit 32 is mounted on the carriage 3 with the ejectors for ejecting inks and the ejector for ejecting the printability improving liquid being connected to liquid storage tanks (ink tanks and a printability improving liquid tank) 33 separately.

As shown in FIG. 29, the carriage 3 includes a carriage base for positioning and mounting the five liquid storage tanks 33 and 3 head lever 35 mounted on the carriage base 34 for positioning and holding the head unit 32. On the upper part of the head unit 32 is provided with a connector 36 for receiving driving signals for driving the ink ejectors 1B, 1C, 1M, and 1Y and the printability improving liquid ejector 1S. The connector 36 is electrically connected to a connector 37 provided in the carriage 3.

The liquids in the liquid storage tanks 33S, 33B, 33C, 33M, and 33Y (printability improving liquid and various color inks) are supplied through supply ports 38S, 38B, 38C, 38M, and 38Y provided in the head unit 32 correspondingly via passages in the head unit 32 to corresponding ejectors (a printability improving liquid ejector and color ink ejectors) 2, 1B, 1C, 1M and 1Y in the head unit 32. The printability improving liquid tank 33S and the color ink tanks 33B, 33C, 33M, and 33Y are provided with supply ports 39 (39S, 39B, 39C, 39M, and 39Y) which engage with the supply ports 38S, 38B, 38C, 38M, and 38Y, respectively.

As shown in FIG. 29, the inside of each liquid storage tank 33 is partitioned into two chambers 33' and 33", with the chamber 33' closer to the supply port 39 being filled with an ink absorbing substrate 40 and the other chamber 33" storing a liquid (ink or printability improving liquid). U-shaped chassis 41 is provided on both side walls thereof with a guide shaft 4 and a support shaft 42 for guiding and supporting the carriage 3. The driving force for driving the carriage 3 which moves reciprocatingly along the shafts 4 and 42 in the main scanning direction is transmitted through a driving belt 5 from a carriage motor 43.

The printing material 10 such as paper is conveyed by conveying rolls 8 and 9 while they clamp the printing material 10 therebetween. In the printing region, the printing material 10 is conveyed along a platen 44. At this moment, the ejector (ejecting port plane) of the head unit 32 mounted on the carriage 3 projects downward from the carriage 3 so that it faces in parallel and at a predetermined distance or gap from the printing surface of the printing material 10 on the platen 44.

A recovering unit 11 is arranged on the left side (home position side) of the printing region of the printing apparatus. As shown in FIG. 30, the recovering unit 11 includes as arranged from the left to the right in order a cap 13 for a printability improving liquid S, a cap 12 for black B, a cap 12 for cyan C, a cap 12 for magenta M, and a cap 12 for yellow Y corresponding to ejectors (printability improving liquid ejector and ink ejectors) S. B, C, M, and Y in the head unit 32 mounted on the carriage 3.

In this example, the cap 13 for the printability improving liquid ejector S and the cap 12 for yellow ink ejector Y are used as both suction cap and non-suction cap (left-as-is cap), while the caps 12 for the black, cyan and magenta color ink ejectors B, C, and M are used exclusively as non-suction caps. Therefore, suction of ink from the black, cyan and magenta ink ejectors b, C, and M is performed with the cap 12 for the yellow ink ejector Y.

Figure 31:
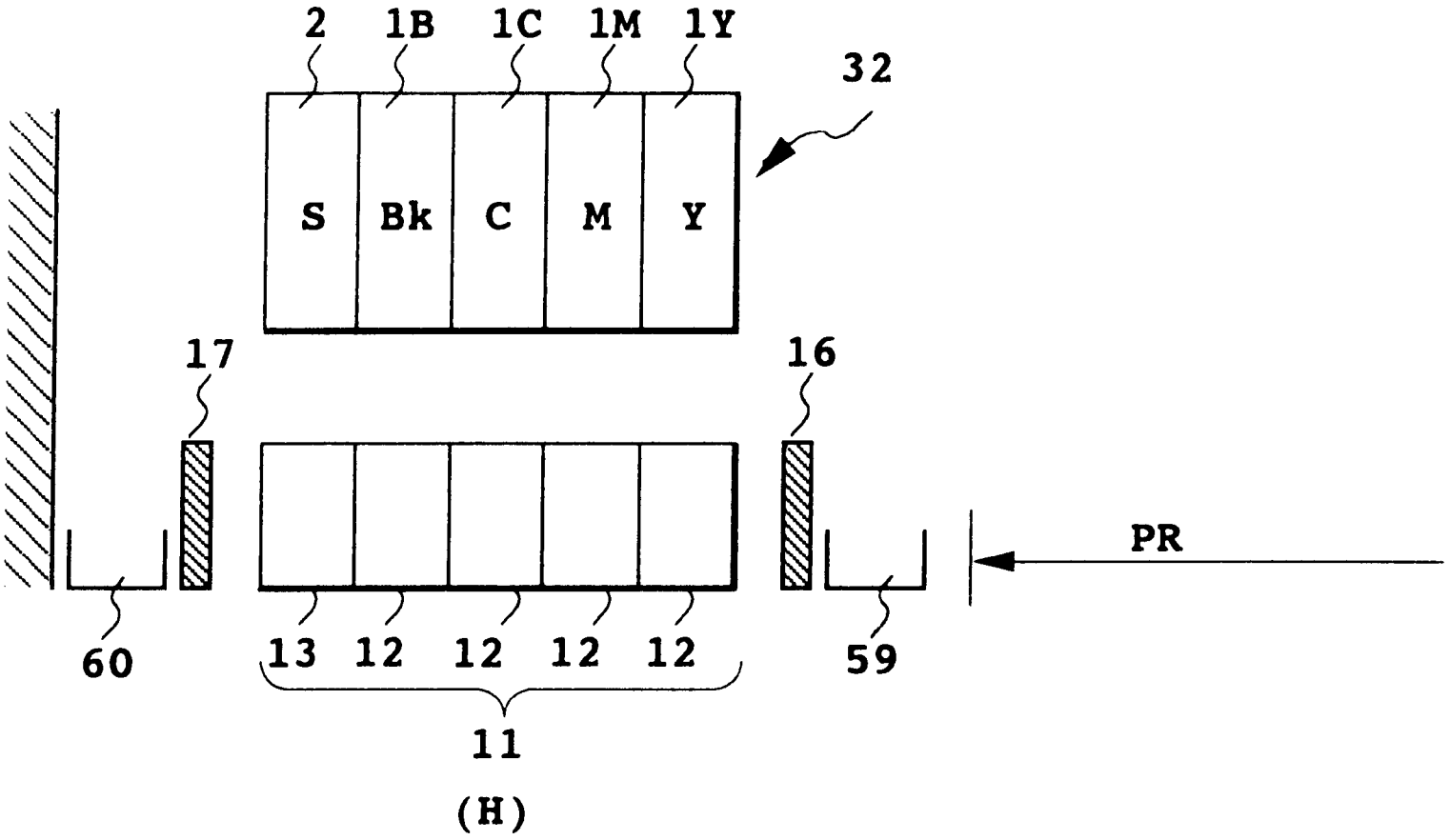
FIG. 31 is a schematic front view illustrating the capping action of the ink jet printing apparatus shown in FIGS. 27 to 30.
Figure 32:
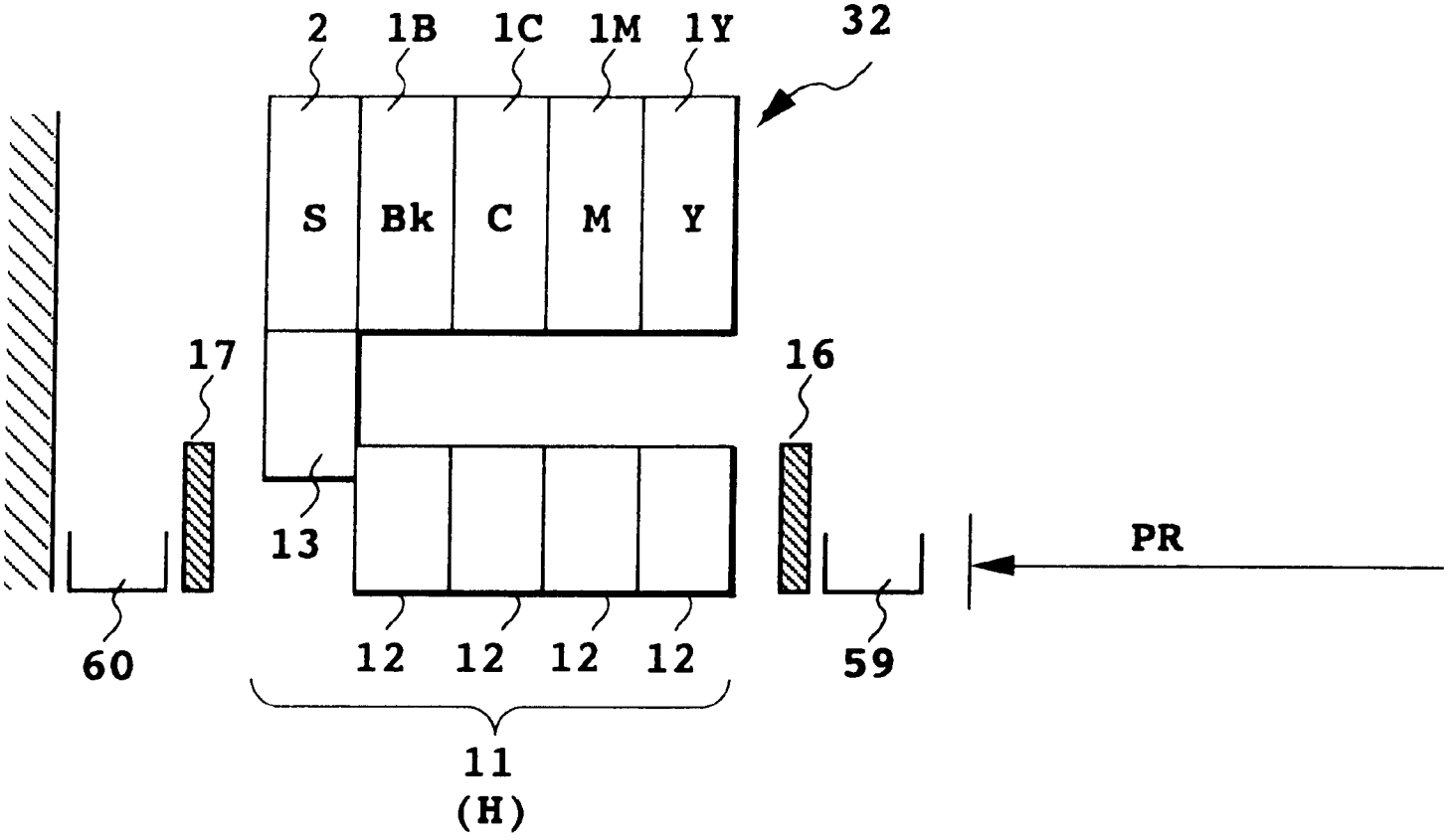
FIG. 32 is a schematic front view illustrating the capping action of the ink jet printing apparatus shown in FIGS. 27 to 30.
Figure 33:
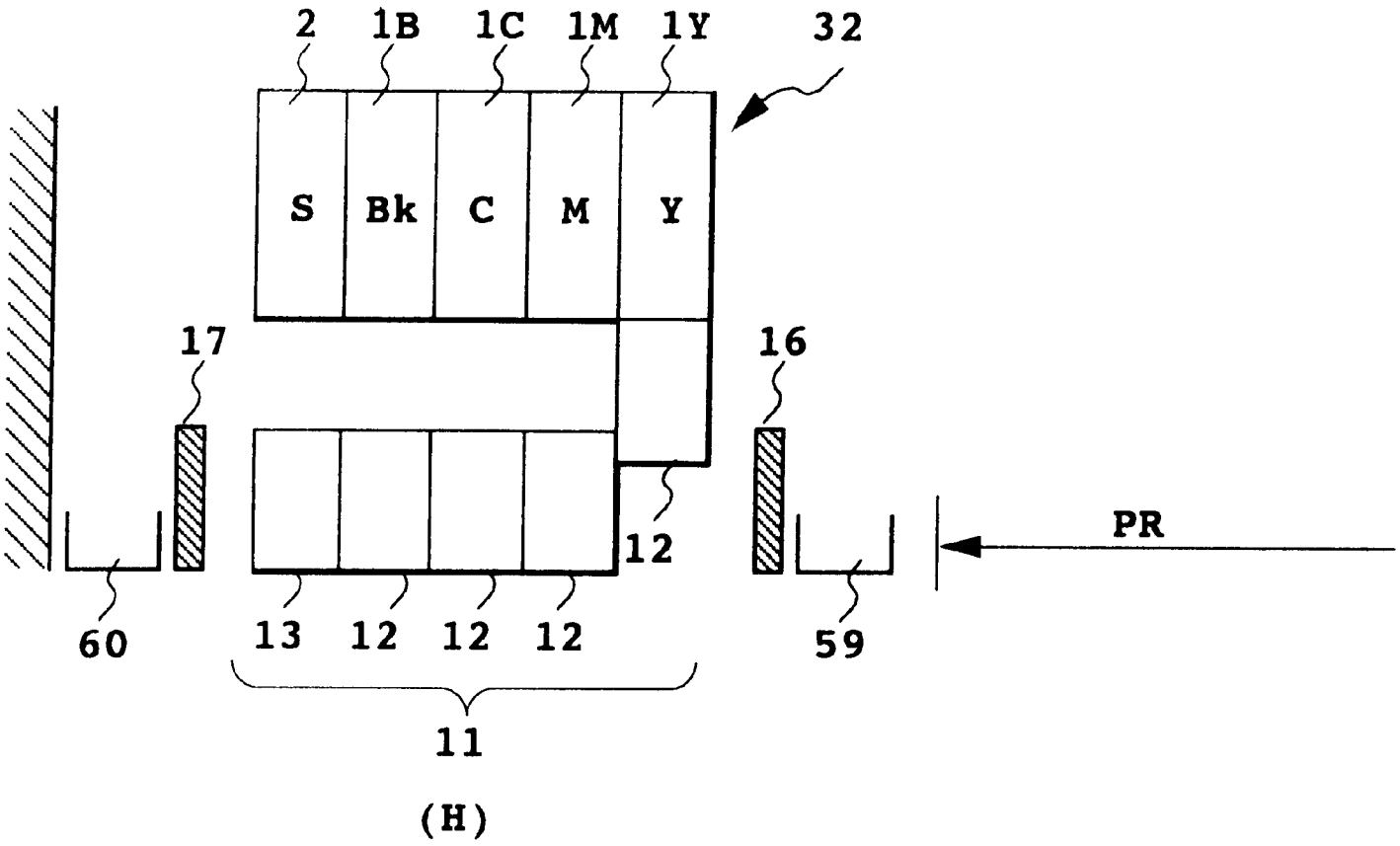
FIG. 33 is a schematic front view illustrating the capping action of the ink jet printing apparatus shown in FIGS. 27 to 30.
Figure 34:
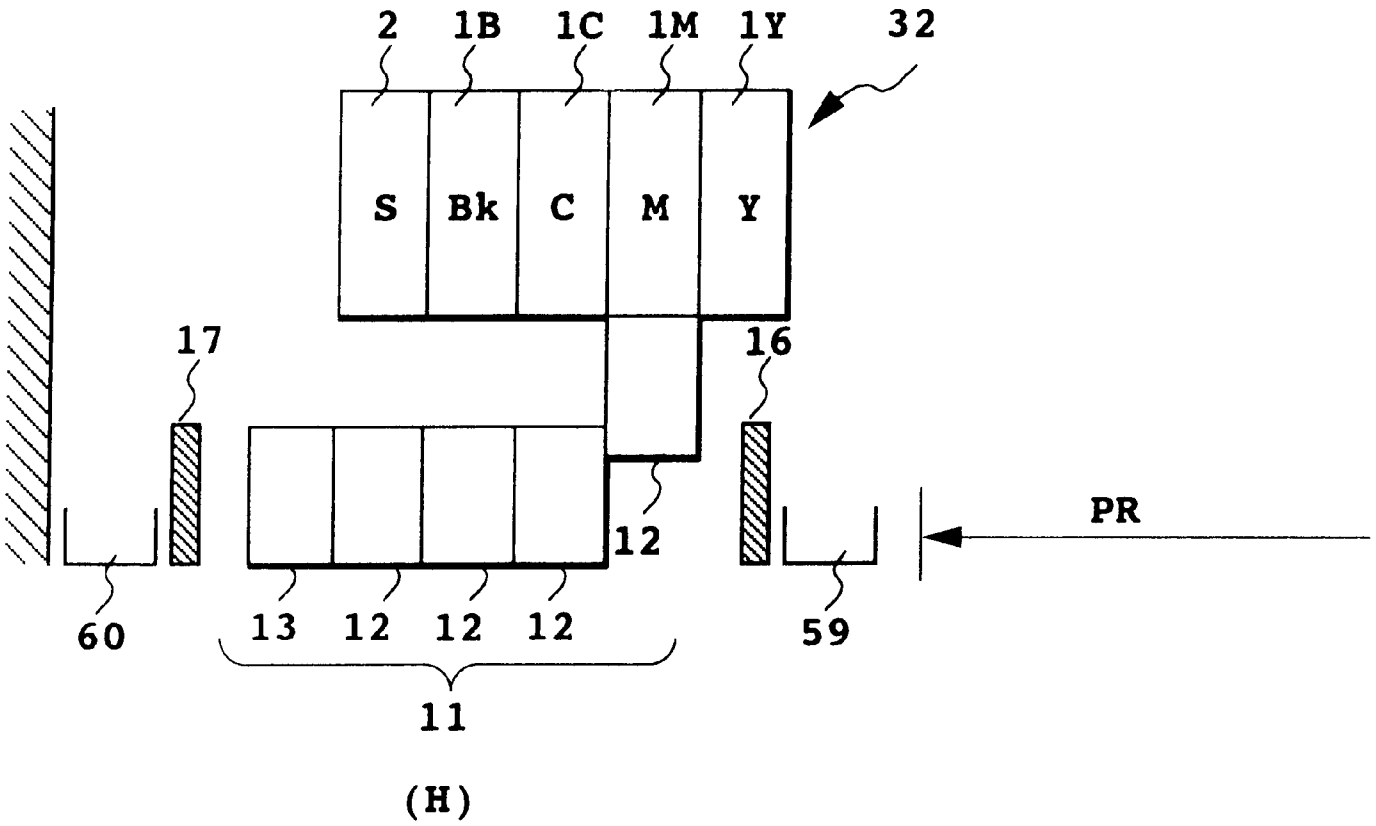
FIG. 34 is a schematic front view illustrating the capping action of the ink jet printing apparatus shown in FIGS. 27 to 30.
Figure 35:
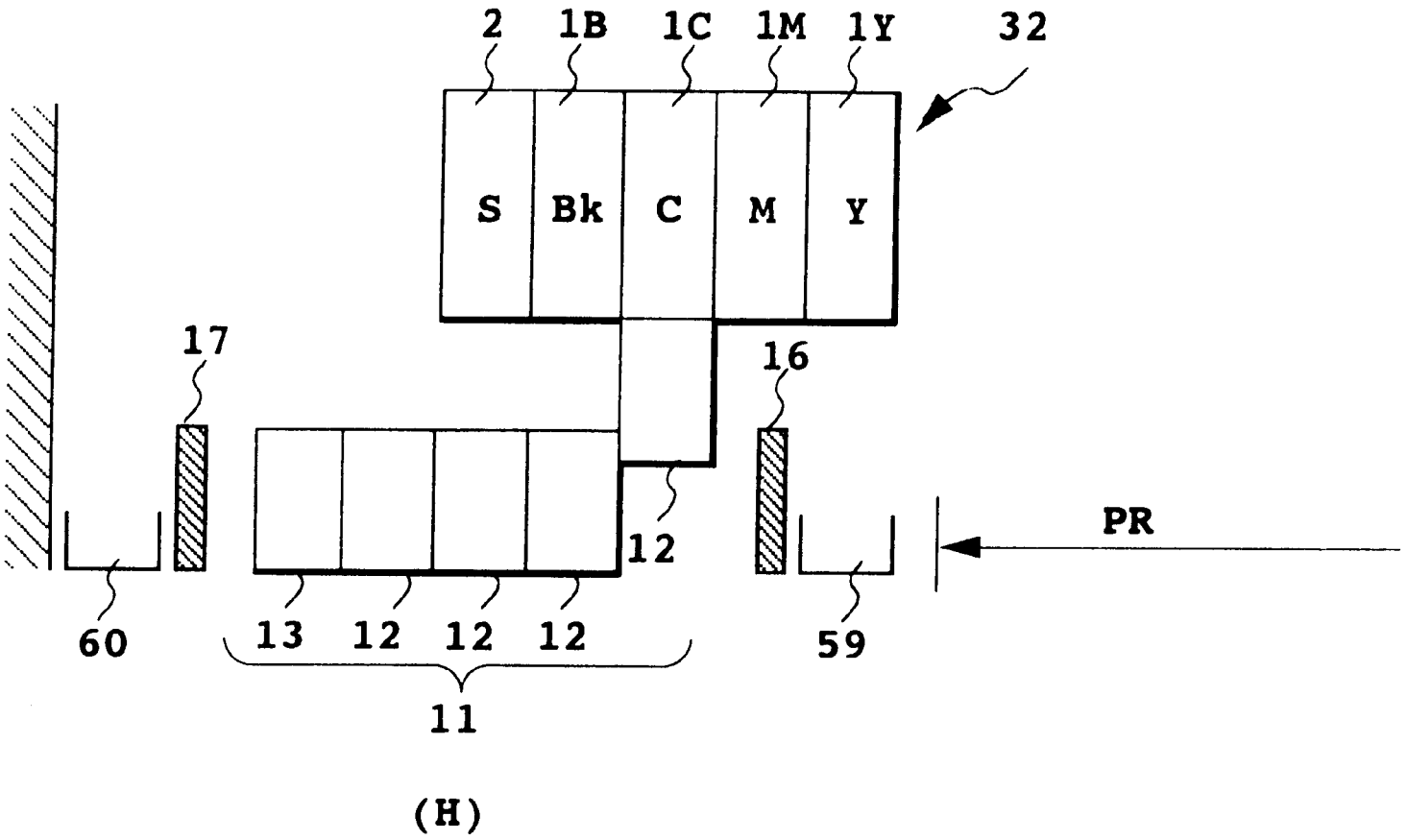
FIG. 35 is a schematic front view illustrating the capping action of the ink jet printing apparatus shown in FIGS. 27 to 30.
Figure 36:
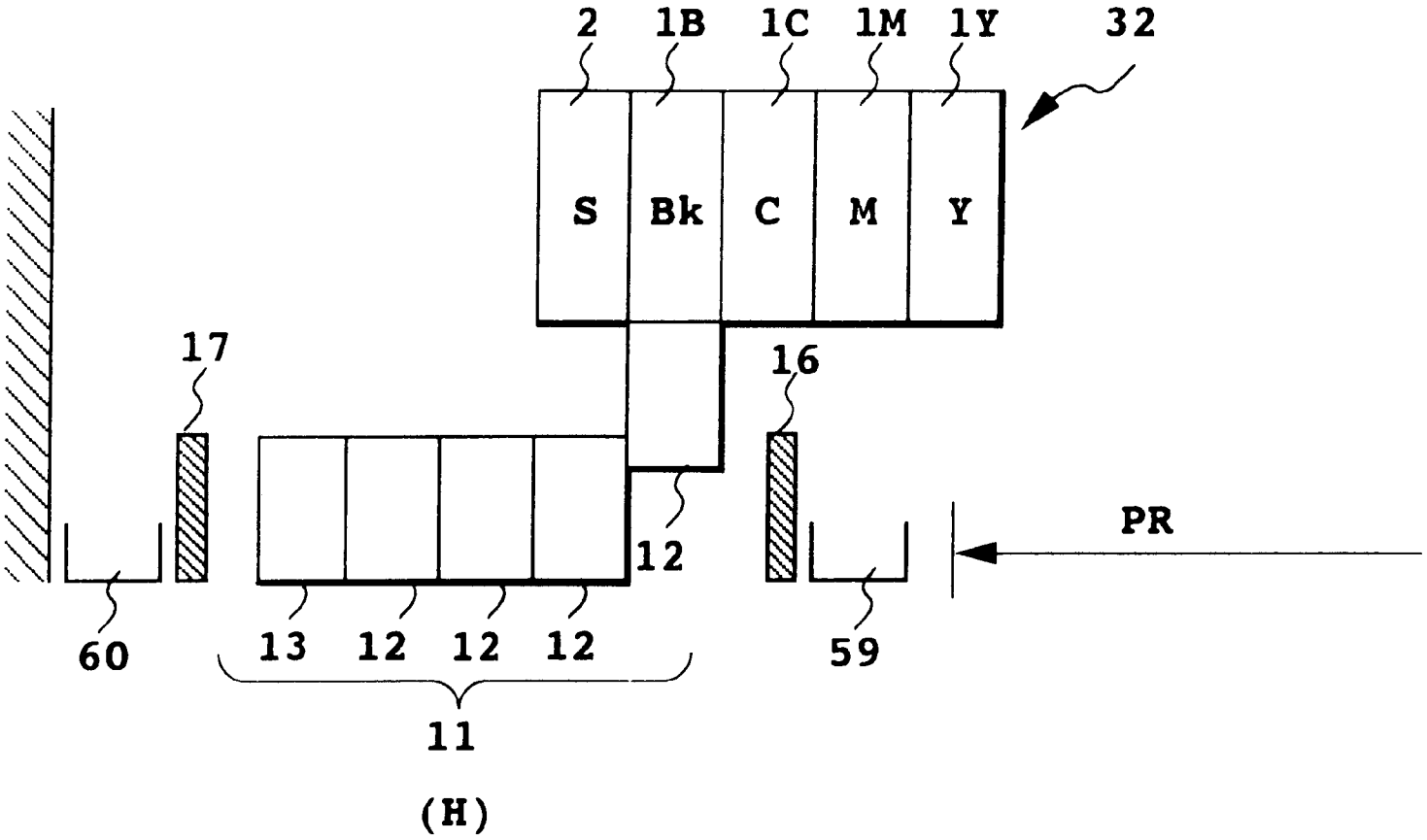
FIG. 36 is a schematic front view illustrating the capping action of the ink jet printing apparatus shown in FIGS. 27 to 30.
Figure 37:
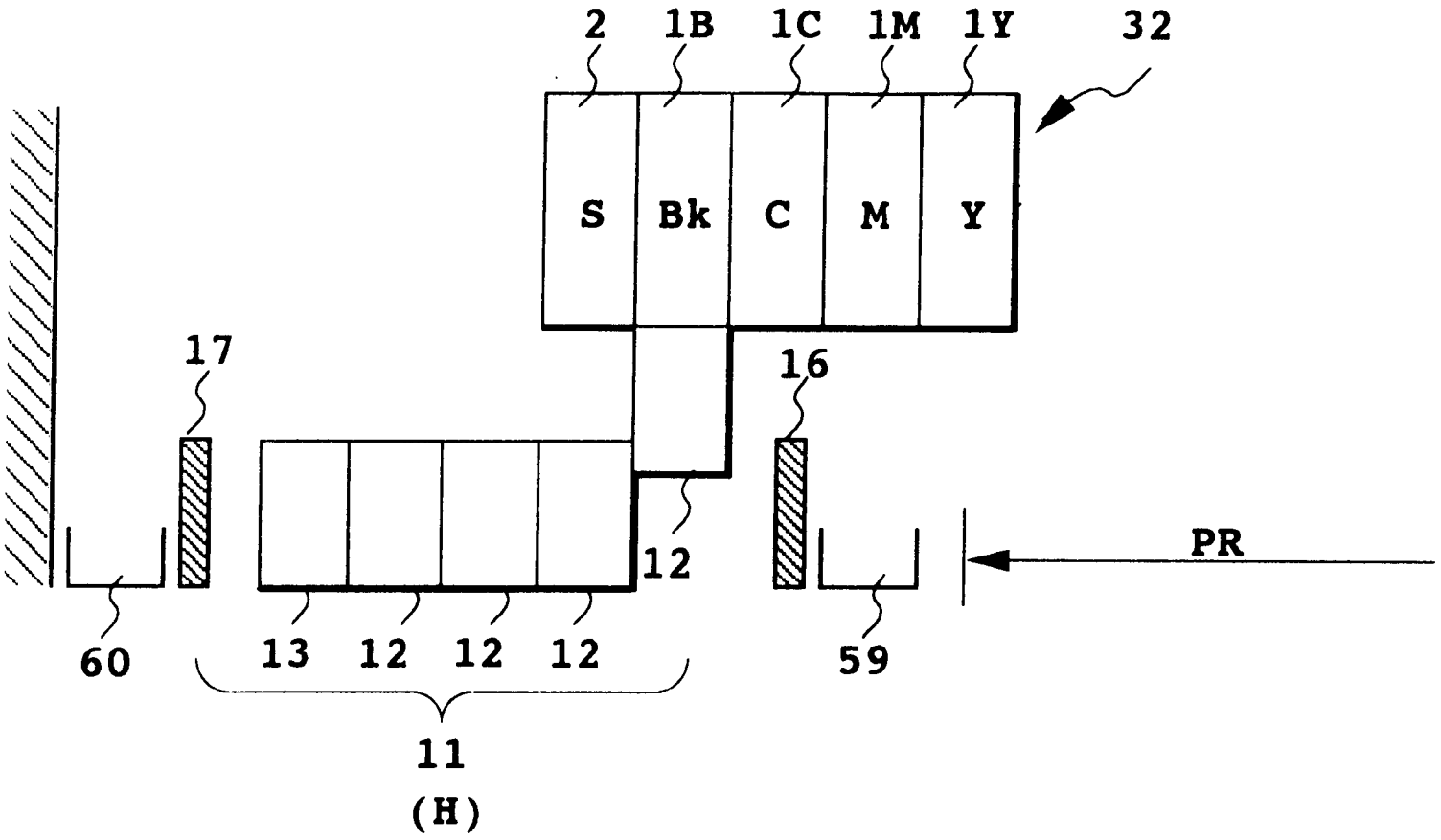
FIG. 37 is a schematic front view illustrating the capping action of the ink jet printing apparatus shown in FIGS. 27 to 30.

FIG. 31 is a schematic front view illustrating the non-suction capping state of the ink jet printing apparatus. FIG. 32 is a schematic front view illustrating the retracted state of a cap of the ink jet printing apparatus shown in FIGS. 27 to 30. FIG. 33 is a schematic front view illustrating the state in which the printability improving liquid is sucked. FIGS. 34 to 37 are each a schematic front view illustrating the state in which color ink is sucked. In FIG. 30, cap levers 48 and 49 are rotatably supported on the base 47 of the recovering unit 11. The caps 12 for capping the ink ejectors and the cap 13 for capping the printability improving liquid S are supported by the cap levers 48 and 49 through cap holders 45 and 46. Portions of the cap levers 48 and 49 move slidably along cam surface 51 of a suction cam 50 and rock upward and downward to thereby move the caps 12 and 13 upward and downward.

In order to prevent mixing of the printability improving liquid with the printing inks in the vicinity of the ejecting port planes of the printability improving liquid ejector 2 and color ink ejectors 1B, 1C, 1M, and 1Y in the head unit 32 by capping, the angle of rotation of the suction cam 50 is controlled so as to move the caps 12 and 13 upward and downward independently of each other so that upon suction and recovery of he printability improving liquid ejector 2, only the cap 13 for the printability improving liquid contacts the head unit 32 while upon suction and recovery of the color ink ejectors 1B, 1C, 1M, and 1Y, only the caps 12 for color inks contact the head unit 32.

When the head unit 32 is located at the home position (H), all the caps 12 and 13 contact all the ejectors 2, 1B, 1C, 1M, and 1Y to cap them, thus preventing the occurrence of an ejection failure due to an increase in viscosity or setting of the liquid resulting from the evaporation of the printability improving liquid or ink in the ejecting ports of each ejector.

In the recovering unit 11, the cap 13 for the printability improving liquid and the cap 12 for yellow ink communicate with tubing 53 and 54 of a pump unit 52 through the respective cap holders 46 and 45. The pump unit 52 is used for generating a negative pressure suction force in order to connect each of the caps 12 and 13 to the corresponding ejector upon a suction recovering treatment in which liquids are sucked form the ejecting ports in case the head unit 32 undergoes ejection failure. As the pump unit 52, there is used a tube pump which generates a sucking force by stroking the tube thereof.

The tube pump 52 includes tubes 53 and 54, a roller holder 55, and a roller 56 held by the roller holder 55. The roller holder 55 is supported rotatably on the base 47 of the recovering unit 11. A negative pressure is generated by pressing down the tubes 53 and 54 guided by the roller holder 55 with the roller 56 supported by the roller holder 55.

The pump unit (tube pump) 52 has the tube 53 exclusively used for the printability improving liquid and the tube 54 exclusively used for inks. Waste liquid are transported in separate passages independently of each other to a waste liquid tank. This is to prevent the occurrence of insolubilization and/or agglomeration of the coloring material in the ink upon contact of the printing ink with the printability improving liquid in the pump 52. Here, an example is taken in which the pump unit 52 has two passages one for the printability improving liquid and the other for printing inks. However, each cap may be provided with a separate pump.

The recovering unit 11 further includes a blade 17 for wiping the ejecting port plane of the printability improving liquid ejector 2 and a blade 16 for wiping the ejecting port planes of the color ink ejectors 1B, 1C, 1M, and 1Y for ejecting different colors, respectively, in the head unit 32. The blade 17 for the printability improving liquid is on the left side of the base 47 of the recovering unit 11 and the blade 17 for the inks is on the right side of the base 47 without being adjacent to each other.

The blades 16 and 17 are provided in order to wipe off and remote the ink or printability improving liquid or foreign matter adhering to the ink ejectors and the printability improving liquid ejector in the head unit 32 and the blades are made of an elastic member such as rubber. The blades 16 and 17 are attached to blade arms 57 and 58 rotatably supported by the base 47 of the recovering unit 11. Portions of the blade arms 57 and 58 slidably move along the cam surface (not shown) of the suction cam 50, which makes the blades movable upwards and downwards so that each of the blades 16 and 17 can take a projected (elevated) position for wiping the ejecting port plane of each head and a retracted (lowered) position remote from the ejecting port plane for waiting.

In order to prevent mixing of the color inks with the printability improving liquid in the vicinity of the ejecting port plane of each liquid ejector in the head unit 32 by wiping, there are provided separately the blade 17 for wiping the liquid ejector 2 and the blade 16 for wiping the color ink ejectors 1B, 1C, 1M, and 1Y. The blades are movable independently of each other, and also project and retract (move upward and downward) independently of each other.

Figure 38A:
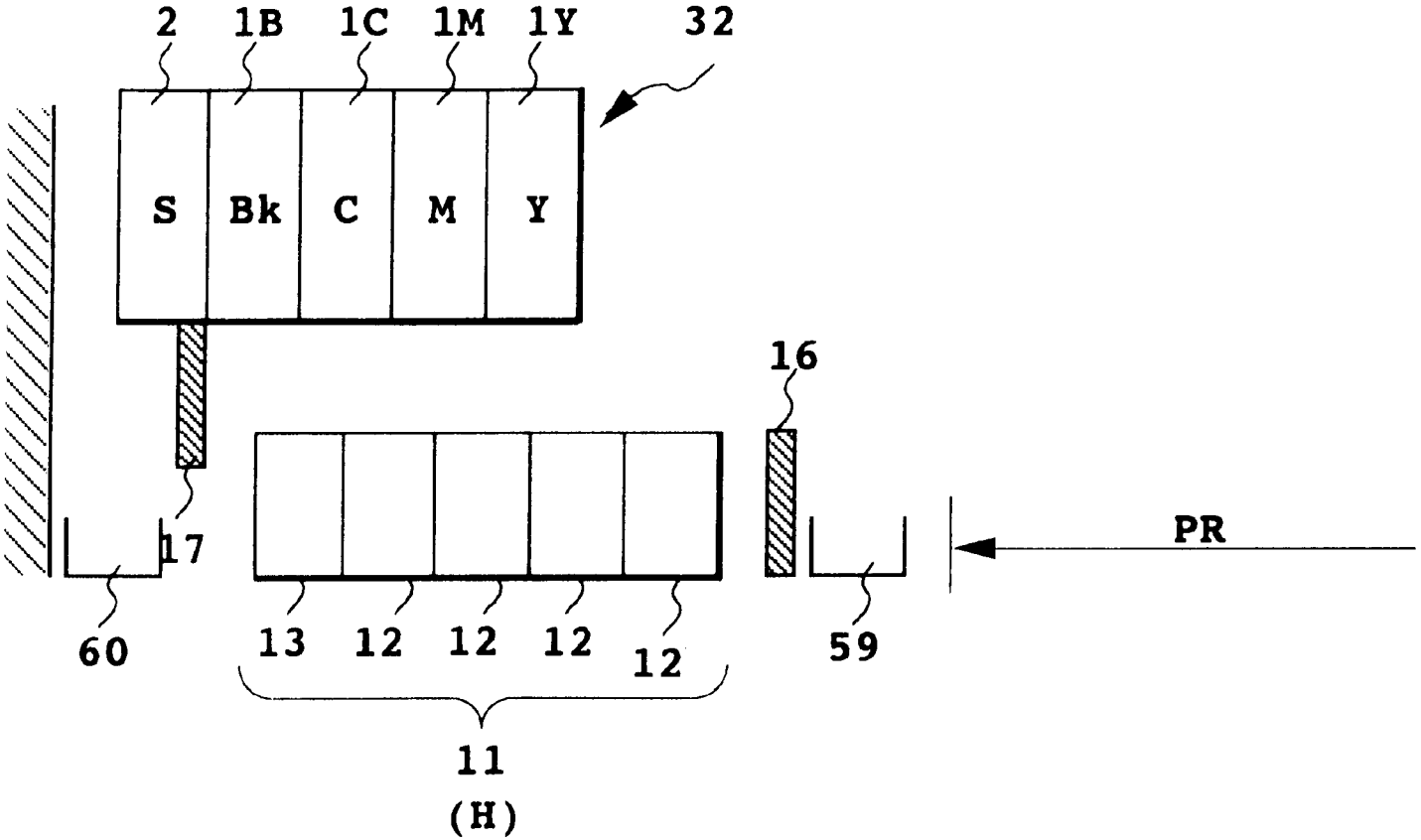
FIGS. 38A and 38B are each a schematic front view illustrating the wiping action of the ink jet printing apparatus shown in FIGS. 27 to 30.
Figure 38B:
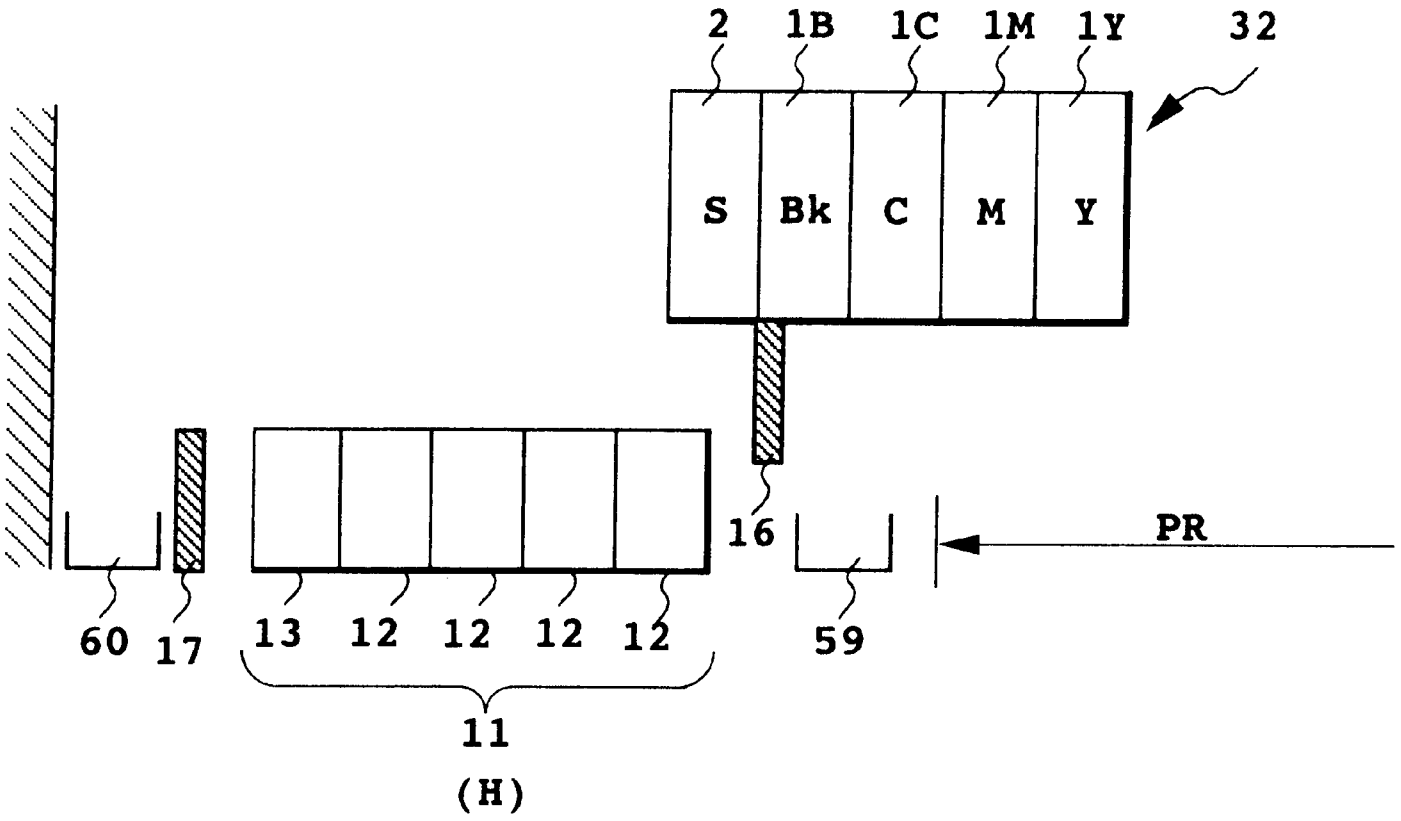

The ejection portions of the head unit 32 is carried out by moving the head unit 32 along the ejecting port planes thereof with the corresponding blades elevated. FIGS. 38A and 38B are each a schematic front view illustrating the wiping action of the ink jet printing apparatus shown in FIGS. 27 to 30. FIG. 38A shows the state in which the printability improving liquid ejector S which ejects a printability improving liquid is wiped while FIG. 38B shows the state in which the color ink ejectors 1B, 1C, 1M, and 1Y are wiped. Here, the blade 17 for the printability improving liquid is arranged on the left side of the base 47 of the recovering unit 11 while the blade 16 for the color inks is arranged on the right side (printing region side) of the base 47 of the recovering unit 11. The arrangement of the blades 16 and 17 may be reversed. However, the arrangement in this example is preferred in view of down sizing of the apparatus since the amount of movement of the head unit 32 to the left side of the recovering unit 11 can be reduced to prevent enlargement of the width of the apparatus.

In this example, in order to prevent mixing of a color ink with a printability improving liquid to cause insolubilization and/or agglomeration in the vicinity of a liquid receiver by preliminary ejection, there are provided separately and independently of each other a liquid receiver 59 for exclusive use for a color ink and a liquid receiver 60 for exclusive use for the printability improving liquid on both sides of the recovering unit 11 at a distance as shown in FIG. 32. Further, the color inks and the printability improving liquid discharged from the pump 52 are recovered in a waste ink tank 61 (FIG. 27).

EXAMPLE 10

Figure 39A:
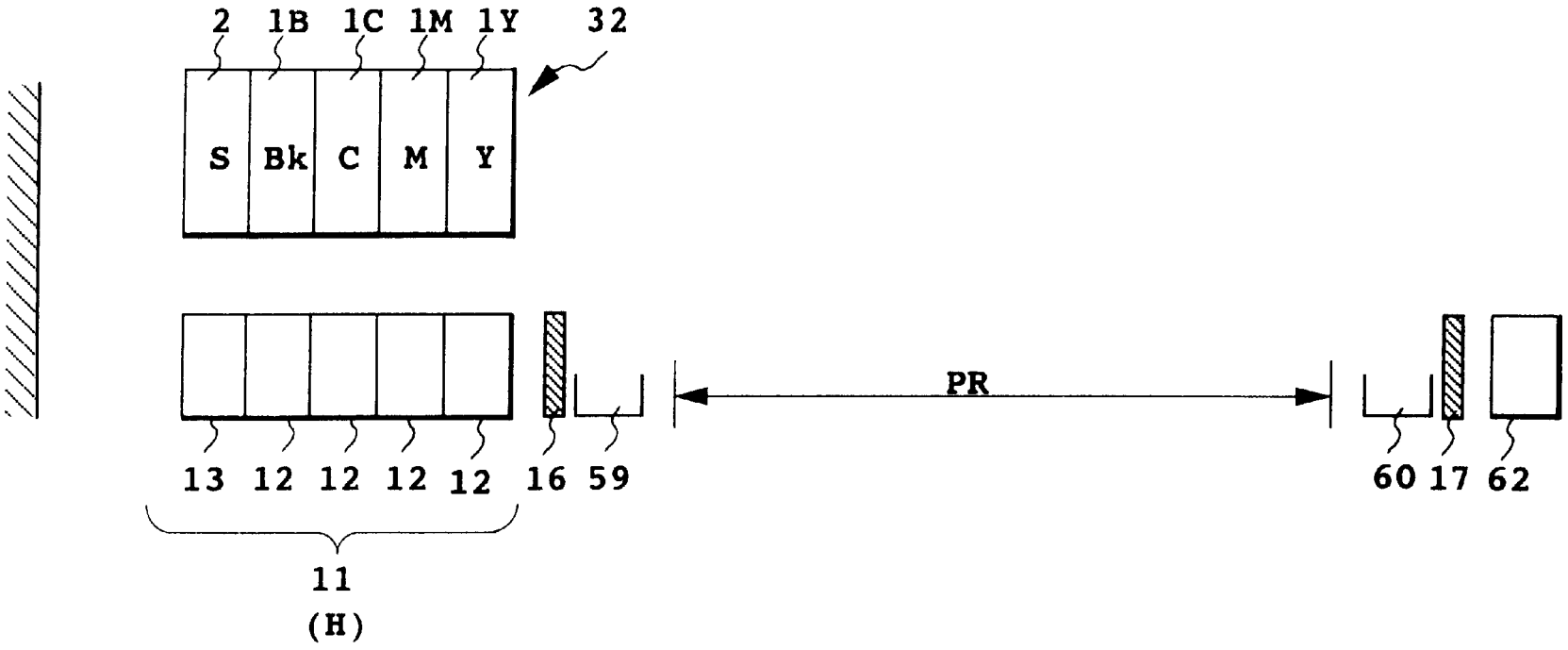
FIGS. 39A and 39B are each a schematic front view illustrating the capping action of an ink jet printing apparatus according to a tenth example of the present invention.
Figure 39B:
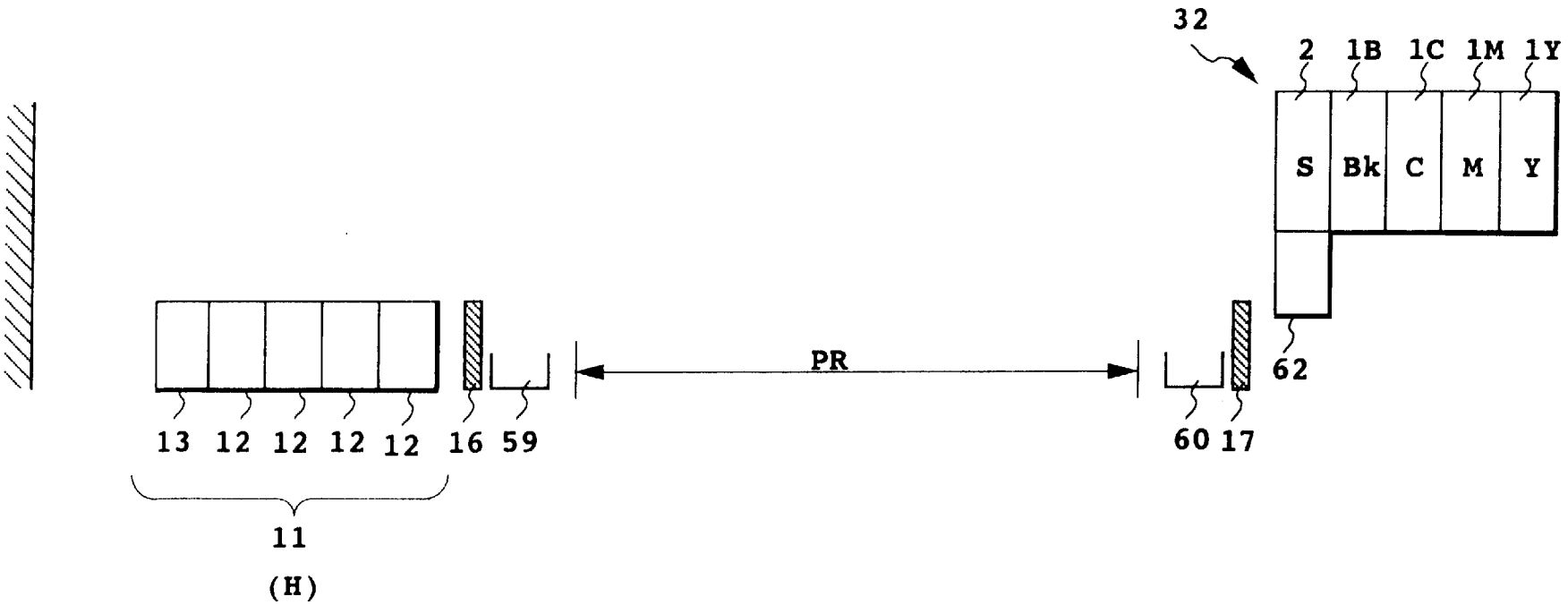
Figure 40A:
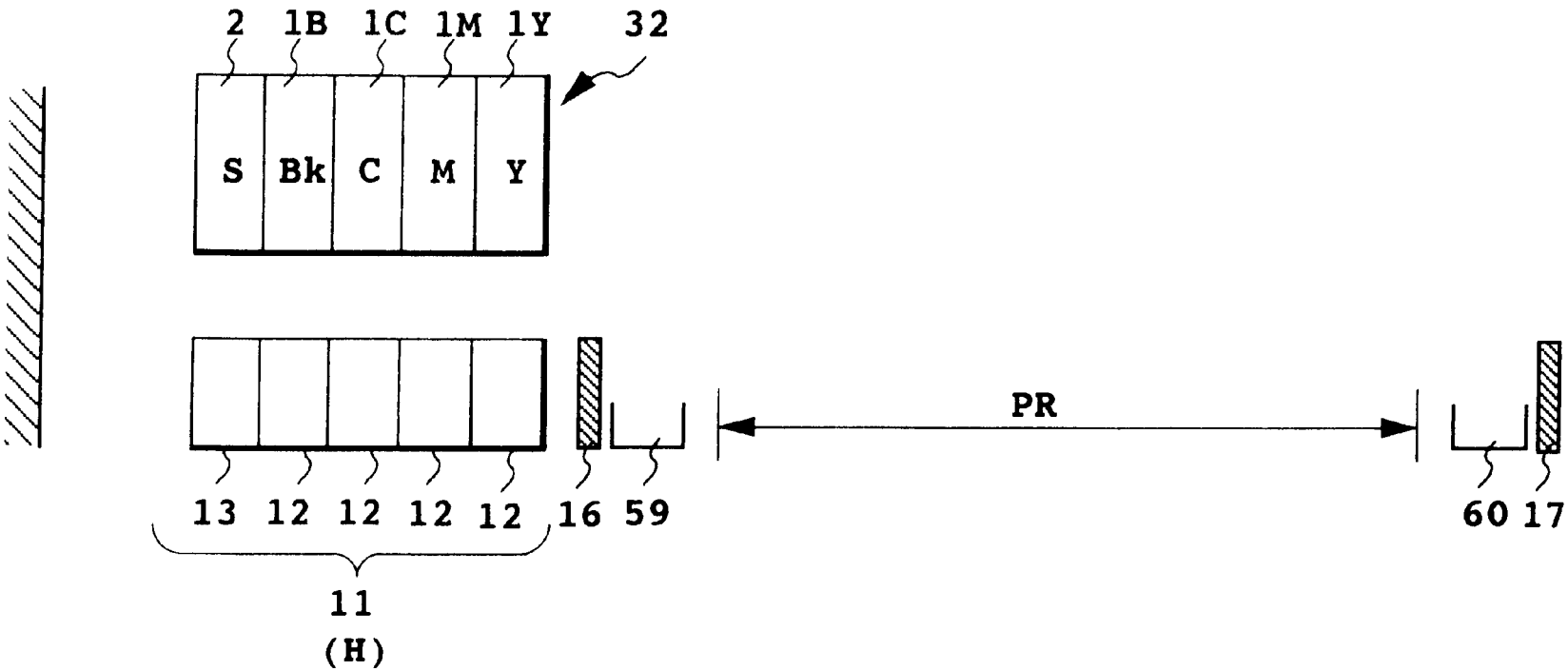
FIGS. 40A and 40B are each a schematic front view illustrating the wiping action of the ink jet printing apparatus shown in FIGS. 39A and 39B.
Figure 40B:
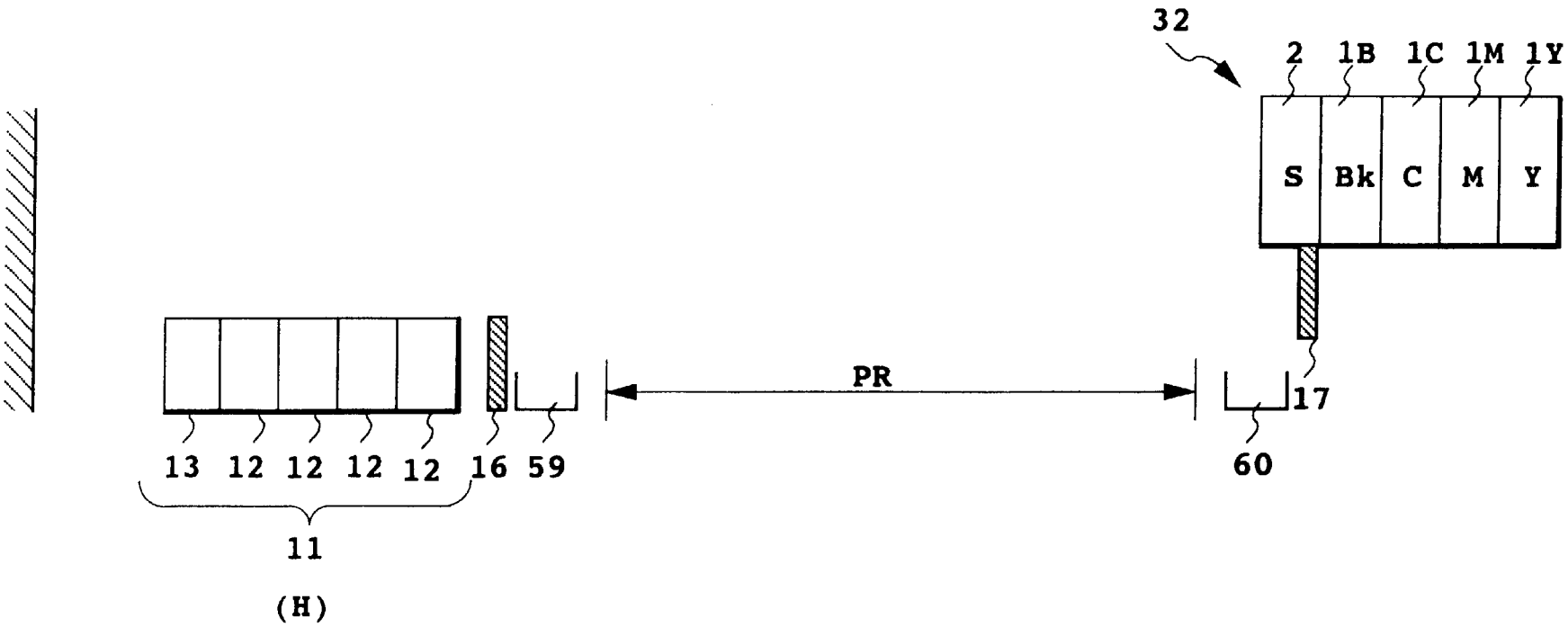

FIGS. 39A and 39B are each a schematic front view illustrating the capping action of an ink jet printing apparatus according to a tenth example of the present invention. FIGS. 40A and 40B are each a schematic front view illustrating the wiping action of the ink jet printing apparatus shown in FIGS. 39A and 39B, respectively. In FIGS. 39A and 39B and 40A and 40B, the same or equivalent parts as the preceding examples are indicated by the same reference numeral. The feature of the arrangement according to this example is that suction, wiping and preliminary ejection of the printability improving liquid ejector 2 can be performed at a position outside the printing region on the side opposite to the home position. That is, the recovering unit for the color inks and the recovering unit for the printability improving liquid are arranged on both sides of the printing apparatus as intervened by the printing region. FIGS. 39A and 39B show the action of sucking the printability improving liquid from the printability improving liquid ejector S while FIGS. 40A and 40B show the action of wiping the ejecting port plane of the printability improving liquid ejector 2. The suction cap 62 for the printability improving liquid ejector S is arranged for exclusive use for suction, and on the home position side there is provided the non-suction cap 13 for the printability improving liquid ejector 2 for exclusive use.

EXAMPLE 11

Figure 41A:
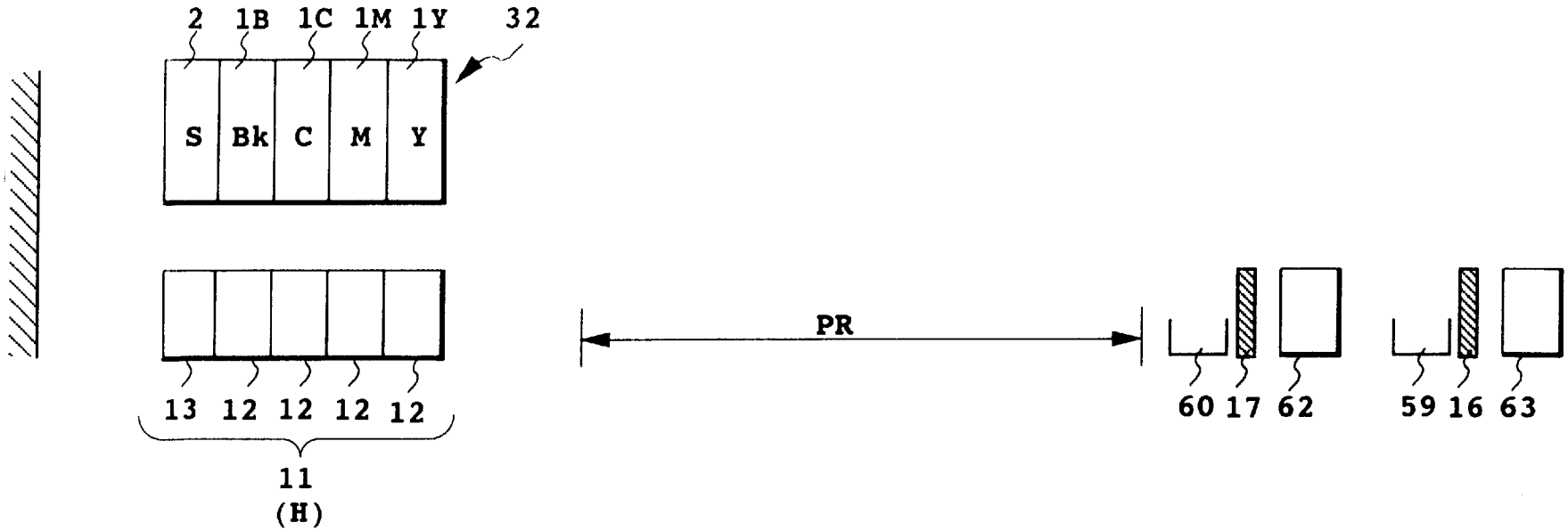
FIGS. 41A and 41B are each a schematic front view illustrating the capping action of an ink jet printing apparatus according to an eleventh example of the present invention.
Figure 41B:
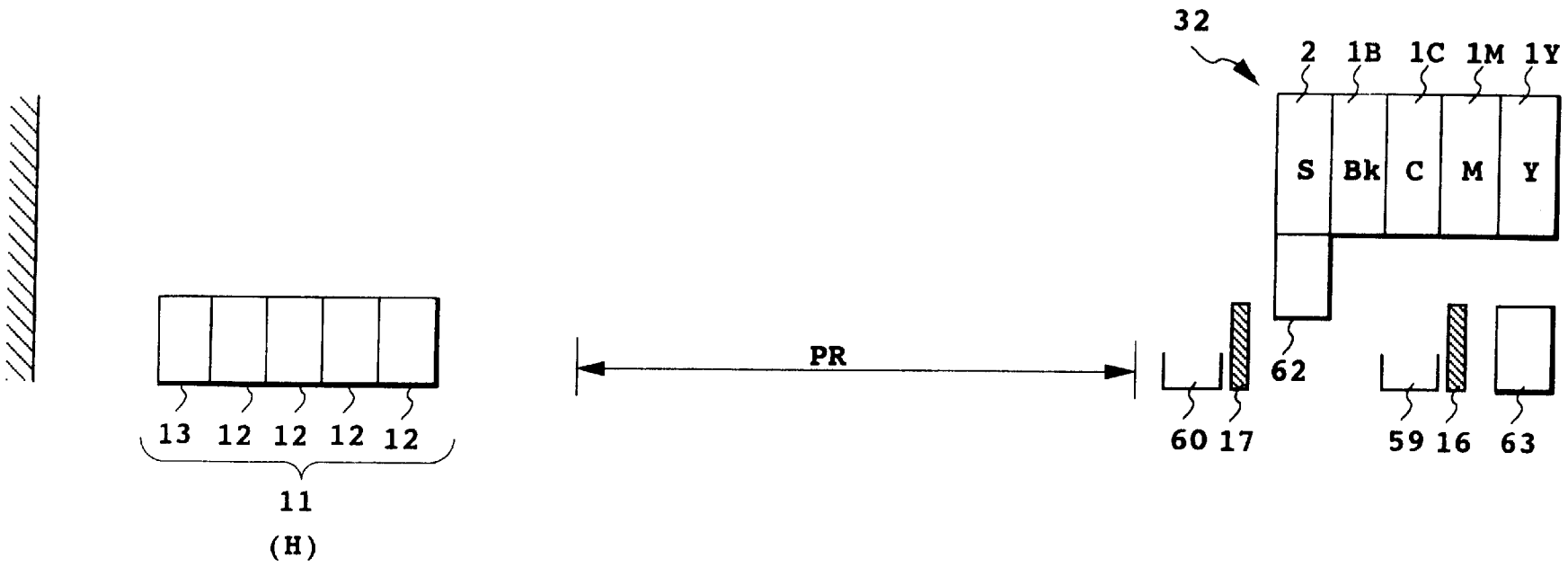

FIGS. 41A and 41B are each a schematic front view illustrating the capping action of an ink jet printing apparatus according to an eleventh example of the present invention. This example is featured that there are arranged non-suction caps 12 and 13 for exclusive use corresponding to the respective ejectors of the head unit 32 on the home position (H) side (the left side) of the printing apparatus and a recovering unit for the printability improving liquid ejector 2 and a recovering unit for the color ink ejectors outside the printing region (PR) on the side opposite to the home position (H). The recovering unit for the printability improving liquid ejector 2 includes a cap 62 for exclusive use for suction, a blade 17, and a liquid receiver 60 while the recovering unit for the color ink ejectors includes a cap 63 for exclusive use for a suction, a blade 16 and a liquid receiver 59. With the arrangement of this example, a suction, wiping and preliminary ejection of the printability improving liquid and color inks can be performed outside the printing region on the side opposite to the home position (H).

According to the examples shown in FIGS. 27 to 41B, the ink jet printing apparatus which ejects inks and a printability improving liquid on a printing material is constructed such that the inks and the printability improving liquid do not contact with each other in the recovering unit and, hence, water resistance of images is high, there occurs no bleeding at the boundary between different color regions in the image and the occurrence of insolubilization and/or agglomeration of the coloring material such as dye in the ink in the printing apparatus can be prevented, thus providing an ink jet printing apparatus having a high reliability in recovering treatment.

EXAMPLE 12

Figure 42:
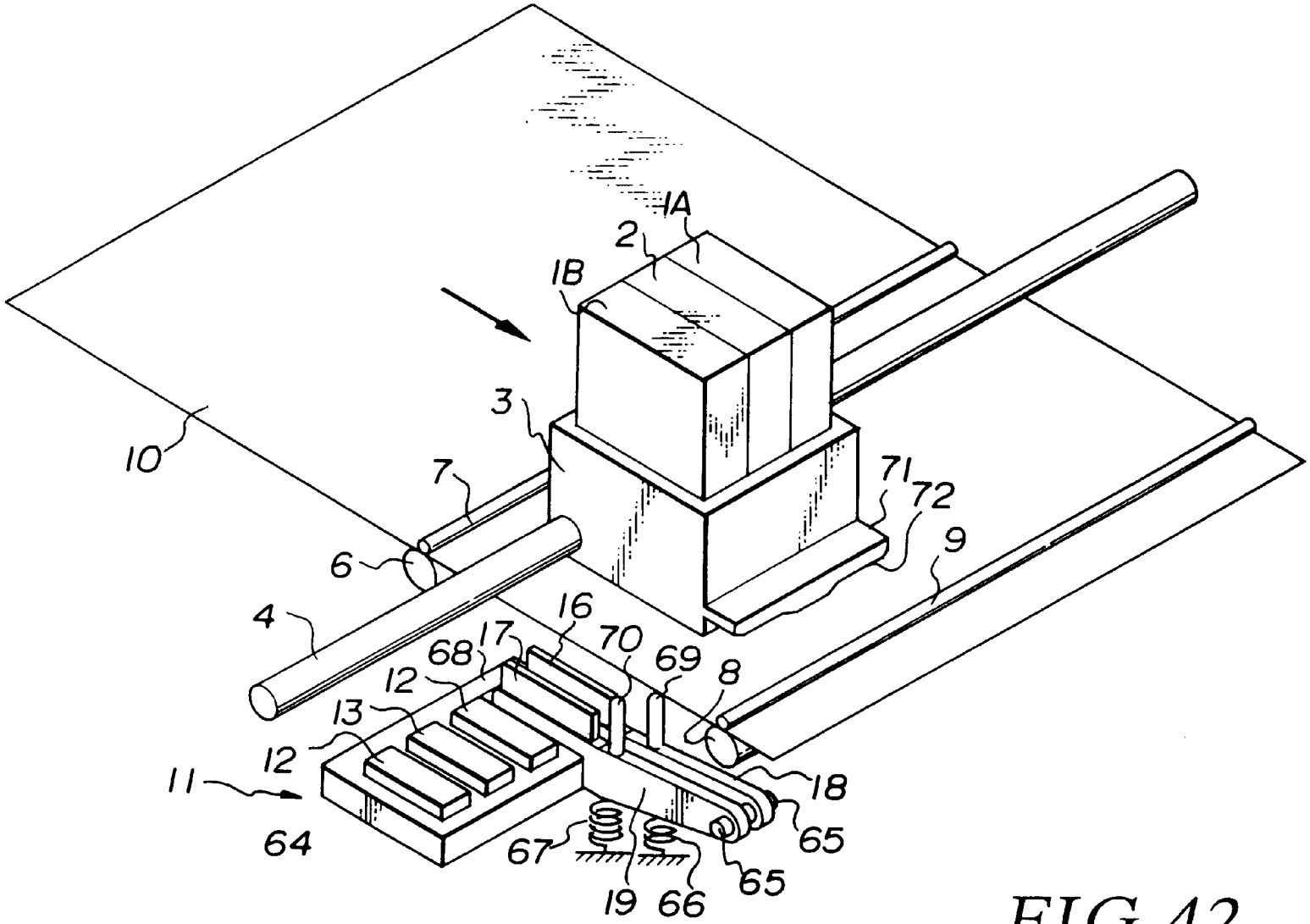
FIG. 42 is a schematic perspective view showing a main part of an ink jet printing apparatus according to a twelfth example of the present invention.

FIG. 42 is a schematic perspective view showing a main part of an ink jet printing apparatus according to a twelfth example of the present invention. As shown in FIG. 42, there are mounted on a carriage 3 guided and supported by a guide shaft (scanning rail) 4 reciprocatingly movable therealong three heads 1A, 2, and 1B. The head cartridge 1A on the right end contains three color inks, yellow Y, magenta M, and cyan C, and ejects them therefrom for printing. The central cartridge 2 contains a printability improving liquid and ejects it therefrom. The head cartridge 1B at the left end contains black ink and ejects it therefrom for printing.

The cartridges 1A and 1B have each an ink tank portion 21 for storing an ink on its upper part and an ink ejector (printing portion) 22 (FIG. 5) for ejecting the ink on its lower part. The cartridge 2 for the printability improving liquid has a printability improving liquid tank portion 21S (FIG. 5) for storing a printability improving liquid on its upper part and a printability improving liquid ejector 22S (FIG. 5) for ejecting the printability improving liquid. To the cartridges 1A, 2, and 1B is connected a connector 23 for receiving driving signals for driving them. The carriage 3 is provided with a connector holder for transmitting signals for driving the printing heads 1 (1A, 1B) and the printability improving liquid ejecting head 2 so that it is electrically connected to the heads 1 and 2. The printability improving liquid ejected from the printability improving liquid ejecting head 2 is to insolubilize and/or agglomerate the coloring materials such as dyes in the inks.

In FIG. 42, the guide shaft 4 extends in the direction of main scanning of the carriage 3 supported thereon. A pair of conveying rolls 6 and 7 and another pair of conveying rolls 8 and 9 are arranged before and after the printing position where printing is performed by the printing heads and clamp therebetween a printing material 10 for conveying. The printing material 10 such as paper, at its portion in the printing region, is guided as pressed against a platen (not shown) for controlling the printing surface of the printing material to be flat. At this moment, the ejecting port plane of each of the cartridges (heads) 1 and 2 mounted on the carriage 3 projects downward from the carriage 3 and located between the rolls 7 and 9 so that it faces the printing material 10 in parallel thereto.

The ink jet printing apparatus according to this example is provided with a recovering unit 11 for maintaining and recovering the performance of ejection of each of the cartridge 1 and 2 outside the printing region on the left side, i.e., on the home position side. The recovering unit 11 includes three caps 12, 13, and 12 arranged corresponding to the three heads 1A, 2, and 1B. These caps are attached in a cap unit 64 which is movable in the direction toward and away from the ejecting port plane (up and down). When the carriage 3 is at the home position (H), the caps 12 and 13 are pressed against the ejecting port plane of each of the heads 1 and 2 so that the ejector of the head is capped. This capping prevents an increase in viscosity of ink or printability improving liquid due to the evaporation of the solvent in the ejecting ports of the heads 1 and 2, thus preventing an ejection failure from occurring.

The recovering unit 11 also includes a suction pump 14 (FIG. 4) communicating with each caps 12 and a suction pump 15 (FIG. 4) communicating with the cap 13. The suction pumps 14 and 15 cap the ejecting port planes of the printing heads 1 (1A and 1B) or the printability improving liquid ejecting head 2 and perform suction for recovering in case where ejection failure occurs in one or more of the heads. The ink and printability improving liquid sucked by the suction and recovering action are transported from the suction pumps 14 and 15 to a waste ink tank through a tube (not shown) and absorbed by an absorbing substrate contained in the tank.

The recovering unit 11 includes wiping means for cleaning the ejecting port planes of the heads 1 and 2. Next, explanation will be made of the wiping means. The body of the printing apparatus are provided with, among other, a cap unit 64, blades 16 and 17, and a blade stroke controlling member 68 for controlling the stroke of the blades. On the right side of the base (not shown) of the recovering unit 11 are arranged the blade 17 for the printability improving liquid ejecting head 2 and the blade 16 for the printing heads 1A and 1B side by side. The blades 17 and 16 are held by a blade holder 19 for the printability improving liquid and a blade holder 18 for the inks.

The two blade holders 19 and 18 are capable of rotation around a rocking lever shaft 65 independently of each other and urged toward the head by springs 67 and 66, respectively. The strokes of the blade holders 19 and 18 in the direction of urging are controlled by the stroke controlling member 68. In this manner, the two blade arrangement according to this example is obtained.

The blade holders 18 and 19 are provided with striking portions 69 and 70, respectively, for controlling the amount of invasion (overlap) of the blade 16 or 17 into the ejecting port plane of the head 1 or 2. By contact of the striking portions 69 and 70 with position controlling cam surfaces 71 and 72 (FIG. 43), the amount of invasion of the blades 16 and 17 into the ejecting port planes can be controlled and the blades 16 and 17 are driven for their projection and retraction (up and down movement).

FIGS. 43 to 48 are each a schematic front view illustrating the wiping action of the ink jet printing apparatus shown in FIG. 42, illustrating details of the position controlling cam surfaces 71 and 72 of the carriage 3. In FIGS. 43 to 48, the striking portion 69 of the blade holder 18 for inks (for printing heads) contacts the cam surface 71 while the striking portion 70 of the blade holder 19 contacts the cam surface 72 and as a result the amount of invasion of the blade 17 for the inks and the blade 17 for the printability improving liquid can be controlled and the blades 16 and 17 can be retracted from the ejecting port plane of the head. More specifically, The both ends 71A of the cam surface 71 and an intermediate portion 72B of the cam surface 72 serve to control the amount of invasion of the blades 16 and 17 while the intermediate portion 71B of the surface 71 and the both ends 72A of the cam surface 72A serve to retract the blades 16 and 17.

Figure 43:
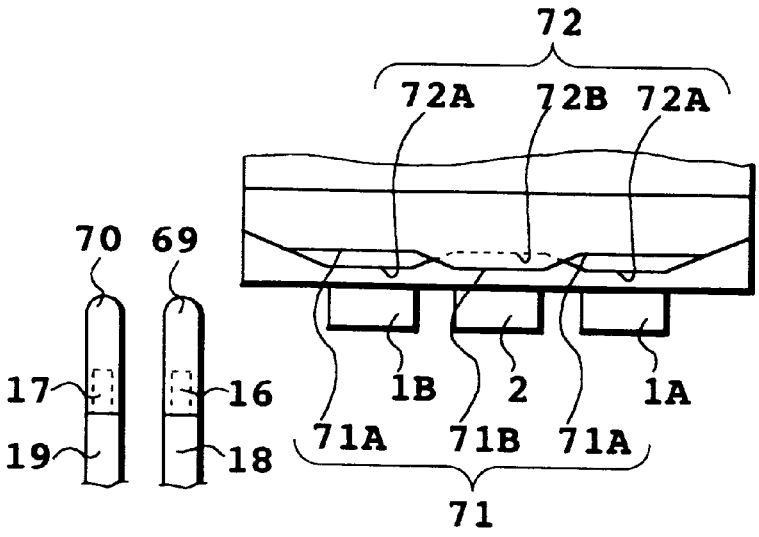
FIG. 43 is a schematic front view illustrating the wiping action of the ink jet printing apparatus shown in FIG. 42.

Next, explanation will be made of the wiping actions of the heads 1A, 2, and 1B with reference to FIGS. 43 to 48. FIG. 43 shows the state of a non-wiping (a fully retracted state). At this moment, the blade holders 18 and 19 are lowered to positions in which their striking portions 69 and 70 do not interfere at all with the cam surfaces 71 and 72 on the part of the head. The carriage 3 can scan till the position just above the recovering unit 1 without any interference with the heads 1 and 2 and the blades 16 and 17, so that the width of the body of the apparatus can be made smaller. Also, there is no contact with the portions 69 and 70 unless required specifically, and, hence, a high durability can be obtained.

Figure 44:
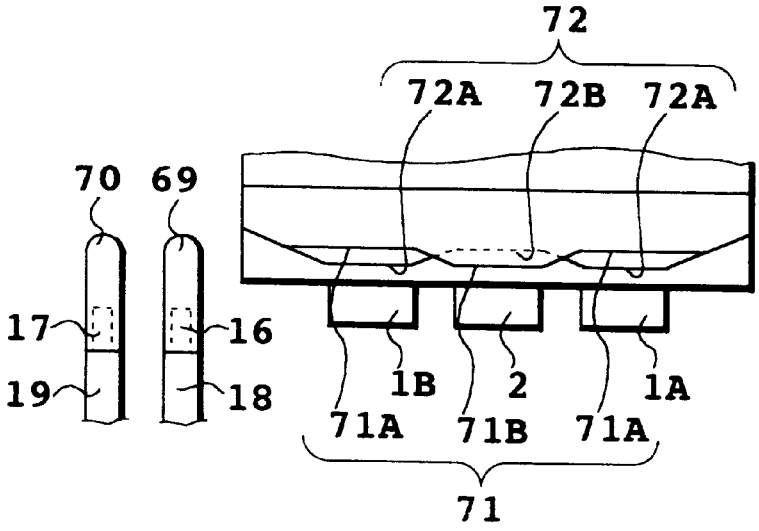
FIG. 44 is a schematic front view illustrating the wiping action of the ink jet printing apparatus shown in FIG. 42.
Figure 45:
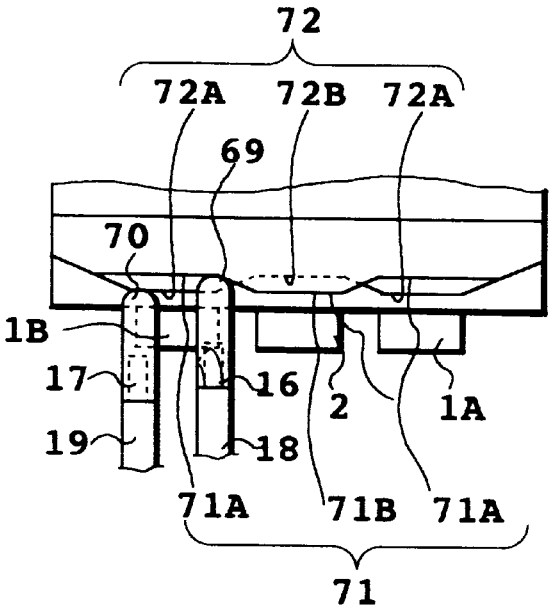
FIG. 45 is a schematic front view illustrating the wiping action of the ink jet printing apparatus shown in FIG. 42.

FIG. 44 shows the state in which the carriage 3 comes on the immediately right side of the blades 16 and 17. At this moment, the blade 16 and 17 are elevated to an upper limit position (within the range in which an inclined surface for retraction can function) by the stroke controlling means 68. FIG. 45 shows the state in which the blade 16 wipes the first head (printing head) 1B, i.e., the head at the left end. At this moment, the striking portion 69 for ink blade contacts the cam surface 71 while the striking portion 70 for the printability improving liquid blade contacts the cam surface 72A to retract the blade 17.

Figure 46:
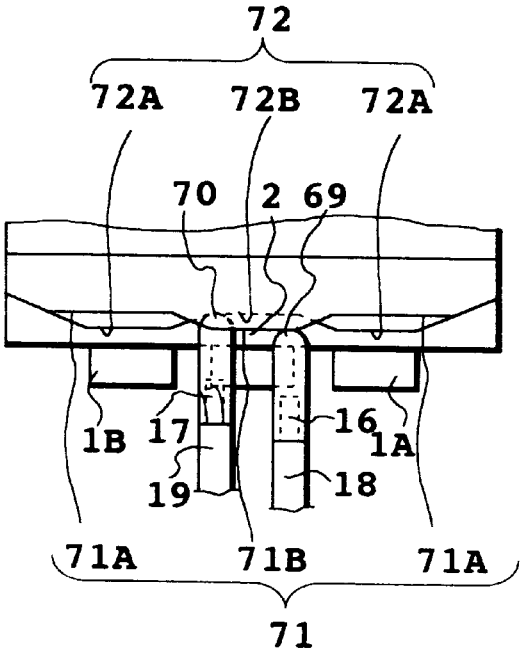
FIG. 46 is a schematic front view illustrating the wiping action of the ink jet printing apparatus shown in FIG. 42.
Figure 47:
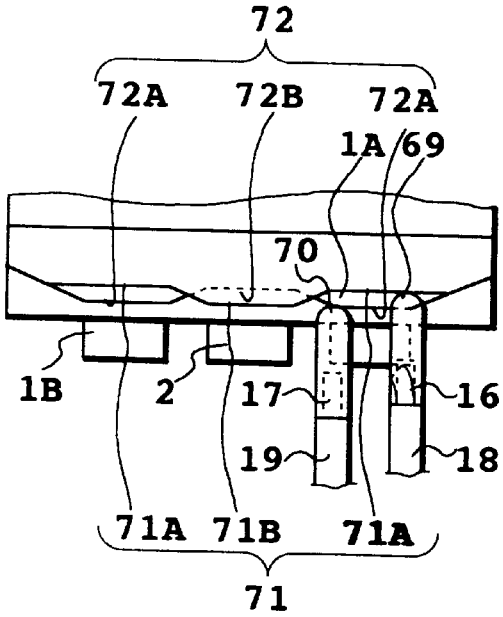
FIG. 47 is a schematic front view illustrating the wiping action of the ink jet printing apparatus shown in FIG. 42.

FIG. 46 shows the state in which the blade 17 wipes the central (the second) head (printability improving liquid ejecting head) 2. At this moment, the striking portion 69 contacts the cam surface 71B to retract the blade 16. FIG. 47 shows the state in which the blade 16 wipes the rightmost (third from the left) head (printing head) 1A. At this moment, the striking portion 69 for ink contacts the cam surface 71A while the striking portion 70 for the printability improving liquid contacts the cam surface 72A to retract the blade 17.

Figure 48:
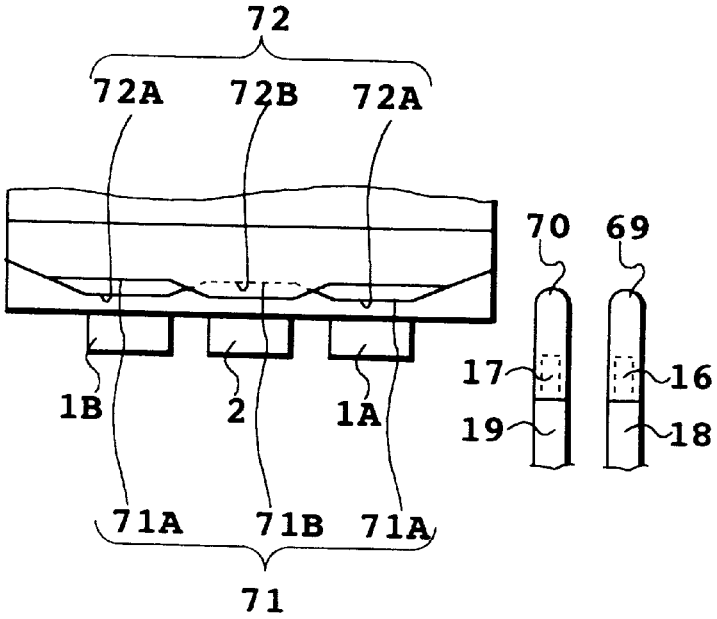
FIG. 48 is a schematic front view illustrating the wiping action of the ink jet printing apparatus shown in FIG. 42.

FIG. 48 shows the state immediately after the wiping. At this moment, the carriage 3 is located immediately on the left side of the blades 16 and 17, and the blade 16 and 17 are elevated to the same upper limit height as the state immediately before the wiping (FIG. 44). Then, the blades 16 and 17 return to non-wiping mode (fully retracted) the same as shown in FIG. 43 and stand in a waiting mode. According to the example shown in FIGS. 42 to 48, down sizing and cost reduction of the printing apparatus can be attained.

EXAMPLE 13

In the arrangement of the ink jet printing apparatus according to Example 12 shown in FIGS. 42 to 48, the cam surfaces 71 and 72 controlling the position of the blades are provided on the carriage 3. In contrast, in the third example of the present invention, the cam surfaces 71 and 72 for controlling the position of the blades 16 and 17 are provided on the heads 1 and 2 and thus are detachable together with the head cartridge from the carriage 3. The wiping action is substantially the same as the arrangement shown in FIGS. 43 to 48. With this arrangement, there can be obtained an ink jet printing apparatus in which it is unnecessary to change the wiping arrangement even if the number and positional relationship of the printing heads and the printability improving liquid ejecting head are changed and in which the user can select an optimal printing head according to the purposes of obtaining high image quality printing or high speed printing, or the like.

EXAMPLE 14

Figure 49A:
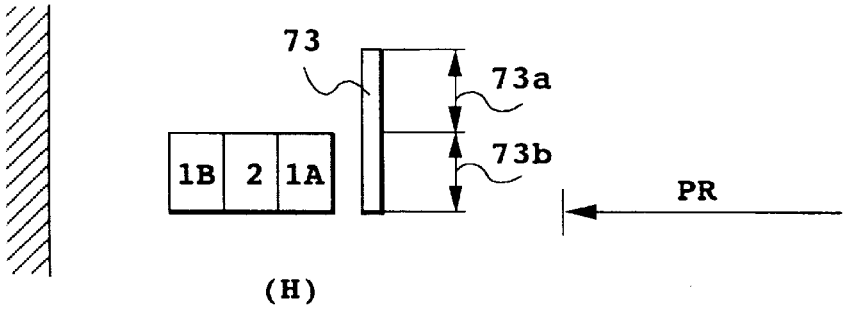
FIGS. 49A and 49D are each a schematic plan view showing a main part of an ink jet printing apparatus according to a fourteenth example of the present invention, illustrating the wiping action thereof.
Figure 49B:
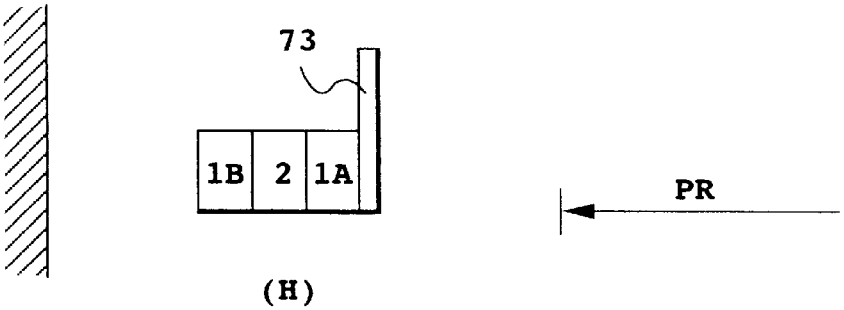
Figure 49C:
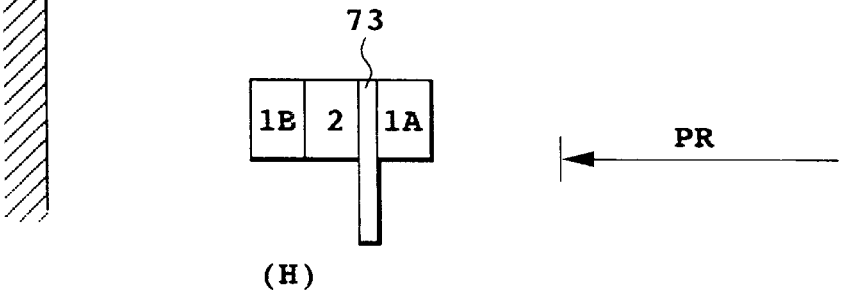
Figure 49D:
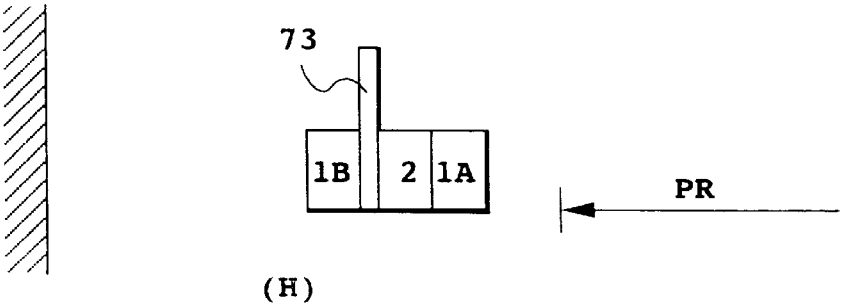

FIGS. 49A and 49D are each a schematic top view showing a main part of an ink jet printing apparatus according to a fourteenth example of the present invention, illustrating the wiping action thereof. FIG. 49A shows the state in which a blade 73 faces a printing head 1A such that one wiping region 73*b* of the blade 73 corresponds to the printing head 1A. FIG. 49B shows the state in which the one wiping region 73*b* contacts the printing head 1A. FIG. 49C shows the state in which the blade 73 is moving in the direction vertical to the direction of arrangement of the heads so that the other wiping region 73*a* of the blade 73 contacts a printability improving liquid ejecting head 2. FIG. 49 shows the sate in which the other wiping region 73*a* of the blade 73 has completed the wiping of the printability improving liquid ejecting head 2. In this example, one blade 73 is used commonly as a blade for wiping printing heads and also as a blade for wiping a printability improving liquid ejecting head. The length of the blade 73 in the up and down direction in FIGS. 49A to 49D is at least twice as long as each head (in the direction of up and down in FIGS. 49A to 49D). The blade 73 is movable in the direction in which the ejecting ports of the head are arrayed (in the direction of up and down in FIGS. 49A to 49D) at positions where it contacts each head.

The carriage 3 is provided with a striking portion which contacts the blade 73 and the position of the blade 73 in the up and down direction can be controlled such that the blade 73 contacts heads in different contact surface regions (regions contacting ejecting port planes) on the surface of the blade 73 between the case where it wipes the printability improving liquid ejecting head 2 and the case where it wipes each printing head 1. With this arrangement, unidirectional movement of the carriage 3 enables to wipe both the printing heads and the printability improving liquid ejecting head even with one blade 73 with preventing contact of the ink with the printability improving liquid.

EXAMPLE 15

FIGS. 50A to 50L are each a schematic plan view showing a main part of an ink jet printing apparatus according to a fifteenth example of the present invention, illustrating the wiping action of thereof. Like Example 14, this example employs only one blade 74 which is used commonly as a blade for the printing head and the printability improving liquid ejecting head. In this example, the blade 74 may be of a length in the direction in which the ejecting ports are arranged, approximately the same as the length of each head in the direction in which ejecting ports are arranged. Use of both surfaces of the blade 74 selectively enables one to perform the wiping of the printing heads and the printability improving liquid ejecting head with different surfaces of the blade.

The wiping action of this example will be explained with reference to FIGS. 50A to 50L. In FIGS. 50A to 50L, the carriage 3 is provided with two position controlling cam surfaces 71 and 72 for controlling the positions of the blades, and upon relative movement of the carriage 3, the striking portion 69 of the blade holder 18 contacts the position controlling cam surfaces 71 and 72. That is, when the carriage 3 moves in one direction (to the left) the striking portion 69 contacts the cam surface 71 while the carriage 3 moves in the opposite direction (to the right) the striking portion contacts 69 the cam surface 72.

Figure 50A:
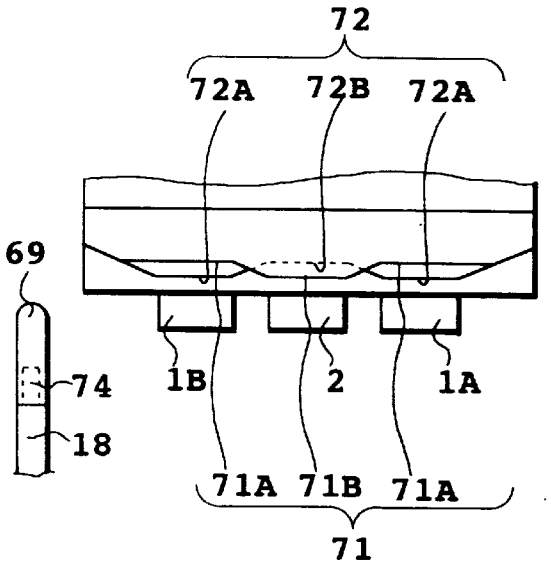
FIGS. 50A to 50L are each a schematic plan view showing a main part of an ink jet printing apparatus according to a fifteenth example of the present invention, illustrating the wiping action of thereof.
Figure 50B:
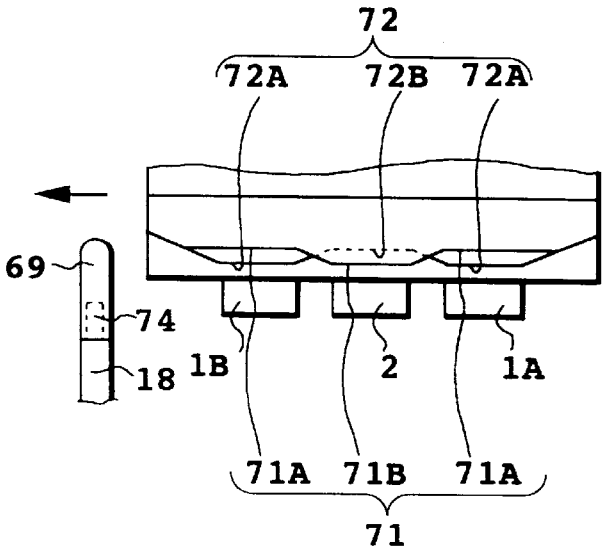
Figure 50C:
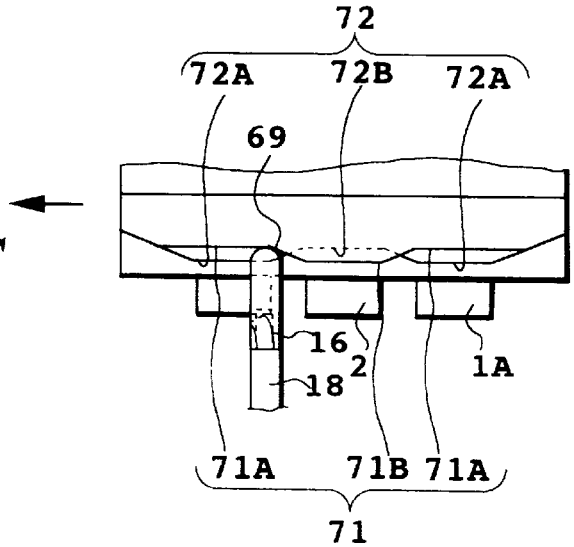
Figure 50D:
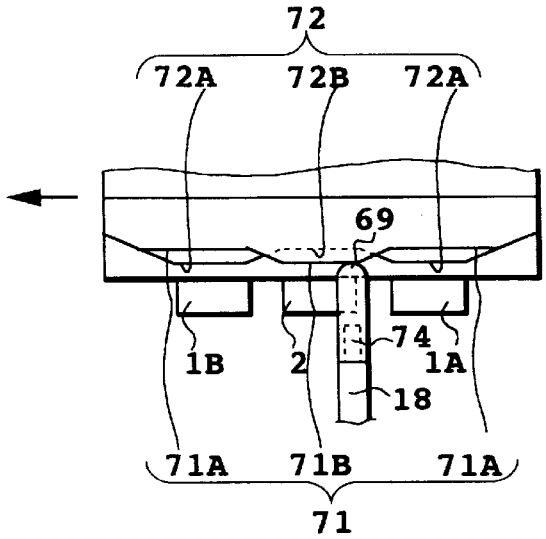
Figure 50E:
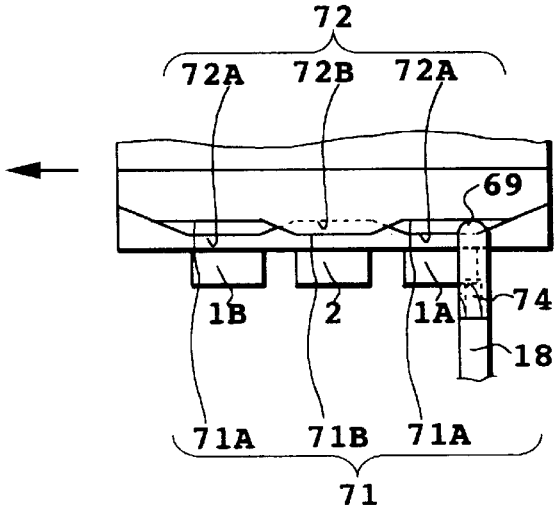
Figure 50F:
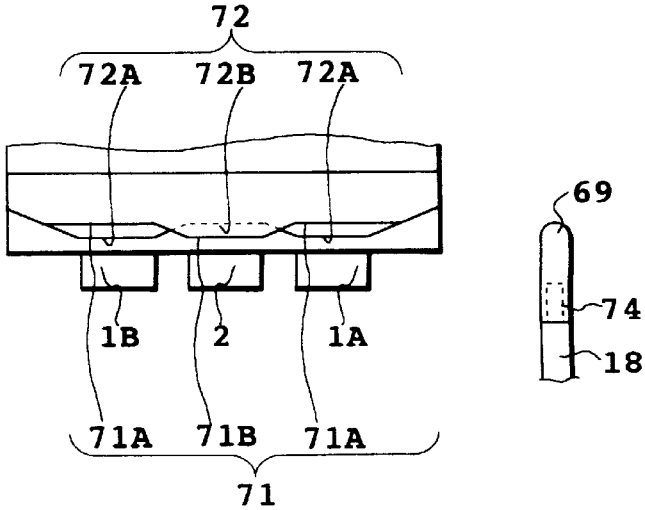

In other words, the blade holder 18 or the striking portion 69 thereof contacts a different position controlling cam surface depending on which direction the carriage 3 is moving. In this way, contacting and retracting of one blade 74 with respect to two heads (printing head 1B and printability improving liquid ejecting head 2) can be controlled. FIGS. 50A to 50F show the state in which the carriage 3 is moving to the left and the striking portion 69 contacts the cam surface 71, so that the printing heads, i.e., the leftmost printing head 1B and the rightmost printing head 1A are wiped. More particularly, the blade holder 18 elevates from a retracted position as shown in FIG. 50A, to a state as shown in FIG. 50B. Then, the carriage moves to the left so that the striking portion 69 of the blade holder 18 contacts the leftmost end region 71A of the cam surface 71 to wipe the printing head 1B as shown in FIG. 50C. Next, as shown in FIG. 50D, the striking portion 69 of the blade 74 contacts the central region 71B of the cam surface 71, so that the blade 74 is lowered, with the result that the blade 74 does not contact the printability improving liquid ejecting head 2. Thereafter, as shown in FIG. 50E, the striking portion 69 of the blade holder 18 contacts the rightmost end region 71A of the cam surface 71, with the blade 74 wiping the printing head 1A. Thus, the wiping of the printing heads 1A and 1B is over (FIG. 50F).

Figure 50G:
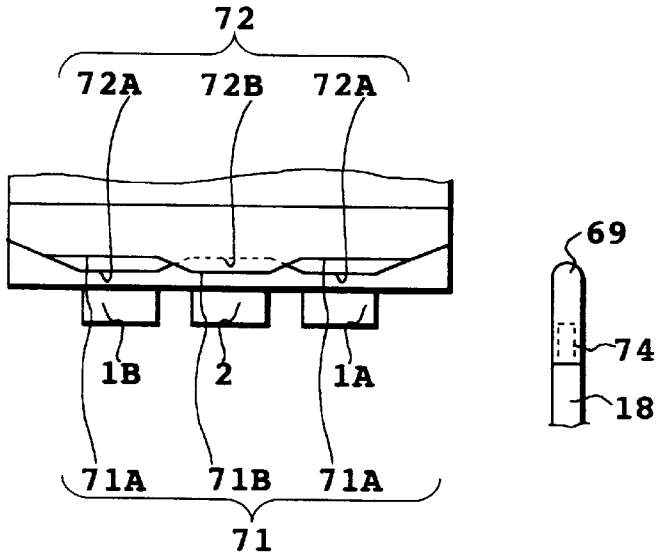
Figure 50H:
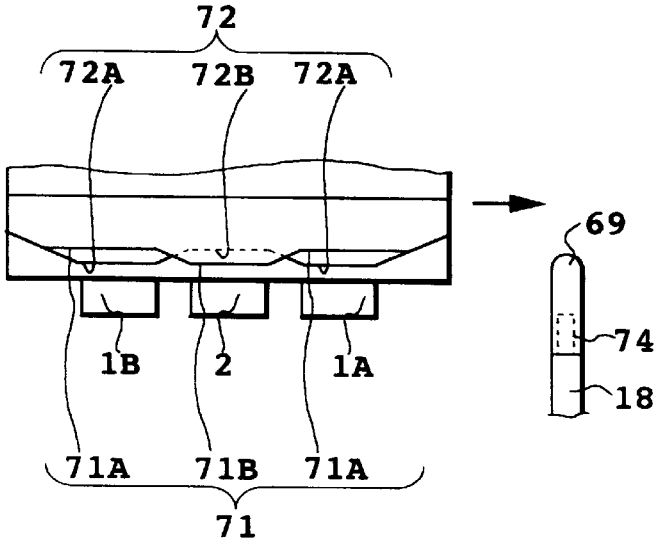
Figure 50I:
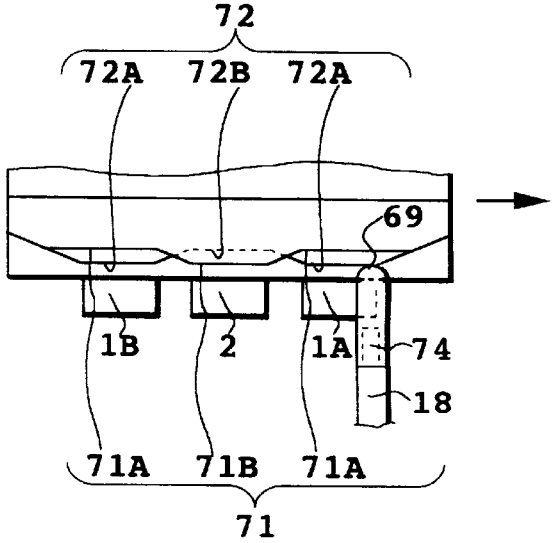
Figure 50J:
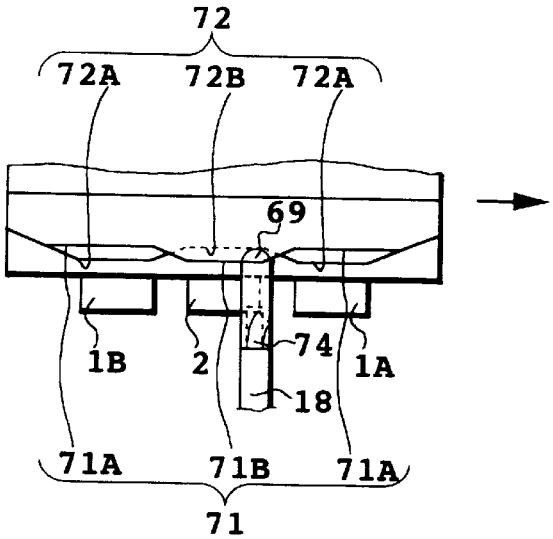
Figure 50K:
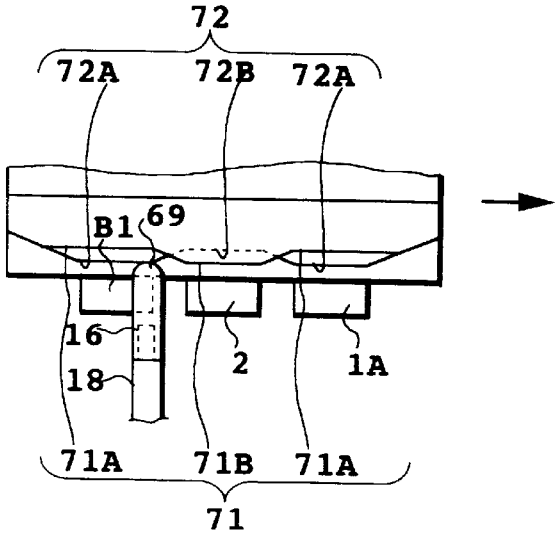
Figure 50L:
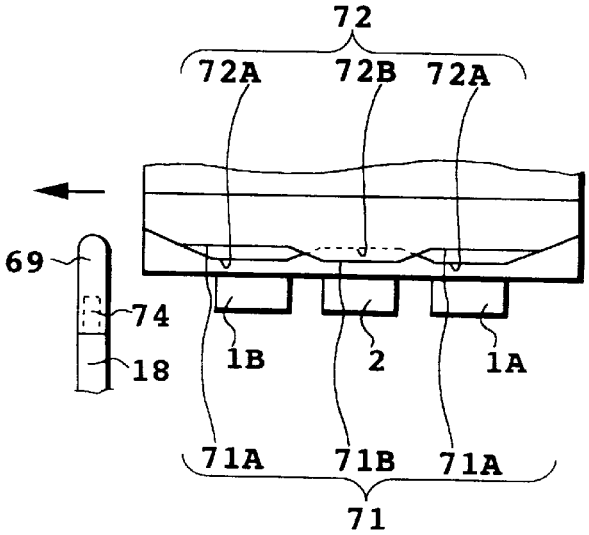

FIGS. 50G to 50I show the state in which the carriage 3 is moving to the right and the striking portion 69 contacts the cam surface 72, thereby the printability improving liquid ejecting head, i.e., the central head 2, is wiped. That is, the blade holder 18 translates to a position just facing the other cam surface 72 by a moving mechanism (not shown) as shown in FIG. 50G. After the blade holder 18 elevates, the carriage moves to the right as shown in FIG. 50H. Then, the striking portion 69 of the blade holder 18 contacts the rightmost end region 72A of the cam surface 72 so that the blade 74 is lowered and does not contact the printing head 1A as shown in FIG. 50I. Next, according as the carriage moves further to the right, the striking portion 69 of the blade holder 18 contacts the central region 72B of the cam surface 72 sot that the blade 74 is elevated and contacts the printability improving liquid ejecting head 2 to wipe it as shown in FIG. 50J. After completion of the wiping of the head 2 by the blade 74, the striking portion 69 then contacts the leftmost region 72A of the cam surface 72 to lower the blade holder 18 as shown in FIG. 50K, and thus the blade 74, so that the blade 74 passes below the printing head 1A without any touch to complete the wiping of the head 2 as shown in FIG. 50L.

By the arrangement and action shown in FIGS. 50A to 50L, it is possible to wipe only the printing head while the carriage 3 moves to the left and to wipe only the printability improving liquid ejecting head wile the carriage 3 moves to the right.

In the examples shown in FIGS. 42 to 50L, an ink jet printing apparatus which forms images by ejecting ink and a printability improving liquid on a printing material 10 and which performs high speed and high quality printing can be obtained at low cost by driving blades for wiping ejecting port planes essential to high quality image printing in a simple construction.

In the foregoing examples, description has been made taking an example of a serial printing system. However, the present invention is also applicable with similar advantageous effects to a line printing system which performs printing using a line printing head of a length fully covering all or a part of the width of a printing material by sub-scanning only. Further, the present invention is applicable with similar advantageous effects to, a color printing apparatus which performs printing using a plurality of printing heads printing with different colors, a monochromatic printing apparatus using a single printing head, a gradation printing apparatus using a plurality of printing heads which performs printing in the same color but different densities, a printing apparatus using a plurality of printability improving liquid ejecting heads, and further a printing apparatus using these printing heads and/or one or more printability improving liquid ejecting heads in combination.

Furthermore, the present invention is also applicable with similar advantageous effects to various printing apparatuses with any desired arrangements of ejection portions (head portions) and liquid storage tanks such as those using an exchangeable head cartridge having an ejection portion (head portion) and a liquid storage tank integrally assembled or separately arranged and connected with a tubing for supplying a liquid.

When applied to an ink jet printing apparatus, the present invention is applicable to one which uses a printing means (printing head) employing an electro-thermal transducer such as piezo element. In particular, the present invention is applicable with excellent effects to an ink jet printing apparatus using a printing means of the type in which ink is ejected utilizing thermal energy. Use of such a system allows printing in high density and high precision.

EXAMPLE 16

Figure 51:
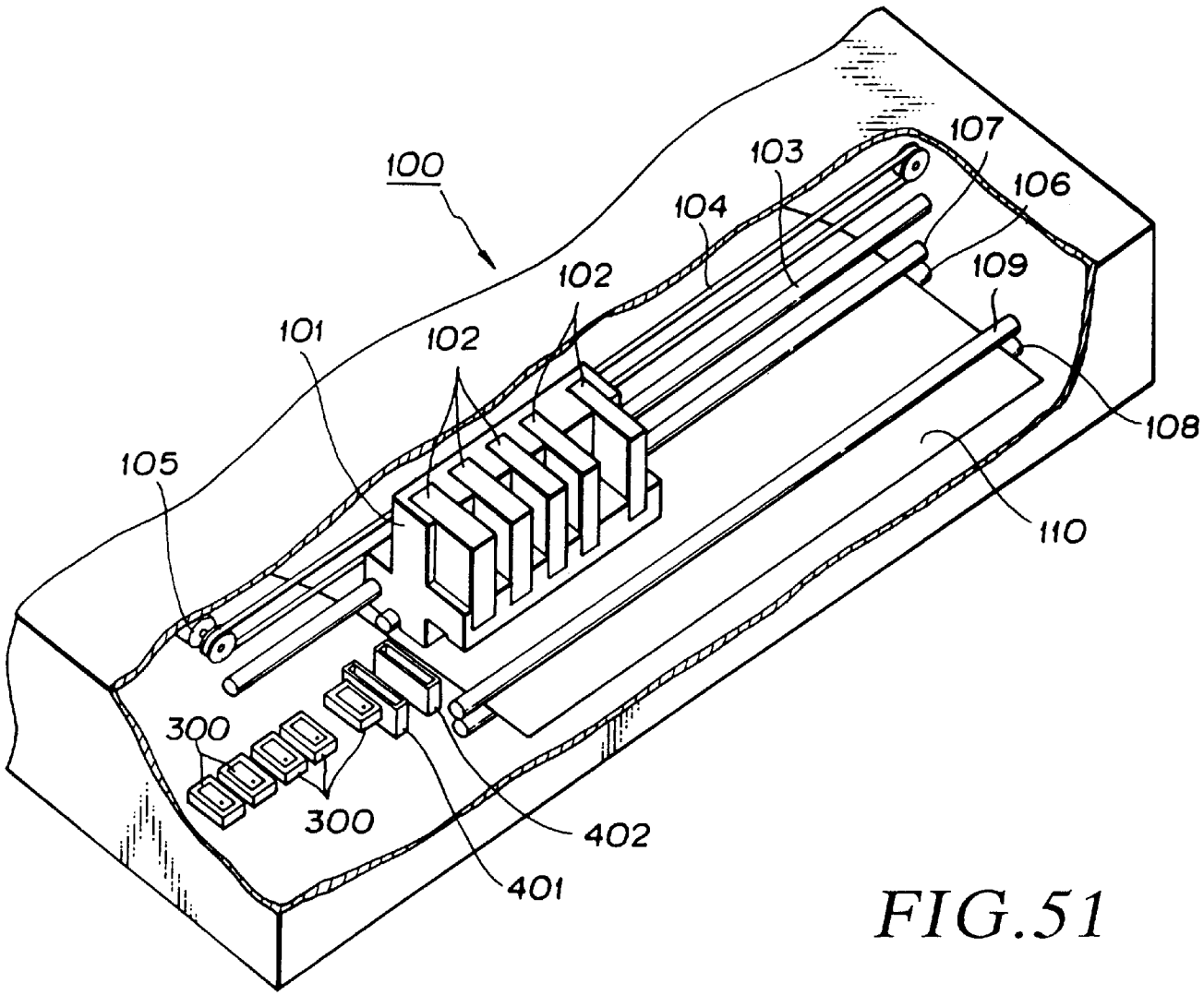
FIG. 51 is a schematic perspective view showing an ink jet printing apparatus according to a sixteenth example of the present invention.

FIG. 51 is a schematic perspective view showing an ink jet printing apparatus according to a sixteenth example of the present invention. An ink jet printing apparatus 100 includes a carriage 101, which has mounted thereon a plurality of ink jet cartridge 102. The ink jet cartridge 102, as will be described in detail with reference to FIG. 52, has an ink tank portion in its upper part and an ejector (sometimes referred to as "head portion" or simply "head"), and a connector for receiving signals for driving the head. The carriage 101 holds, in position alignment, five cartridges 102 containing different inks and a printability improving liquid as a printability improving liquid, respectively, for example, yellow ink, magenta ink, cyan ink, and black ink, and a printability improving liquid which contains a substance that insolubilizes and/or agglomerates a coloring material such as a dye in ink. The carriage 101 also includes a connector holder for transmitting signals for driving the ink jet ejectors and is electrically connected to the ejection portions. In this example, cartridges 102C, 102M, 102C, and 102K containing yellow (Y) ink, magenta (M) ink, cyan (C) ink, and black (B) ink, respectively, and a cartridge 102S containing a printability improving liquid (P) for insolubilizing and/or agglomerating the dyes in the inks are mounted on the carriage 101 in order from the left.

As shown in FIG. 51, the carriage 101 slidably supported on a guide rail 103, which extends in the main scanning direction of the carriage 101, moves reciprocatingly along the guide rail, with receiving a driving force transmitted through a driving belt 104 from a driving motor 105. Pairs of conveying rolls 106 and 107, and 108 and 109 are arranged before and after a printing position where printing is performed by ink jet ejectors so that a printing material 110 can be clamped and conveyed. The printing material such as paper is pressed against a platen (not shown) which controls a printing surface of the printing material to be flat. The ejector of the ink jet cartridge 102 mounted on the carriage 101 projects downward from the carriage 101 and located between the conveying rolls 107 and 109 so that the ejecting port plane of the ejector or print head portion faces in parallel to the printing material 110 pressed against a guide surface of the platen.

In the ink jet printing apparatus according to this example, a recovering system unit is arranged on the home position side which is on the left side in FIG. 51. The recovering system unit includes cap units 300 provided corresponding to ink jet ejectors which eject ink and a printability improving liquid ejector which ejects a printability improving liquid. The cap units are movable up and down by a moving mechanism (not shown) and when the carriage is at a home position, they are connected to the ejectors for capping to prevent the occurrence of ejection failure due to an increase in viscosity and setting of ink as a result of evaporation of ink in the ejecting ports of the ink jet ejectors.

The cap units 300 communicate with a pump unit (not shown) which is used to generate negative pressure for use in suction recovery treatment performed by connecting the cap units and the ink jet ejectors in case the ink jet ejector fall in ejection failure.

The receiving system unit also includes liquid receivers (preliminary ejection receiver) 401 and 402 for receiving liquids ejected by preliminary ejections. The liquid receiver 401 receives inks ejected by ink jet ejection portions which eject yellow, magenta, cyan, and black inks, respectively, while the liquid receiver 402 receives a liquid ejected by the printability improving liquid ejector. Thus, in this example, separate liquid receivers are arranged one for receiving inks ejected from the ejectors ejecting four color inks by preliminary ejection and the other for receiving the printability improving liquid ejected from the ejection portion ejecting a printability improving liquid which insolubilizes and/or agglomerates the color materials such as dyes in the inks, thereby preventing mixing of the inks with the printability improving liquid so that it is possible to prevent clogging of a discharging passage for discharging waste inks and a waste printability improving liquid with depositions resulting from such a mixing and, hence, contamination of the printing apparatus with ink or the like which overflows from the liquid receivers upon preliminary ejection. In this example, although construction is not shown specifically, a blade made of an elastic material such as rubber may be provided for wiping liquid droplets adhering to ejecting port planes of the ejecting portions.

Paper as the printing material 110 is inserted in an feeding port (not shown) provided in the front of the printing apparatus, with its conveying direction being reversed, and conveyed by the conveying rolls 106, 107, 108, and 109 to a position below a moving region in which the carriage 101 moves. The paper 110 supported on the platen (not shown) is printed on its printing region by the heads mounted on the carriage 101 according as the latter moves.

As described above, Printing over a width corresponding to the width of the array of ejecting ports of the heads according to the movement of the carriage 101 feeding of the paper 110 are repeated alternately to effect printing all over the entire printing region of the paper 110, and then the paper 110 is discharged to the front of the printing apparatus.

On the other hand, there is provided on the upper part or side part of the apparatus an operating portion (not shown) having a switch and a display element. Here, the switch is used for on/off of an electric source of the apparatus or for setting of various print modes while the display element serves to display various conditions of the apparatus.

The ink jet printing apparatus according to this example is to eject from a printability improving liquid head a printability improving liquid which insolubilizes and/or agglomerates the coloring material such as a dye in inks ejected from ink jet ejectors and improves the printability of the inks, and bring the printability improving liquid in contact with the inks ejected from the ink jet ejecting portions on a printing material to endow the dye in ink with water resistance. Since the dye in ink reacts with the printability improving liquid and becomes insoluble or agglomerated in an instant, not only water resistance is improved but also undesirable bleeding between colors can be prevented. In this example, an aqueous solution of a cationic polymer is used as the printability improving liquid while inks containing generally used acidic dyes are used.

The term "improvement of printability" as referred to herein with respect to the printability improving liquid, an example of which will be described hereinbelow, includes improvement in image quality such as density, color saturation, degree of sharpness at edge portion, and dot diameter, improvement in fixability of ink, and improvement in weatherability or image stability such as water resistance and light fastness, as will be described hereinbelow as an example.

The printability improving liquid, which is colorless or has a pale color, can be obtained, for example, as follows.

That is, after the following components are mixed and dissolved, the mixture is filtered under pressure through a membrane filter having a pore size of 0.22 $\mu$m (trade name: Flow Pore Filter, manufactured by Sumitomo Electric Industries, Ltd.) and then is adjusted with NaOH to pH 4.8 to obtain Solution A1. Composition of Solution A1:

Low Molecular Weight Components of Cationic Compound

Stearyl trimethyl ammonium chloride 2 wt. %
(trade name: Electro Stopper QE,
manufactured by Kao Co., Ltd)

High Molecular Weight Component of Cationic Compound

| | |
|---|---|
| Polyaminesulfone<br>(average molecular weight: 5,000)<br>(Trade name: PAS-92, manufactured by NITTOBO Co.) | 3 wt. % |
| Thiodiglycol | 10 wt. % |
| Deionized water | 85 wt. % |

A preferred example of ink which mixes with the above-described liquid and insolubilizes is as follows.

That is, the following components are mixed and dissolved. Then the mixture is filtered under pressure through a membrane filter having a pore size of 0.22 $\mu$m (trade name: Flow Pore Filter, manufactured by SUMITOMO ELECTRIC INDUSTRIES, LTD.) to obtain yellow ink Y1, magenta ink M1, cyan ink C1, and black ink K1.

| | |
|---|---|
| Composition of Y1: | |
| C.I. Direct Yellow 142 | 2 wt. % |
| Thiodiglycol | 10 wt. % |
| Acetynol EH (manufactured by KAWAKEN FINE CHEMICAL CO., LTD.) | 0.05 wt.% |
| Deionized water | to make 100 wt. % |
| Composition of M1: | |
| The same composition as Y1 except that the dye was changed to: | |
| Acid Red 289 | 2.5 wt. % |
| Composition of C1: | |
| The same composition as Y1 except that the dye was changed to: | |
| C.I. Acid Blue 9 | 2.5 wt. % |
| Composition of K1: | |
| the same composition as Y1 except that the dye was changed to: | |
| Acid Black 2 | 3 wt. % |

In mixing the above-described substantially colorless liquid with ink, the liquid and ink are mixed on a printing material or at a position impregnated in the printing material in the present invention. As a result, in the first stage of the reaction, of the cationic substances contained in the colorless or pale color liquid, the lower molecular weight component and the water soluble dye having an anionic group contained in ink associate by ionic interaction and separates from the solution phase instantaneously.

Next, in the second stage of the reaction, the above-described association product of the dye with the lower molecular weight cationic substance is adsorbed on the higher molecular weight component in the liquid, so that the agglomerates of the dye resulting by association grow and have a bigger size and it becomes difficult for them to penetrate in gaps between the fibers of the printing material. As a result, only liquid portion after solid-liquid separation spreads into the printing paper. In this manner, both image quality and fixability are attained. At the same time, the agglomerates formed from the anionic dye, low molecular weight component of the cationic substance, and the high molecular weight component of the cationic substance by the mechanism described above have a high viscosity and do not migrate along with the flow of the liquid medium. Therefore, if adjacent ink dots are of different colors as in full color image printing, they do not mix with each other, nor cause bleeding. Further, the above-described agglomerates are essentially water insoluble so that the printed images have sufficient water resistance. In addition, the images formed have improved light fastness due to shading effect of the polymer.

An ink jet cartridge having an ink jet ejector and an ink tank integrally connected has the same structure as the cartridge shown in FIG. 5. As shown in FIG. 5, the ink jet cartridge has an ink tank portion 21 in the upper part thereof, an ink ejector (printing head portion) 22 in the lower part thereof, and a connector 23 for receiving signals for driving the ejector 22 and outputting ink residual amount detecting signals for determining and giving an information on a residual amount of the ink in the ink tank portion. The connector 23 is arranged at a position abreast of the ink tank 21. The cartridge has an ejecting port plane 81 on a bottom side in FIG. 5 (on the side of a printing material 10). The ejecting port plane is provided with a plurality of ejecting ports. The printing head has a liquid passage communicating to the respective ejecting ports. In the liquid passage is arranged an energy generating element which generates energy required for ejecting ink.

Each head and tank are molded integrally. However, they may be constructed such that they can be attached to and detached from each other and any of them can be exchanged by new ones. For example, only an ink tank for any particular color ink can be exchanged, if desired, e.g., when the ink or printability improving liquid in the tank is used out. Of course, only head can be exchanged.

Figure 52:
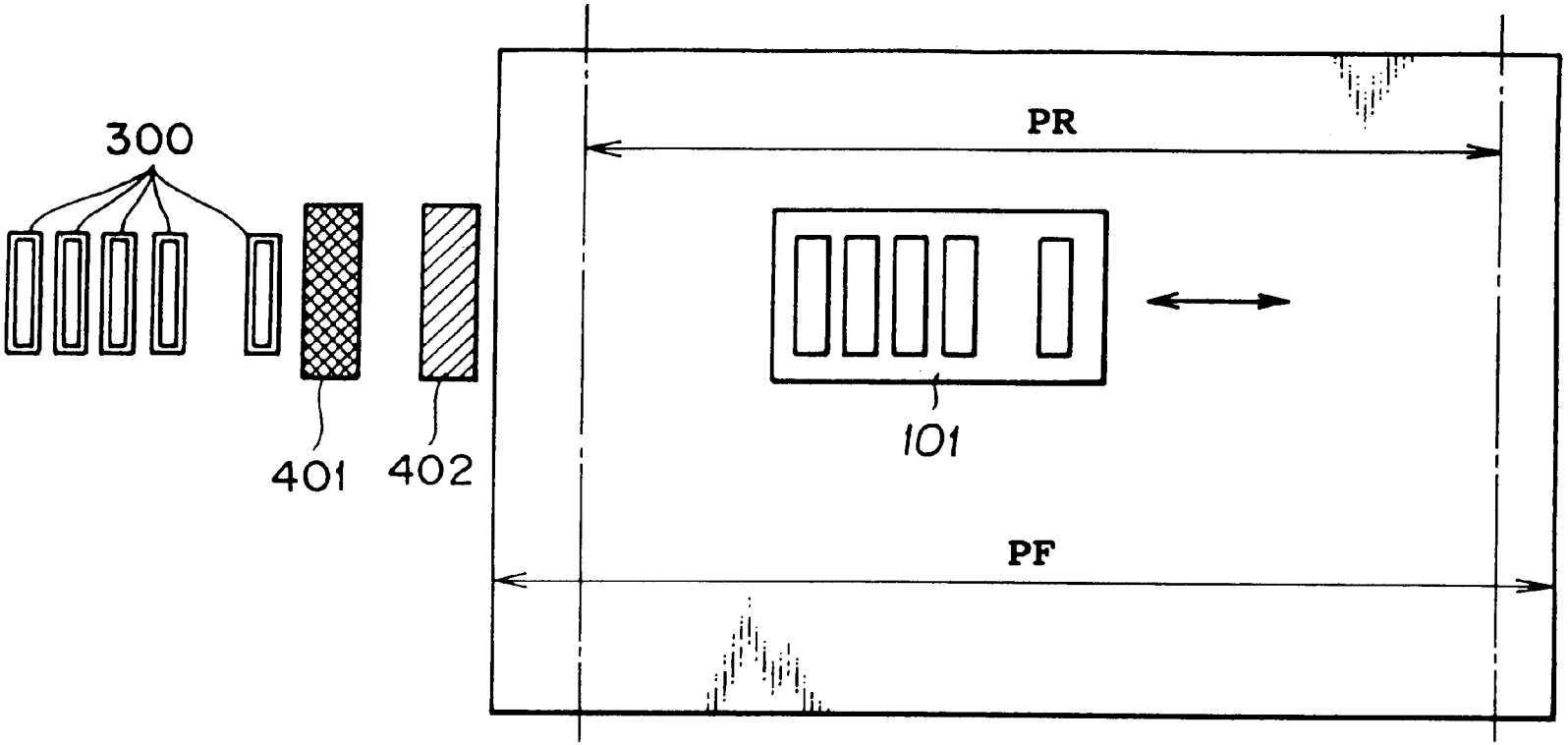
FIG. 52 is schematic plan view showing a part of the ink jet printing apparatus shown in FIG. 51, illustrating relationship between liquid receivers for receiving preliminary ejection and also illustrating the action of preliminary ejection of the apparatus.

FIG. 52 is schematic plan view showing a part of the ink jet printing apparatus shown in FIG. 51, illustrating relationship between liquid receivers for receiving preliminary ejection and also illustrating the action of preliminary ejection of the apparatus.

In this example, the liquid (ink) receiver 401 for receiving ejected ink ejected by preliminary ejection from ink jet ejectors ejecting different color inks and the liquid receiver 402 for receiving ejected printability improving liquid ejected by preliminary ejection from the ejector ejecting colorless liquid which insolubilizes and/or agglomerates the dyes in the inks are arranged separately at respective positions located in the region where the carriage 101 scans and outside the conveying rout in which the printing material is conveyed (paper feed region). With this arrangement, in preliminary ejection sequence, the ink jet ejectors ejecting different color inks can eject a predetermined amount of ink when they are at a position facing the ink receiver 401 and a predetermined amount of printability improving liquid when they are at a position facing the liquid receiving portion 402.

The direction of movement of the carriage when preliminary ejection is performed is not limited particularly. That is, the carriage can move in the direction from the home position toward the printing region or in the direction opposite thereto. The distance between the center of the liquid receiver for receiving ink and the center of the liquid receiver receiving the printability improving liquid may be set identical to the distance between the array of ejecting ports of the ejector for ejecting the printability improving liquid and the array of ejecting ports of the ejector for ejecting ink (in this example Bk ink head) adjacent the ejector for ejecting the treating liquid so that preliminary ejection of the printability improving liquid and that of ink (in this example black ink) can be performed simultaneously.

Since the printability improving liquid is a liquid which is substantially colorless and transparent or translucent, unlike ordinary ink, it does not attract attention when it adheres onto the printing material such as paper. Therefore, when the printing material is not conveyed, preliminary ejection of the printability improving liquid may be performed in the liquid receiving portion 402, and when the printing material is in the conveying route, preliminary ejection may be performed on the printing material. By changing the position of preliminary ejection or the liquid receiver receiving preliminary ejection depending on the presence or absence of the printing material, the amount of waste liquid to be discharged in the printing apparatus can be reduced since the portion of the liquid corresponding to that of preliminary ejection is discharged onto the printing material when the printing material is present, e.g., during printing. Also, preliminary ejection onto the printing material allows omission of movement of the ejectors to the position of preliminary ejection so that it is possible to perform preliminary ejection without substantially decreasing throughput.

EXAMPLE 17

Figure 53:
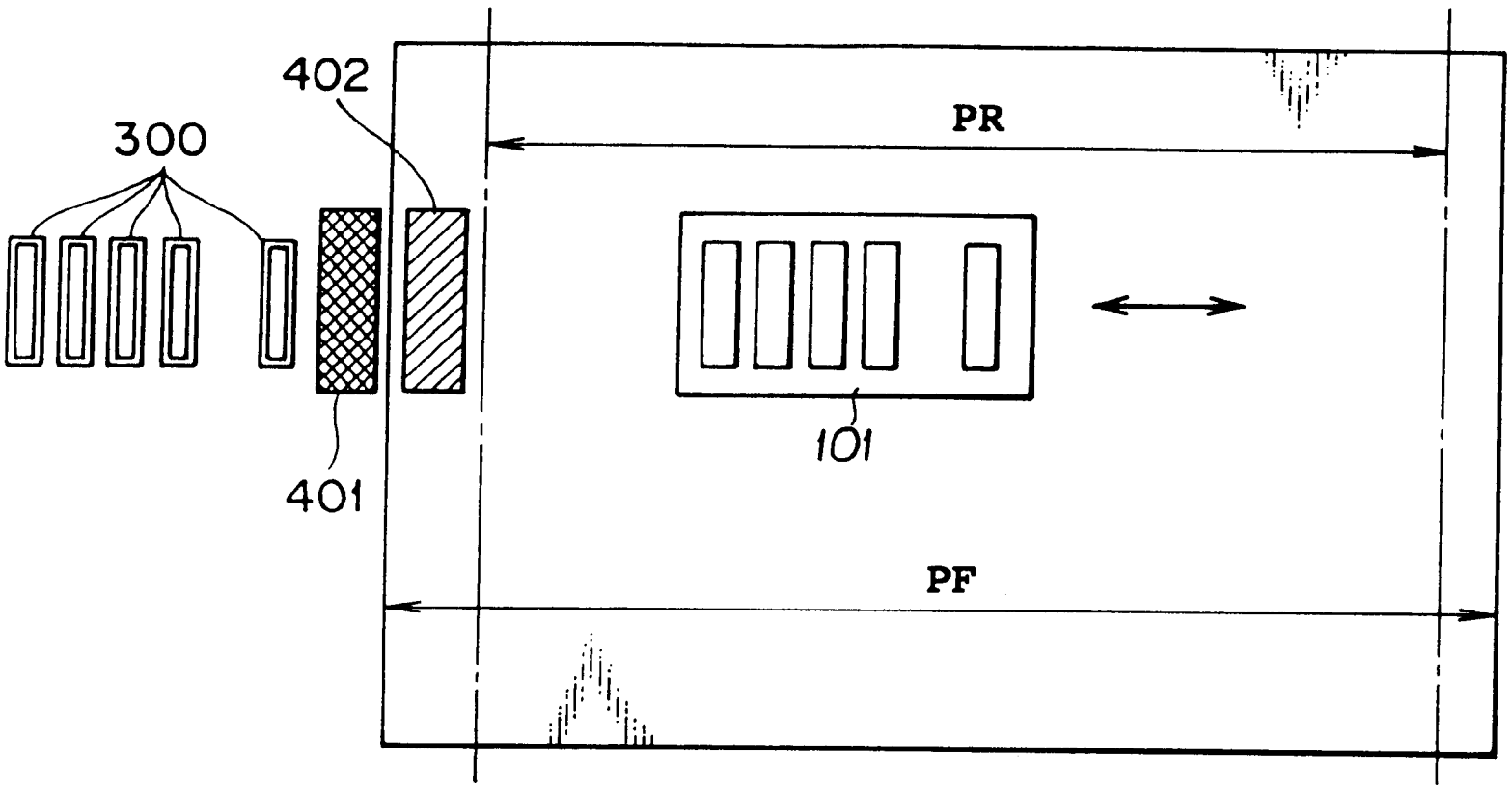
FIG. 53 is schematic plan view showing a part of an ink jet printing apparatus according to a seventeenth example of the present invention, illustrating relationship between liquid receivers for receiving preliminary ejection and also illustrating the action of preliminary ejection of the apparatus.

FIG. 53 is schematic plan view showing a part of an ink jet printing apparatus according to a seventeenth example of the present invention, illustrating relationship between liquid receivers for receiving preliminary ejection and also illustrating the action of preliminary ejection of the apparatus.

In this example, the liquid receiver 401 for ink is arranged outside the conveying route of a printing material (outside the paper feeding region) while the liquid receiver 402 for the printability improving liquid is arranged inside the conveying route (inside the paper feeding region).

In this case, as described above, preliminary ejection of the printability improving liquid is performed in the liquid receiver 402 when the printing material is not being conveyed while when the printing material is in the conveying route, preliminary ejection is performed onto the printing material. With this arrangement, the amount of the waste liquid to be discharged in the printing apparatus can be decreased by the amount of preliminary ejection. In addition, as compared with the arrangement shown in FIG. 52, the whole recovering system unit is made close to the printing region so that a decrease in throughput due to the recovery sequence can be minimized and the down sizing of the apparatus is possible.

When preliminary ejection is performed on the printing material by the ejecting portion for the printability improving liquid, there may be a case where it is preferred depending the nature of the printing material that preliminary ejection be performed in the printing region but outside the printing region on the printing material. This is because there can depending the kind of the printing material be a case where it is preferred that no treatment for insolubilizing ink is performed.

For example, in the case of a special printing material called back print film where print image is viewed from the side opposite to the print surface, it is necessary for ejected ink to penetrate into the printing material sufficiently when the printing material is printed. If the treating liquid which insolubilizes or agglomerates the dye in the ink is applied, agglomeration occurs on the printing material to prevent the penetration of ink into the printing material and as a result the quality of print image as viewed from the back side decreases. For this reason, it is preferred, regardless of the kind of the printing material, that preliminary ejection by the ink jet ejector ejecting the liquid which insolubilize or agglomerates the ink be performed always outside the printing region, more preferably preliminary ejection be performed at a position corresponding to the position where the liquid receiver 402 is located. As a result, the same sequence can be used for preliminary ejection itself regardless of whether a printing material is present or absent.

Conversely, the liquid receiver 402 may be arranged in the printing region. In this case, the apparatus can be adapted such that when a printing material is present in the conveying region, preliminary ejection is performed on the printing material outside the printing region.

Figure 54:
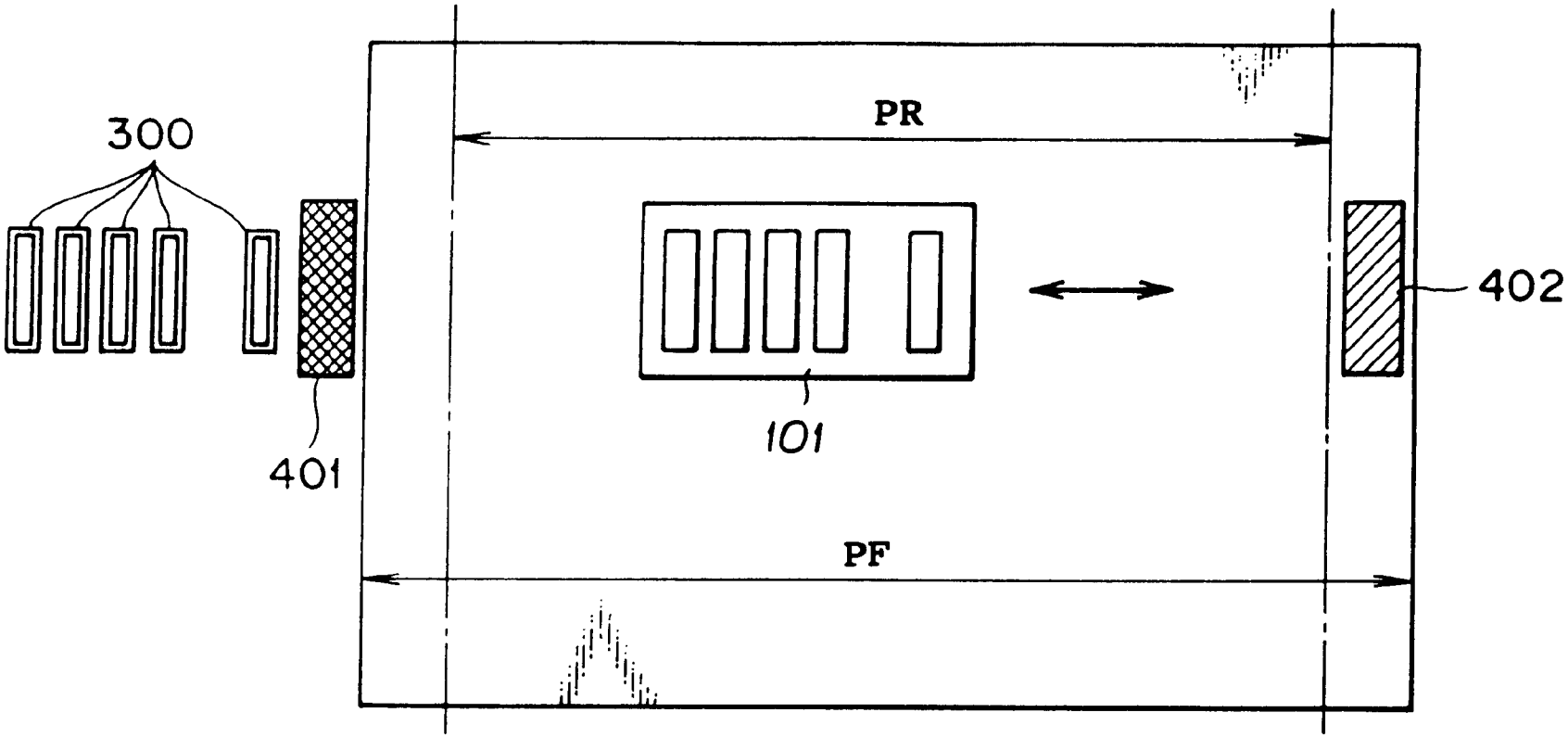
FIG. 54 is a schematic plan view showing a part of an ink jet printing apparatus according to a variation of the seventeenth example of the present invention, illustrating relationship between liquid receivers for receiving a preliminary ejection and also illustrating the action of the preliminary ejection of the apparatus.
Figure 55:
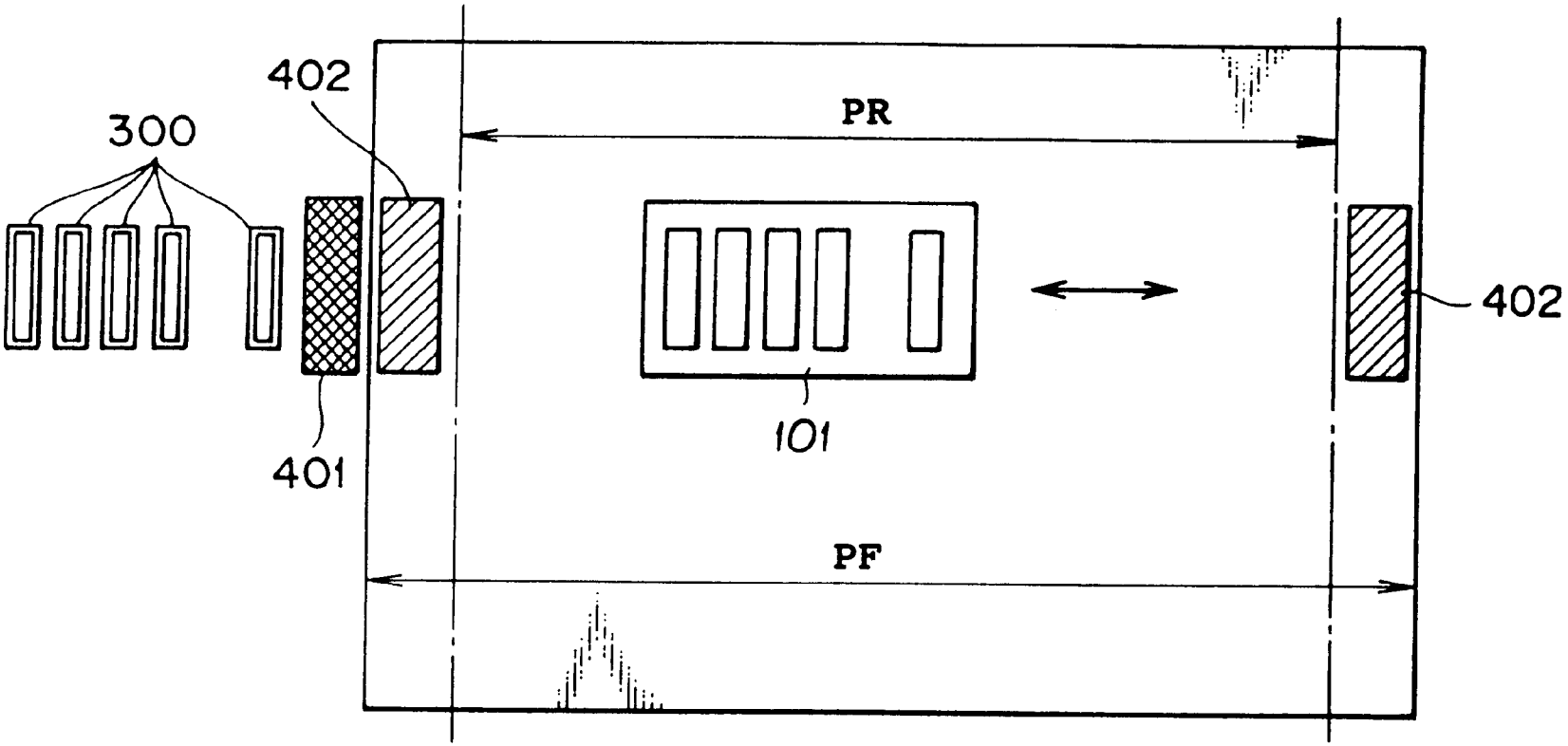
FIG. 55 is a schematic plan view showing a part of an ink jet printing apparatus according to another variation of the seventeenth example of the present invention, illustrating a relationship between liquid receivers for receiving preliminary ejection and also illustrating the action of the preliminary ejection of the apparatus.

The position of the liquid receiver 402 for the printability improving liquid is not limited to what has been described above. Instead, as shown in FIG. 54, the liquid receiver 402 may be positioned on the side opposite to the side of the recovering system unit in the paper feeding region, more preferably in the paper feeding region and outside the printing region, or as shown in FIG. 55, on both sides.

The printing apparatus may also be constructed such that instead of providing the liquid receiver 402 for the printability improving liquid, the ejecting portion for ejecting the printability improving liquid performs preliminary ejection on the printing material only. Preliminary ejection performed on the printing material makes it possible to perform preliminary ejection without substantially decreasing throughput.

EXAMPLE 18

Figure 56:
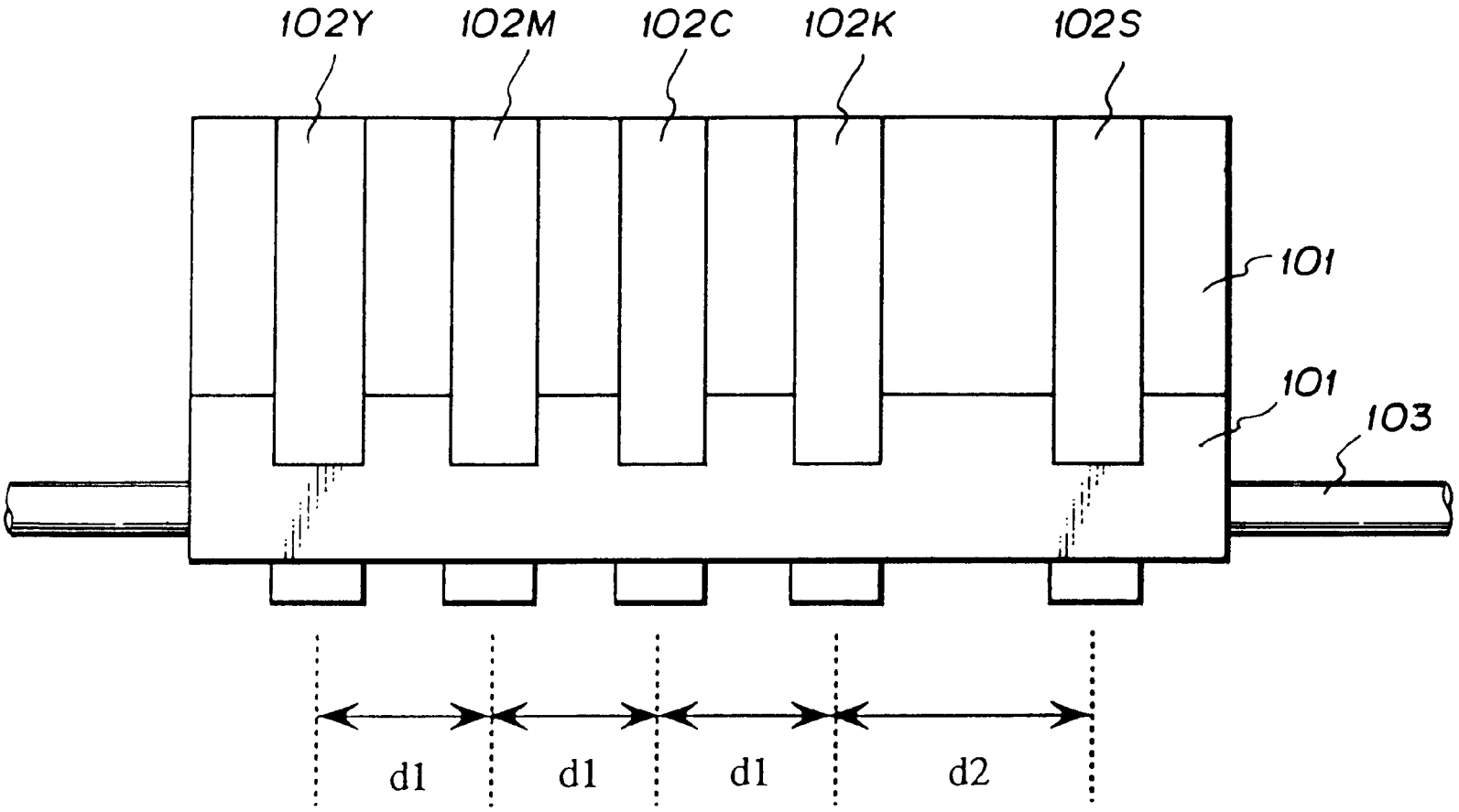
FIG. 56 is a schematic front view showing a carriage having mounted thereon an ink jet cartridge according to an eighteenth example of the present invention.

FIG. 56 is a schematic front view showing a carriage having mounted thereon an ink jet cartridge according to an eighteenth example of the present invention. FIG. 56 is a front view of the carriage 101 shown in FIG. 51. The distance between any adjacent two of the heads of the ink jet ejectors 102Y, 102M, 102C, and 102K which eject the respective color inks is made the same, i.e., d1. The rightmost ejector 102S and the ejection portion adjacent thereto (in this example, the ejector 102K for black ink Bk) are arranged at a distance, d2, from each other. In this case, the distance d2 is made larger than the distance d1 (d1<d2). If not only d2 but also d1 is made large, the size of the carriage 101 is considerably large, which leads to an increase in the size of the printing apparatus. After investigation by the present inventors, it has been found that appropriate distance d2 is at least 1.5 cm, more preferably at least 2 cm. In this distance range, ejection failure decreases. Enlargement of the distance between the ejection portion for the printability improving liquid and the ejection portion for ink adjacent thereto results in alleviation of influences on the head of scattered ink droplets due to the elasticity of the blade upon wiping.

Each head is provided with 160 ejecting ports and each ejecting port ejects 40 ng of ink. Each tank is connected to the corresponding head so that ink or a printability improving liquid can be supplied.

Further, the liquid receiver may be a conventional one, or the liquid receiver 401 and 402 described in Examples 16 and 17 may be used.

As the ink and the printability improving liquid, those described in Example 16 are used.

EXAMPLE 19

Figure 57:
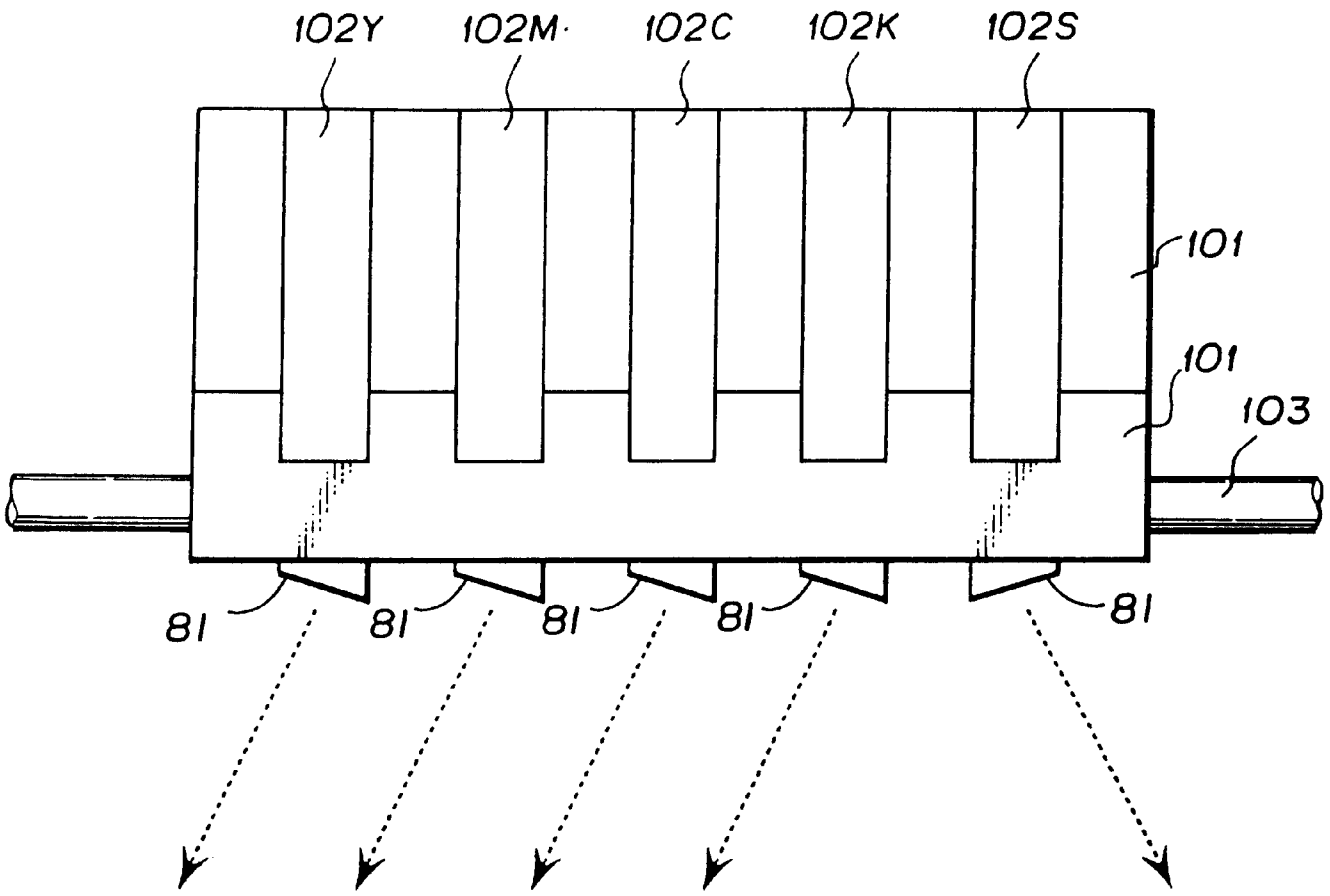
FIG. 57 is a schematic front view showing a carriage having mounted thereon an ink jet cartridge according to a nineteenth example of the present invention.

FIG. 57 is a schematic front view showing a carriage having mounted thereon an ink jet cartridge according to a nineteenth example of the present invention. In FIG. 57, the carriage 101 is seen from the front, reference numeral 81 indicates an ejecting port plane of the ink jet ejector. In FIG. 57, the ejectors 102Y, 102M, 102C, and 102K for color inks and the ejecting portion 102S for the printability improving liquid are arranged at the same distance one from another. In this example, the rightmost ejection portion 102S for the printability improving liquid has an ejecting port plane 81' and the ejectors 102Y, 102M, 102C, and 102K have respective ejecting port planes 81. The ejecting port plane 81' is inclined to the axis of the guide shaft 103. Also, the ejecting port planes 81 are inclined to the axis of guide shaft 103. However, the ejecting portion 81' is inclined in a direction opposite to the direction of inclination of the ejecting port planes 81. In other words, the ejecting port plane of the ejector 102S and the ejecting port plane of each of the ejectors 102Y, 102M, 102C, and 102K are inclined oppositely to each other to a direction vertical to a surface of a printing material at a printing position. With this arrangement, liquid droplets ejected from the ejector 102S can be ejected further from those ejected from the ejectors 102K, etc. The arrangement in which the direction of ejection is inclined with respect to a direction vertical to a printing surface of a printing material may include one shown in FIGS. 58 to 60 or one shown in FIG. 61. In these figures, the ejection portions are simplified for ease of understanding and only for nozzles are depicted.

Figure 58:
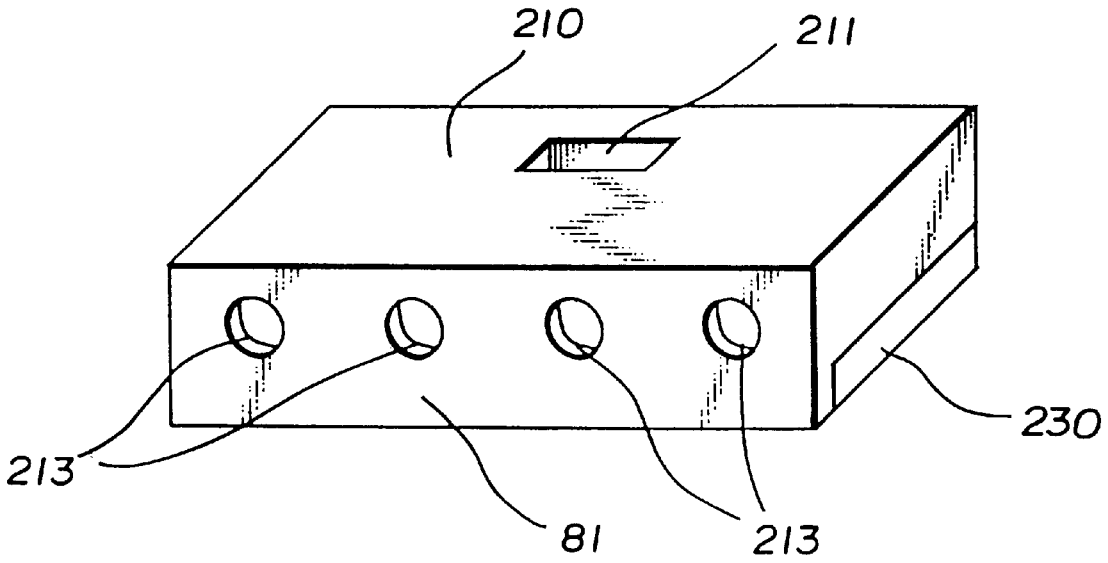
FIG. 58 is a perspective view showing an ejector.
Figure 59:
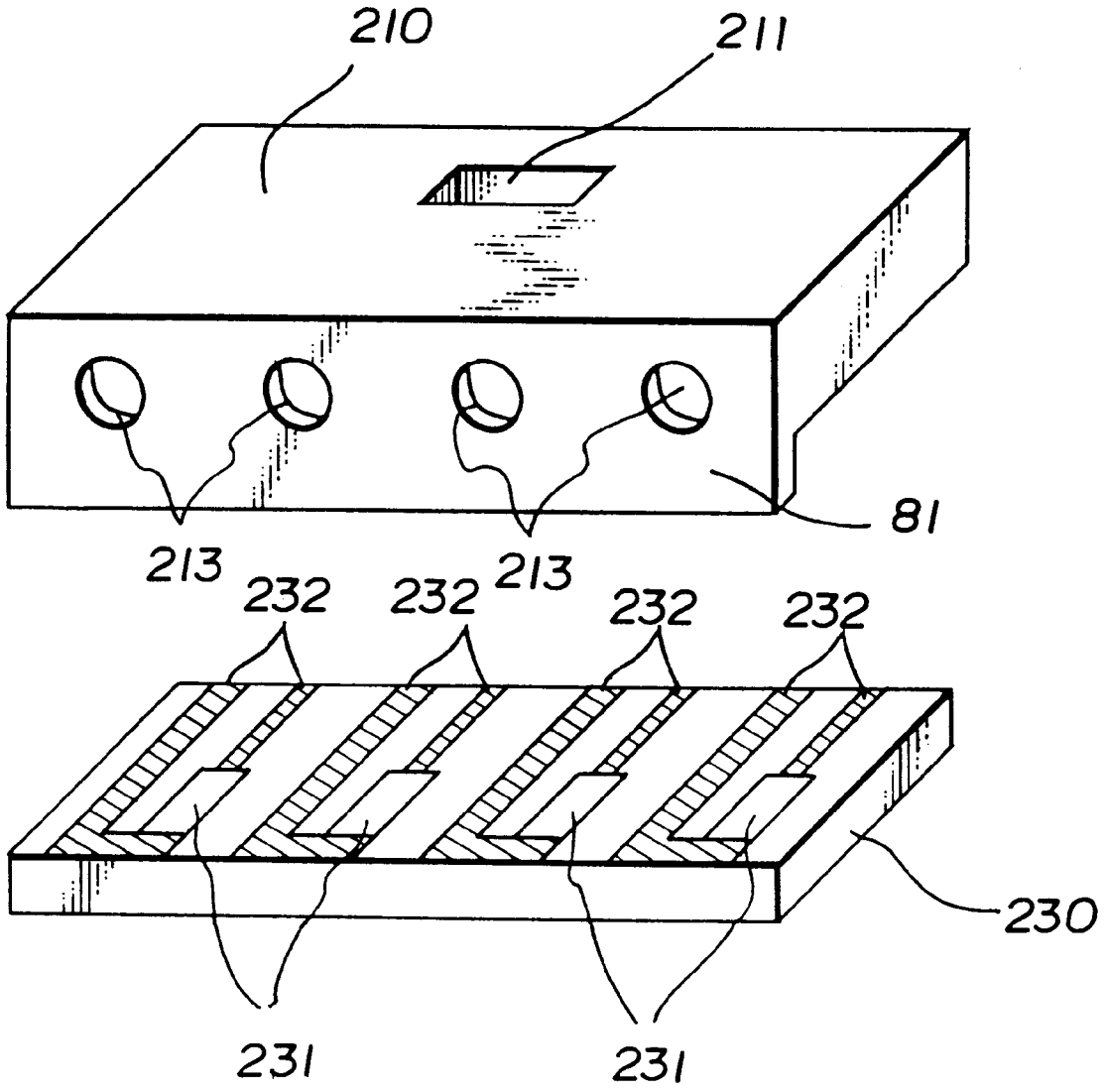
FIG. 59 is an exploded perspective view showing the ejector shown in FIG. 58.
Figure 60:
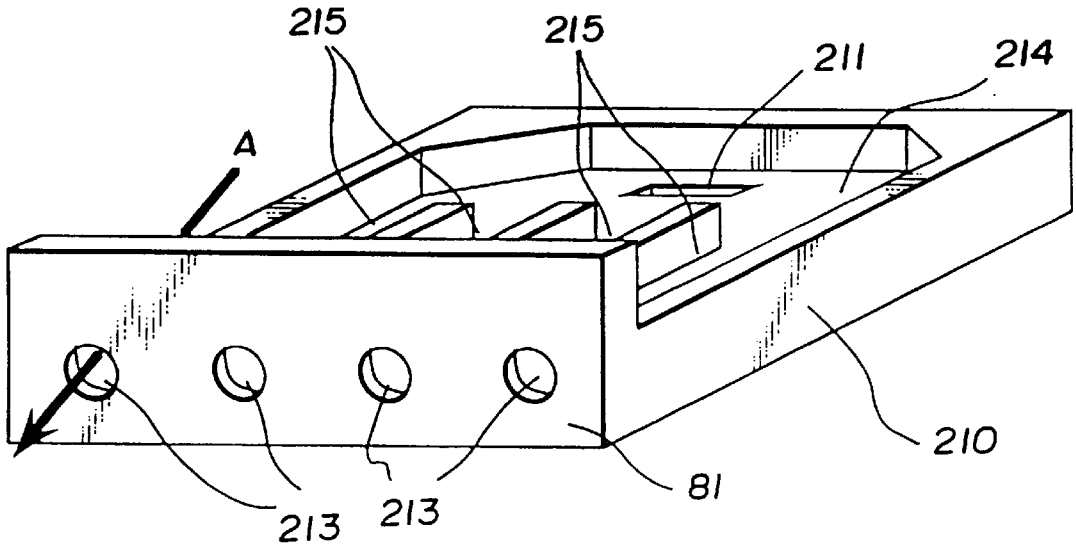
FIG. 60 is a perspective view showing a top plate portion of the ejector shown in FIG. 58.
Figure 61:
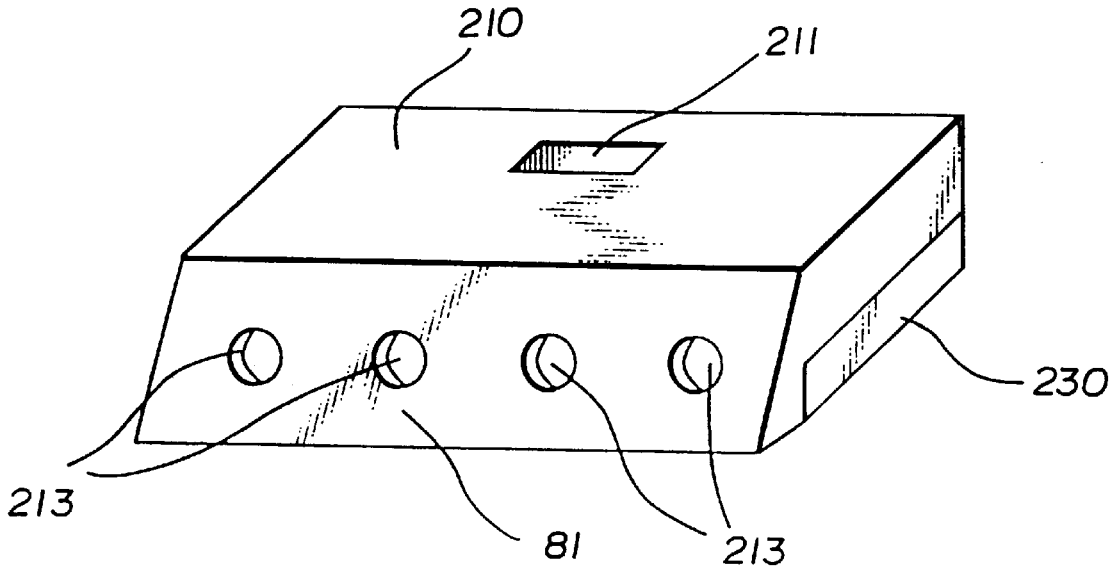
FIG. 61 is a perspective view showing an ejector according to a variation of the nineteenth example of the present invention.

The ejection portion shown in FIGS. 58 to 60 includes a top plate 210 having integrally incorporated therein an ejecting port plane and a heater board 230 connected to the top plate. As shown in FIG. 60, the top plate 210 has an ink supply port 211, an ink reservoir (common liquid chamber) 214, and a plurality of ink passages 215. The ejecting port plane 81 is provided with ejecting ports 213 corresponding to the ink passages 215, respectively. The heater board 230 has formed thereon heaters (electro-thermal elements) 231 positioned in the respective ink passages 215 and wiring 232 for applying electric current to the respective heaters 231 for heat generation. In the case where the top plate 210 thus molded integrally together with the ejecting port plane is provided with ejecting ports 213 inclined with respect to the ejecting port plane 81, the top plate 210 is formed of the ejecting ports 213 as inclined as indicated by arrow A as shown in FIG. 60. That is, the ejecting ports 213 are formed such that the center axis of each ejecting port 213 crosses a perpendicular of the ejecting port plane at an angle less than 90°. Alternatively, as shown in FIG. 61, the ejecting port plane itself may be molded such that it is inclined, that is, the top plate 210 is molded such that when the head is mounted, the ejecting port plane crosses a plane perpendicular to the printing surface of the printing material at a predetermined angle and ejecting ports are formed therein vertically or with its center axis crossing vertically to the ejecting port plane. In this case, the angle of deviation is set so that there can be attained separation of mist similar to the case where the distance between the ejector for ink and the ejector for the printability improving liquid is at least 1.5 cm, preferably at least 2 cm. For example, when the distance between heads is 1.27 cm (½ inches) and distance from paper is 2 mm, the angle between is 60° or more.

In these heads, ink (liquid) supplied into the common liquid chamber 214 is fed into the liquid passages 215 and forms a meniscus at the ejecting ports 213 and is retained in a stable state. By applying current to the heaters 231 through the wiring 232, the ink (liquid) on each heater 231 is heated to cause foaming by film boiling, so that liquid droplets are ejected through the ejecting ports 213 by virtue of the foaming energy As shown in FIG. 57, the direction of the ejector 102S for the printability improving liquid is differed from the direction of ejection of the ejectors 102Y, 102M, 102C, and 102K for ink so that the droplets ejected from one may go further from those ejected by another as they run. As a result, mist generated by the ejector for the printability improving liquid spreads in a position more remote in the same manner as the direction of ejection, so that the mist does not adhere to the surface of the adjacent ejector. Conversely, mist generated by the ejector for ink does not adhere to the ejector for the printability improving liquid.

Other structures are the same as in Example 18. As the ink and the printability improving liquid, the same compositions as those described in Example 16.

Combination of the arrangements described in Example 17 with those described in Example 18 is more effective. In this case, d2 and deviation angle may be adjusted appropriately to give optimal conditions depending on the object on which printing is to be made.

Further, combination of the arrangements described in Example 16 and those described in Example 17 is also effective.

The tank used in the practice of the present invention may be of integral type in which tanks for the printability improving liquid P and ink Bk are integral or tanks for inks C, M, and Y are integral.

Ink may be injected by connecting an ink supply pipe to the ink tank to form a passage for introducing ink to the tank and injecting ink through the passage. Ink supply port in the ink tank may be a supply port to be connected to the ejector, an air communication port, or a bore formed in the wall of the ink tank.

In the above described examples, description has been made of an example of the type in which printing is performed by moving the above-described small size head in the direction of the width of a printing material. However, the present invention is not limited thereto and a full line head may be used.

[Refill Kit]

Figure 62:
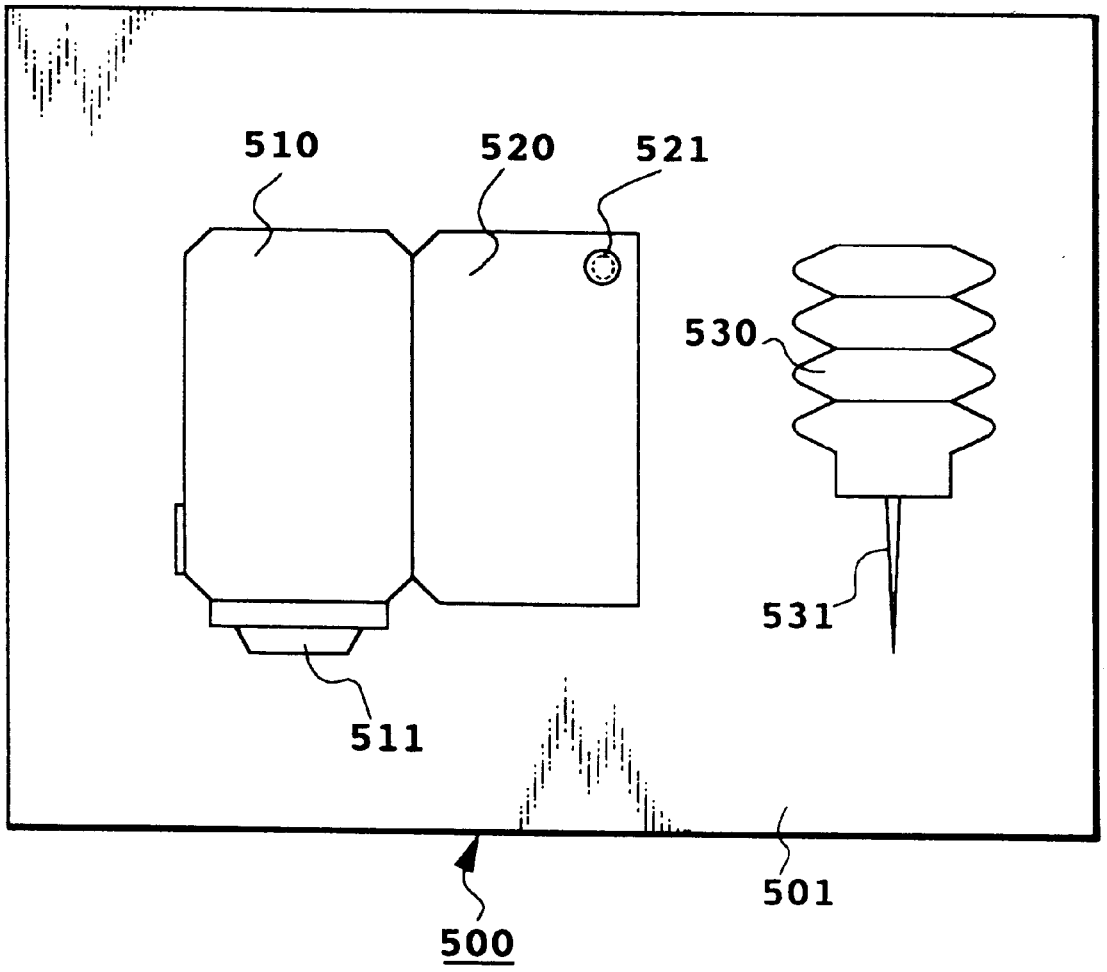
FIG. 62 is a schematic plan view showing an ink jet head kit according to the present invention.

Hereinafter, description will be made of ink jet head kit including an ink jet head of the present invention. FIG. 62 is a schematic plan view showing an ink jet head kit according to the present invention. The ink jet head kit 500 includes a kit container 501 housing therein an ink jet head 510 of the present invention having an ink ejector 511, an ink tank 520 which is a liquid tank separable or inseparable from the head, an ink filling means containing ink for filling it to the ink tank.

When the ink is consumed, a portion of an inserting portion (injection needle, etc.) 531 of the ink filling means is inserted into an air communication port 521, a connecting portion for connecting to the ink jet head, or a bore or opening formed in the wall of the ink tank and the ink in the ink filling means is filled in the ink tank.

As described above, provision of a kit including the ink jet head of the present invention, an ink tank, an ink filling means, and so on contained in a kit container, it is easy to fill into the ink tank as described above in case the ink is consumed so that printing can be started without delay.

In the ink jet head kit according to this example of the present invention, explanation has been made as including an ink filling means. However, the ink jet head kit may also be constructed such that it has no ink filling means but may be one that has a separable ink tank filled with ink and housed in the kit container 510.

FIG. 62 shows an ink jet head kit having only the ink filling means for filling ink in the ink tank. However, the ink jet head kit may be of a type in which a printability improving liquid filling means for filling a printability improving liquid in the liquid tank therefor housed in a kit container.

In the practice of the present invention, no particular limitation is posed to the printing material and any conventional material such as so-called normal paper, e.g., copying paper and bond paper can be used advantageously. Coated paper specifically prepared for ink jet printing or transparent film for OHP can be used suitably. In addition, general high quality paper or luster paper can also be used. Further, in practicing the present invention, the coloring material which can be used is not limited to dyes but pigments or mixtures of dyes and pigments may also be used.

Furthermore, in the practice of the present invention, ink is not limited particularly to dye inks but pigment inks in which.

For practicing the present invention, useful ink is not limited especially to the dyestuff ink but also it is possible to use the ink comprising dispersed pigments. In the latter case, an useful printability improving liquid can be an agglomerate of the pigment. The followings are examples of the pigment ink that causes an agglomeration by mixing with the above-mentioned colorless liquid A. That is, as will be described below, each color ink of yellow Y2, magenta M2, cyan C2, and black K2 is prepared as comprising a pigment and an anionic compound.

1. Black Ink K2

An anionic high-molecule P-1 (styrene-methacrylic acid-ethyl acrylate, an acidic value 400, an average molecular weight 6,000, an aqueous solution containing 20% solid material, and a potassium hydroxide as a liquid neutralizing agent) is used as a dispersion agent. The following materials are filled in a vertical batch-type sand mill (manufactured by Imex Co., LTD) and then glass beads of 1 mm in diameter are provided as media to fill the hole tightly. After that, the mixture is subjected to a water-cooled dispersion treatment for three hours, resulting that a fluid dispersion having the viscosity of 9 cps and the pH of 10.0. The thus obtained fluid dispersion is centrifuged by a centrifuge to separate contained materials of different specific gravities to remove coarse particles. Consequently, a dispersion of carbon-black with an average particle diameter of 100 nm.

| [Composition of the carbon-black dispersion] | |
|---|---|
| P-1 aqueous solution (including 20% of solidified portion) | 40 parts |
| Carbon black Mogul L (Cablack made) | 24 parts |
| Glycerin | 15 parts |
| Ethylene glycol monobutyl ether | 0.5 parts |
| Isopropyl alcohol | 3 parts |
| Water | 135 parts |

A black ink K2 for the ink-jet recording, comprising pigments as sufficiently-dispersed bodies obtained by the above procedure, is thus prepared. A solidified portion of the final preparation is about 10%.

2. Yellow Ink Y2

An anionic high-molecular substance P-2 (styrene-acrylic acid-methyl methacrylate, an aqueous solution having an acid value of 280, a molecular weight of 11,000, and a solid content of 20%, and neutralizer diethanolamine) is used as a dispersion agent. The dispersion is managed similarly to the process of preparing the black ink K2 by means of the following materials. Consequently, a yellow color dispersion body of 103 nm in average particle diameter is obtained.

| [Composition of the yellow dispersion] | |
|---|---|
| P-2 aqueous solution (20% of solid content) | 35 parts |
| C.I. Pigment yellow 180 (Trade name: Nova palm yellow - PH-G, manufactured by HOECHST AG.) | 24 parts |
| Triethylene glycol | 10 parts |
| Diethylene glycol | 10 parts |
| Ethylene glycol monobutyl ether | 1.0 parts |
| Isopropyl alcohol | 0.5 parts |
| Water | 135 parts |

A yellow ink Y2 for the ink-jet recording, comprising pigments as sufficiently-dispersed bodies obtained by the above procedure, is thus prepared. A solidified portion of the final preparation is about 10%.

3. Cyan Ink C2

The anionic high-molecular substance P-1, which is used in the preparation of the black ink K2, is also used as a dispersion agent for preparing the cyan ink Y2. The dispersion treatment is managed similar to the process of preparing the carbon-black dispersion by means of the following materials. Consequently, a cyan color dispersion body of 120 nm in average particle diameter is obtained.

| [Composition of the cyan dispersion] | |
|---|---|
| P-1 aqueous solution (20% of solid content) | 30 parts |
| C.I. Pigment blue 15:3 (Trade name: Fastgen Blue-FGF, manufactured by DAI NIPPON INK & CHEMICAL INDUSTRIED CO., L | 24 parts |
| Triethylene glycol | 10 parts |
| Glycerin | 15 parts |
| Diethylene glycol monobutyl ether | 15 parts |
| Isopropyl alcohol | 3 parts |
| Water | 135 parts |

A cyan ink C2 for the ink-jet recording, comprising pigments as sufficiently-dispersed bodies obtained by the above procedure, is thus prepared. A solidified portion of the final preparation is about 9.6%.

4. Magenta Ink MC2

The anionic high-molecular substance P-1, which is used in the preparation of the black ink K2, is also used as a dispersion agent for preparing the magenta ink M2. The dispersion treatment is managed similar to the process of preparing the carbon-black dispersion by means of the following materials. Consequently, a magenta color dispersion body of 115 nm in average particle diameter is obtained.

| [A composition of the magenta dispersion] | |
|---|---|
| P-1 aqueous solution (20% of solid content) | 24 parts |
| C.I. Pigment red 122 (manufactured by DAI NIPPON INK & CHEMICAL INDUSTRIES CO., LTD.) | 24 parts |
| Glycerol | 15 parts |
| Isopropyl alcohol | 3 parts |
| Water | 135 parts |

A magenta ink M2 for the ink-jet recording, comprising pigments as sufficiently-dispersed bodies obtained by the above procedure, is thus prepared. A solidified portion of the final preparation is about 9.2%.

In the above examples, the ink-jet recording methods and the ink-jet recording apparatuses using such methods have been explained in detail. As described above, a high-density image having an excellent water-resistant property compared with that of the conventional one can be obtained regardless of recording on a sheet of ordinary paper, under the condition of attaining a low running cost by a moderation in use of the recording-improvement solution to the utmost. In the case of forming a multiple-color image, furthermore, the high-coloring image can be obtained without causing an ink-running on the boundary of different colors.

Hereinafter, we will illustrate other preferred embodiments of the present invention, each of which is able to provide with a high-density black image without causing any feathering and also provide with a high-quality multiple-color image regardless of including both a black image and a color image without causing a spread of ink on the boundary area between the images.

Figure 63:
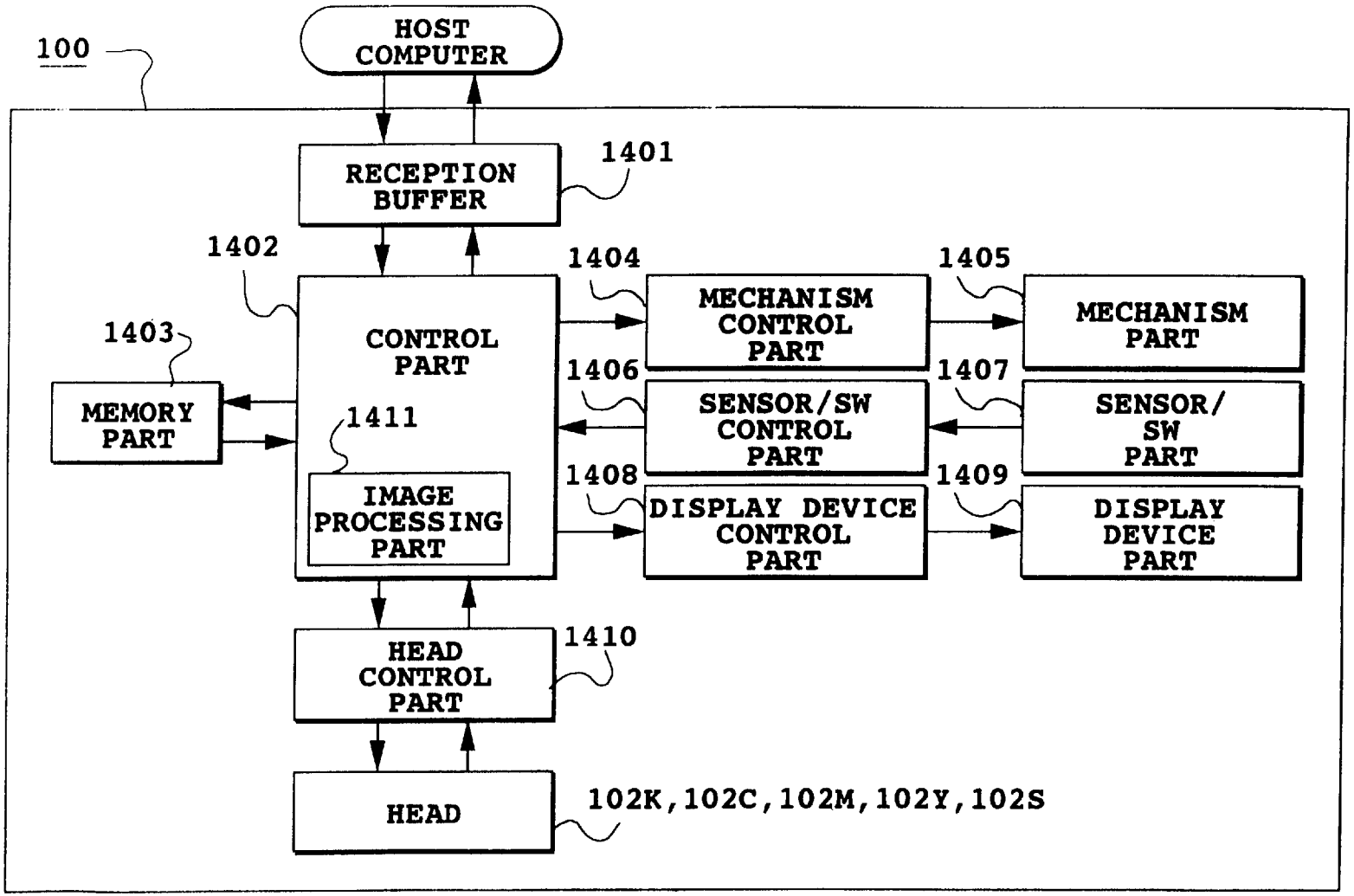
FIG. 63 is a block diagram showing an information processing system using an ink jet printing apparatus of the present invention.

FIG. 63 is a block diagram showing an information processing system using an ink jet printing apparatus of the present invention. Data of characters or image to be printed (hereafter, referred to as image data) are inputted form a host computer to a receiving buffer 1401 of an ink jet printing apparatus 100. Data for confirming if the data are transmitted correctly and data on conditions of operation of the printing apparatus are transmitted from the printing apparatus to the host computer. The data inputted to the receiving buffer 1401 are transmitted to a memory portion 1403 in the form of RAM under control of a control portion 1402, and temporarily stored in the memory portion. A mechanism control portion 1404, under command from the control portion 1402, drives a mechanism portion 1405 such as carriage motor or line feed motor as a driving force source for operating a carriage 101, a driving belt 104, conveying rolls 106 to 109 (FIG. 51). A sensor/SW control portion 1406 transmits signals from a sensor/SW portion 1407 including various sensors and SW (switches) to the control portion 1402. A display device control portion 1408, under command from the control portion 1402, controls display of a display device 1409 such as LED of display panels or liquid crystal display device. A head control portion 1410, under command from the control portion 1402, controls the heads 102K, 102C, 102M, 102Y, and 102S independently, and reads information on the conditions of the heads such as temperature and transmits the data to the control portion 1402.

The control portion 1402 is provided with an image processing portion 1411 fro performing image processing described hereinbelow.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. As examples of the recovery system, are a capping means and a cleaning means for the recording head, and a pressure or suction means for the recording head. As examples of the preliminary auxiliary system, are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

Figure 64:
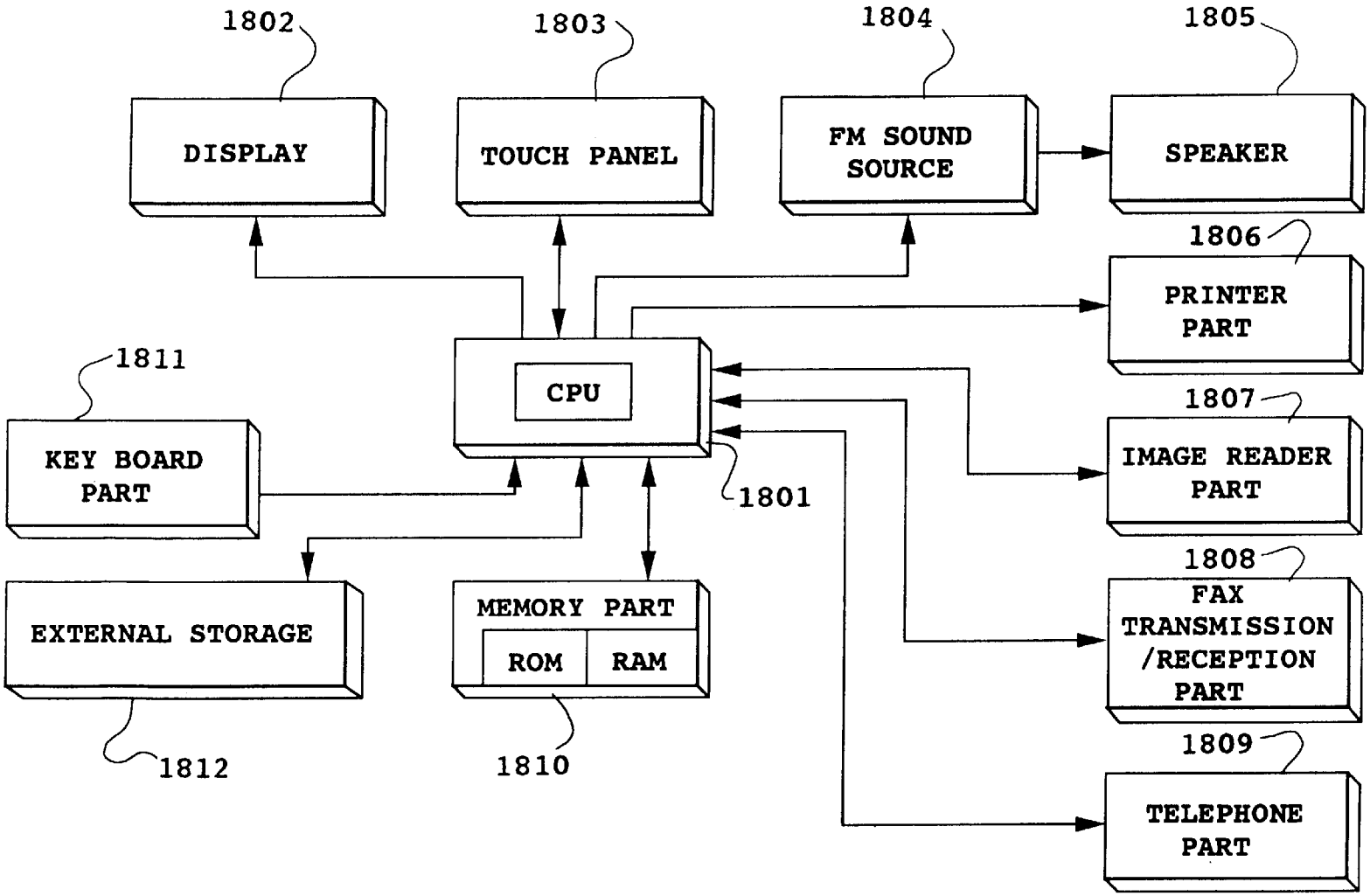
FIG. 64 is a block diagram showing an information processing system using an ink jet printing apparatus of the present invention.

FIG. 64 is a block diagram showing general construction of an information processing apparatus having a function of word processor, personal computer, facsimile machine, a copy machine and so forth, to which the printing apparatus according to the present invention is applied.

In the drawings, a reference numeral 1801 denotes a control part performing control of the overall apparatus, which includes CPU, such as microprocessor and so forth, and various I/O port, to perform control for outputting control signal or data signal and so forth to respective parts and inputting control signal or data signal from the respective parts. A reference numeral 1802 denotes a display part having a display screen, on which various menu, document information and image or so forth read by an image reader 1807 are displayed. A reference numeral 1803 denotes a transparent pressure sensitive touch panel provided on the display part 1802 for performing item entry or coordinate part entry on the display part 1802 by depressing the surface thereof by a finger or so forth.

A reference numeral 1804 denotes a FM (frequency modulation) sound source part which stores music information produced by a music editor and so forth in a memory part 1810 or an external memory 1812 and performs FM modulation by reading out the stored music information from the memory part or so forth. An electric signal from the FM sound source part 1804 is transformed into an audible sound by a speaker part 1805. A printer part 1806 is employed as an output terminal of the word processor, the personal computer, the facsimile machine, the copy machine and so forth, in which the printing apparatus according to the present invention is applied.

A reference numeral 1807 denotes an image reader part for optoelectrically read out an original data for inputting, which is located at the intermediate position in an original feeding path and performs reading out various original document, such as original document for facsimile machine or copy machine. A reference numeral 1808 denotes a facsimile (FAX) transmission and reception part for transmitting original data read by the image reader part or for receiving transmitted facsimile signal, which facsimile transmission and reception part has an external interface function. A reference numeral 1809 denotes a telephone machine part having a normal telephone function and various associated functions, such as a recording telephone and so forth.

A reference numeral 1810 denotes a memory part including a ROM storing a system program, a manager program, other application program and so forth, as well as character fonts, dictionary and so forth, a RAM for storing application program loaded from an external storage device 1812, document information, video information and so forth.

A reference numeral 1811 denotes a keyboard part inputting document information or various commands. A reference numeral 1812 denotes the external storage device employing a floppy disc or hard disc drive as storage medium. In the external storage device 1812, document information, music or speech information, application program of the user and so forth are stored.

Figure 65:
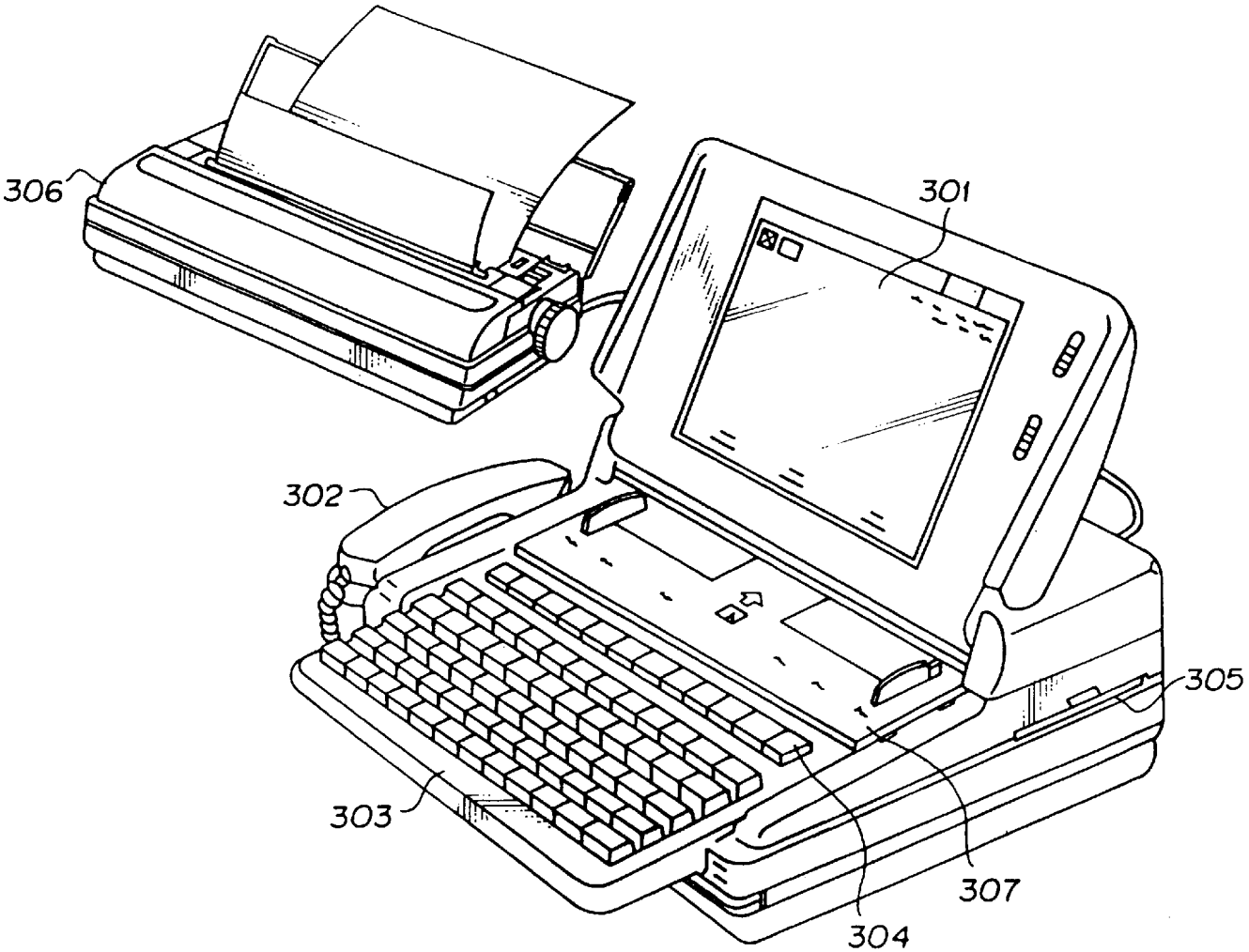
FIG. 65 is a schematic perspective view showing an appearance of the information processing system shown in FIG. 64.

FIG. 65 is a diagrammatic external view of the information processing system shown in FIG. 64.

In FIG. 65, a reference numeral 1901 denotes a flat panel display utilizing a liquid crystal and so forth. On this display, the touch panel 1803 is overlaid so that coordinate position input or item designation input can be performed by depressing the surface of the touch panel 1803 by a finger or so forth. A reference numeral 1902 denotes a handset to be used when a function as the telephone machine of the apparatus is used. A keyboard is detachably connected to a main body of the apparatus through a cable and adapted to permit entry of various document information or various data input. On the other hand, on the keyboard 1903, various function keys and so forth are arranged. A reference numeral 1905 denotes an insertion mouth of the external storage device 1812 for accommodating a floppy disk inserted thereinto.

A reference numeral 1906 denotes a paper stacking part for stacking the original to be read by the image reader part 1807. The original read by the image reader part is discharged from the back part of the apparatus. On the other hand, in facsimile reception, the received information is printed by the ink-jet printer 1907.

It should be noted that while the display part 1802 may be a CRT, it is desirable to employ a flat display panel, such as a liquid crystal display employing a ferrodielectric liquid crystal for capability of down-sizing and reduction of thickness as well as reduction of weight.

When the information processing apparatus as set forth apparatus is operated as the personal computer or the word processor, various information input through the keyboard part 1811 is processed according to a predetermined program by the control part 1801 and output as printed image by the printer part 1806.

When the information processing apparatus is operated as a receiver of the facsimile machine, facsimile information input from the FAX transmission and reception part 1808 via a communication network is subject reception process according to the predetermined program and output as received image by the printer part 1808.

In addition, when the information processing apparatus is operated as a copy machine, the original is read by the image reader part 1807 and the read original data is output to the printer part as copy image via the control part 1801. It should be noted that, when the information processing apparatus is used as the transmitter of the facsimile machine, the original data read by the image reader 1807 is processed for transmission according to the predetermined program by the control part, and thereafter transmitted to the communication network via the FAX transmission and reception part 1808.

Figure 66:
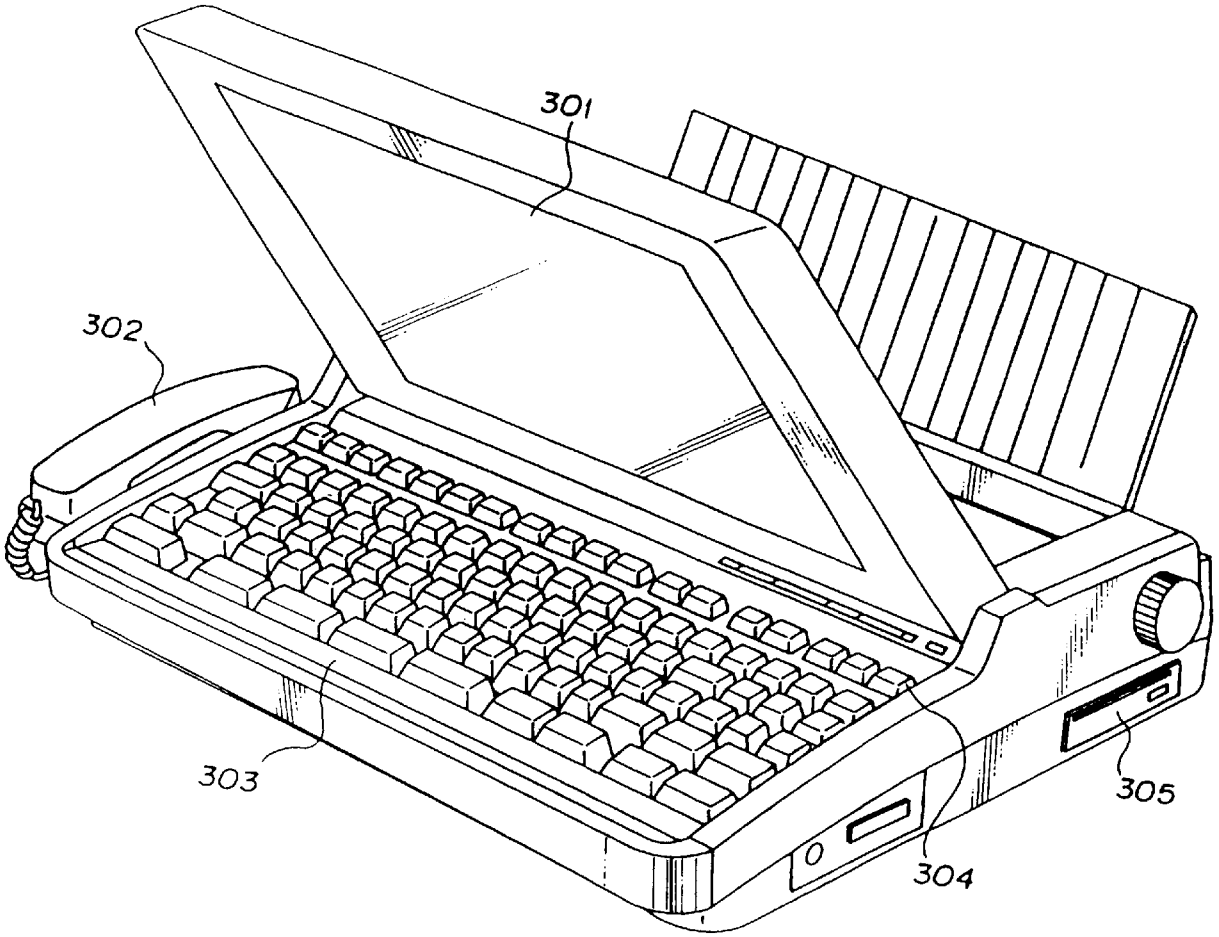
FIG. 66 is a schematic perspective view showing another example of the information processing system.

It should be noted that the information processing apparatus may be an integrated type incorporating the ink-jet printer within a main body as illustrated in FIG. 66. In this case, portability can be further improved. In FIG. 66, the parts having the same function to FIG. 65 are shown with the corresponding reference numerals.

As set forth above, a multi-function type information processing apparatus may obtain high quality printed image at high speed and low noise by employing the printing apparatus of the present invention. Therefore, the functions of the information processing apparatus can be further enhanced.

The present invention has been described in detail with respect to preferred embodiments, and it will be now be that changes and modifications may be made without departing from the invention in its broader aspects, and it is the intention, therefore, in the appended claims to cover all such changes and modifications as fall within the true spirit of the invention.

What is claimed is:

1. An ink jet printing apparatus for printing which uses a first ejector for ejecting an ink and a second ejector for ejecting a liquid for making a coloring agent in the ink at least one of insoluble and coagulated and performs printing on a printing material by ejecting the ink and the liquid from the first and second ejectors, respectively, on said printing material, said apparatus comprising:

a first recovering means for recovering an ejecting condition of said first ejector by discharging the ink from said first ejector;

a second recovering means for recovering an ejecting condition of said second ejector by discharging the liquid from said second ejector;

an ink receiver for receiving the ink discharged by said first recovering means;

a liquid receiver for receiving the liquid discharged by said second recovering means;

a waste tank for holding the discharged ink and the discharged liquid;

a first flow path for introducing the discharged ink from said ink receiver to said waste tank; and a second flow path for introducing the discharged liquid from said liquid receiver to said waste tank, wherein said first flow path and said second flow path are independent of each other, and wherein the waste tank has an ink-absorbing portion and a liquid absorbing portion which are separated from each other so as to contact the ink with the liquid at a boundary region between the ink-absorbing portion and the liquid-absorbing portion, and the first flow path introduces the discharged ink into the ink-absorbing portion and the second flow path introduces the discharged liquid into the liquid-absorbing portion.

2. The ink jet printing apparatus as claimed in claim 1, wherein said first and said second recovering means comprise first and second wiping members for at least said first and second ejectors, respectively.

3. The ink jet printing apparatus as claimed in claim 2, wherein said first and said second wiping members wipe in different directions from one another.

4. The ink jet printing apparatus as claimed in claim 1, wherein said ink receiver comprises a first cap means for capping said first ejectors and said liquid receiver comprises a second cap means for capping said second ejectors.

5. The ink jet printing apparatus as claimed in claim 1, wherein said first and said second recovering means comprise a suction means which performs ink suction for said first ejector and liquid suction for said ejector simultaneously or independently of each other.

6. The ink jet printing apparatus as claimed in claim 4, wherein said first cap means for capping said first ejector and said second cap means for capping said second ejector are not adjacent to each other.

7. The ink jet printing apparatus as claimed in claim 1, wherein said first ejector comprises a plurality of ejectors which ejects different colors, respectively, and wherein a distance between said second ejector and one of said first ejectors which is adjacent to said second ejector is larger than a distance between any adjacent two of said first ejectors.

8. The ink jet printing apparatus as claimed in claim 1, wherein said first and said second ejectors eject said ink and said liquid, respectively, utilizing thermal energy, and further each of said ejectors comprising a thermal energy generating means for generating thermal energy to be applied to said ink and said liquid.

9. The ink jet printing apparatus as claimed in claim 1, wherein said liquid comprises a low molecular weight component and a high molecular weight component comprising a cationic substance, and wherein said ink contains an anionic dye.

10. The ink jet printing apparatus as claimed in claim 1, wherein said liquid comprises a low molecular weight component and a high molecular weight component comprising a cationic substance, and wherein said ink contains an anionic dye or an anionic compound and a pigment.

11. A printed material printed by the use of the ink jet printing apparatus as claimed in claim 1.

12. The ink jet printing apparatus as claimed in claim 4, wherein said first cap means for capping said first ejector is arranged on a side of a printing region and said second capping means for capping said second ejector is arranged on an opposite side thereto.

13. The ink jet printing apparatus as claimed in claim 1, wherein said recovering means performs an operaton for sucking an ink and a liquid from said first and said second ejectors, respectively.

14. The ink jet printing apparatus as claimed in claim 1, wherein said recovering means performs a preliminary ejection for ejecting an ink and a liquid from said first and said second ejectors, respectively.

15. An ink jet printing apparatus for printing which uses a first ejector for ejecting an ink and a second ejector for ejecting a liquid for making a coloring agent in the ink at least one of insoluble and coagulated and performs printing on a printing material by ejecting the ink and the liquid from the first and second ejectors, respectively, on said printing material, said apparatus comprising:

an ink receiver for receiving the ink discharged by said first ejector;

a liquid receiver for receiving the liquid discharged by said second ejector;

a first suction means for sucking an ink from said ink receiver;

a second suction means for sucking the liquid from said liquid receiver;

a waste tank for holding the ink sucked by said first suction means and the liquid sucked by said second suction means;

a first flow path for introducing the ink sucked by said first suction means into said waste tank; and a second flow path for introducing the liquid sucked by said second suction means into said waste tank, wherein said first flow path and said second flow path are independent of each other.

16. The ink jet printing apparatus as claimed in claim 15, wherein said first and said second ejectors eject said ink and said liquid, respectively, using thermal energy, and further, each of said ejectors comprises a thermal energy generating means for generating thermal energy that is applied to said ink and said liquid.

* * * * *